US011270532B2

(12) United States Patent
Sakumoto et al.

(10) Patent No.: US 11,270,532 B2
(45) Date of Patent: Mar. 8, 2022

(54) LOCK CONTROL DEVICE, INFORMATION PROCESSING METHOD, PROGRAM, AND COMMUNICATION TERMINAL

(71) Applicant: SONY CORPORATION, Tokyo (JP)

(72) Inventors: Koichi Sakumoto, Tokyo (JP); Tatsuhiro Iida, Tokyo (JP); Taizo Shirai, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 584 days.

(21) Appl. No.: 16/162,842

(22) Filed: Oct. 17, 2018

(65) Prior Publication Data

US 2019/0066423 A1 Feb. 28, 2019

Related U.S. Application Data

(62) Division of application No. 15/556,027, filed as application No. PCT/JP2016/002286 on May 10, 2016, now Pat. No. 10,475,266.

(30) Foreign Application Priority Data

Jun. 2, 2015 (JP) ..... 2015-112092

(51) Int. Cl.

| | |
|---|---|
| ***G07C 9/00*** | (2020.01) |
| ***E05B 19/00*** | (2006.01) |
| ***E05B 47/00*** | (2006.01) |

(52) U.S. Cl.

CPC ..... *G07C 9/00309* (2013.01); *E05B 19/0011* (2013.01); *E05B 47/00* (2013.01);

(Continued)

(58) Field of Classification Search

CPC ..... G07C 9/00309; G07C 2009/00555; G07C 2009/00396; G07C 2009/00769; G07C 2209/63

See application file for complete search history.

(56) References Cited

U.S. PATENT DOCUMENTS

2006/0072755 A1 4/2006 Oskari
2008/0061931 A1* 3/2008 Hermann ..... G07C 9/00309 340/5.72

(Continued)

FOREIGN PATENT DOCUMENTS

CN 102413112 A 4/2012
CN 103793960 A 5/2014

(Continued)

OTHER PUBLICATIONS

Dec. 12, 2019, Chinese Office Action issued for related CN Application No. 201680030073.2.

(Continued)

*Primary Examiner* — Andrew W Bee
(74) *Attorney, Agent, or Firm* — Paratus Law Group, PLLC

(57) ABSTRACT

There is provided a lock control device attachable to a locking mechanism, the lock control device including circuitry configured to receive key information and a process request from a first communication device, the key information including authorization information of the first communication device related to a plurality of types of functions of the lock control device, and determine whether the process request is permitted based on the key information, wherein the key information further includes identification information of the first communication device.

9 Claims, 39 Drawing Sheets

(52) U.S. Cl.
CPC ..... *G07C 9/00* (2013.01); *G07C 9/00174* (2013.01); *G07C 9/00817* (2013.01); *G07C 9/00857* (2013.01); *G07C 9/00904* (2013.01); *E05B 2047/0054* (2013.01); *E05B 2047/0072* (2013.01); *G07C 9/00571* (2013.01); *G07C 2009/00396* (2013.01); *G07C 2009/00412* (2013.01); *G07C 2009/00507* (2013.01); *G07C 2009/00555* (2013.01); *G07C 2009/00769* (2013.01); *G07C 2009/00841* (2013.01); *G07C 2209/02* (2013.01); *G07C 2209/08* (2013.01); *G07C 2209/63* (2013.01)

(56) References Cited

U.S. PATENT DOCUMENTS

| | | | | |
|---|---|---|---|---|
| 2011/0309922 | A1* | 12/2011 | Ghabra ..... | G07C 9/00309 340/426.36 |
| 2013/0335193 | A1 | 12/2013 | Hanson et al. | |
| 2014/0028438 | A1 | 1/2014 | Kuenzi et al. | |
| 2014/0049361 | A1 | 2/2014 | Ahearn et al. | |
| 2016/0343189 | A1* | 11/2016 | Dumas ..... | G07C 9/00309 |

FOREIGN PATENT DOCUMENTS

| | | | |
|---|---|---|---|
| CN | 103873477 | A | 6/2014 |
| JP | S63-032075 | A | 2/1988 |
| JP | 2006-016956 | A | 1/2006 |
| JP | 2007-239347 | A | 9/2007 |

OTHER PUBLICATIONS

Dec. 24, 2019, Japanese Office Action issued for related JP Application No. 2015-112092.
Apr. 16, 2020, Chinese Office Action issued for related CN application No. 201680030073.2.
May 28, 2019, Japanese Office Action issued for related JP Application No. 2015-112092.

* cited by examiner

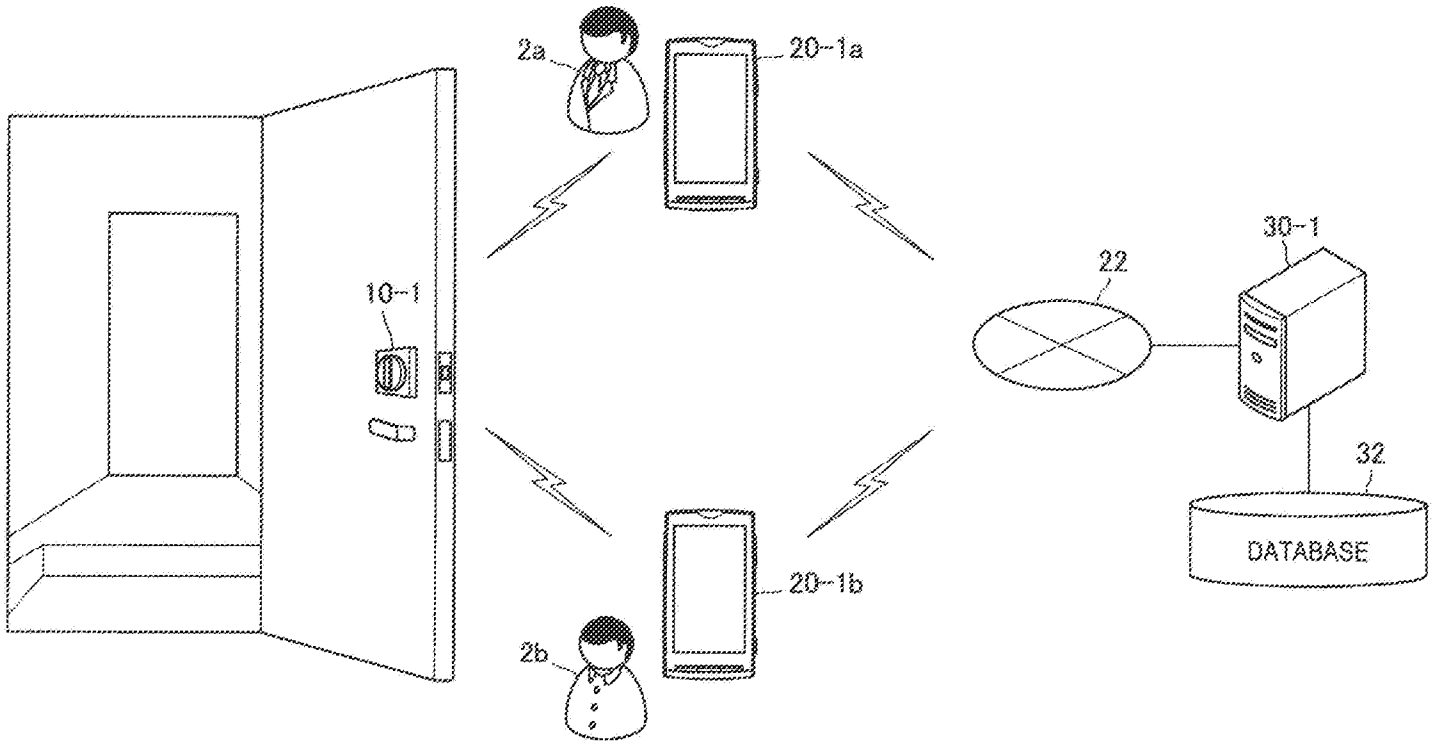
[Fig. 1]

[Fig. 2]
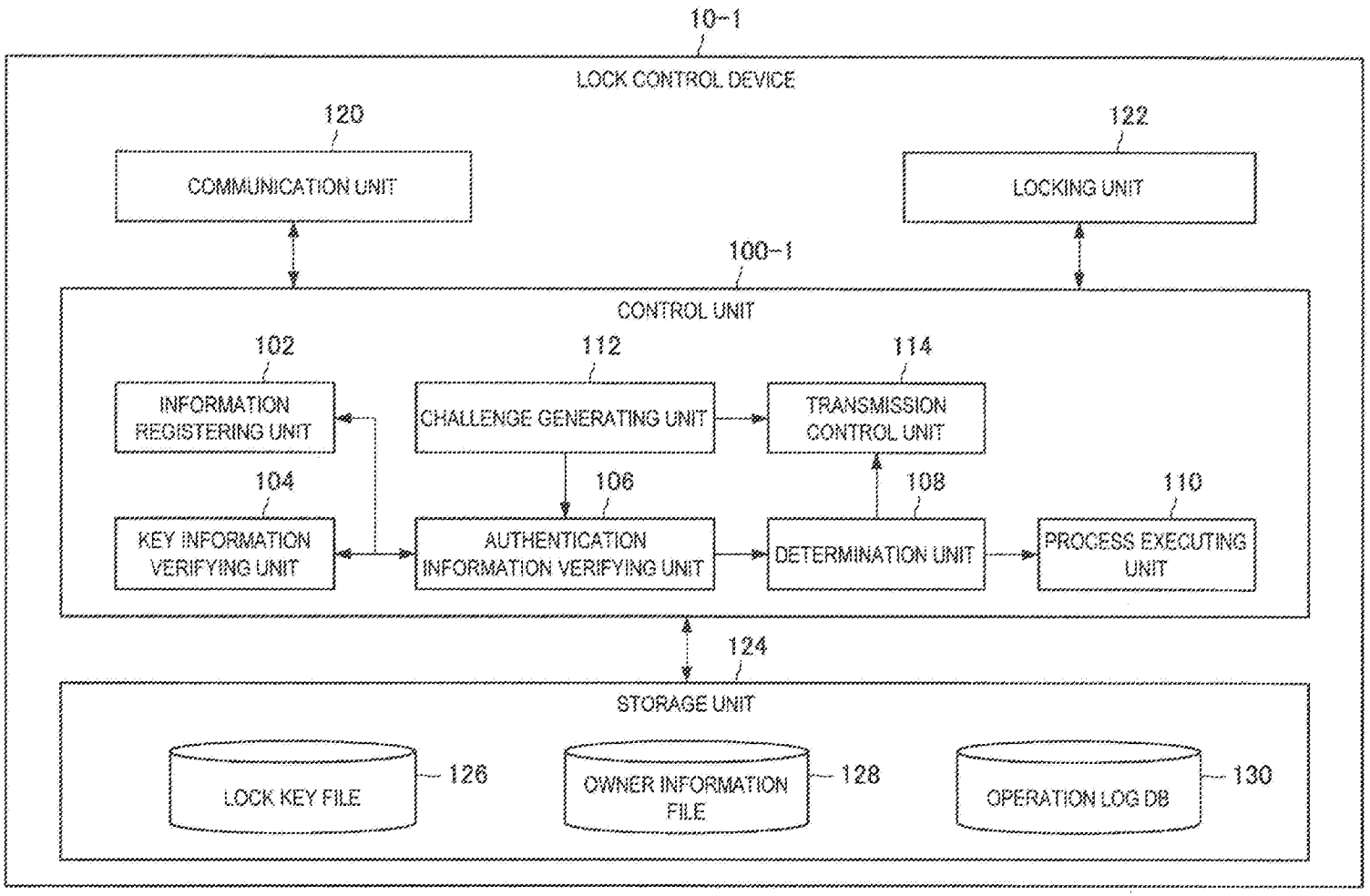

[Fig. 3]

126a

| 1260 | 1262 | 1264 | 1266 |
|---|---|---|---|
| LOCK ID | LOCK COMMON KEY | LOCK SECRET KEY | LOCK PUBLIC KEY |
| 1020 | 183xxx | — | — |

[Fig. 4]

128

| 1280 | 1282 |
|---|---|
| TERMINAL ID | TERMINAL PUBLIC KEY |
| 1234 | ⋮ |

[Fig. 5]
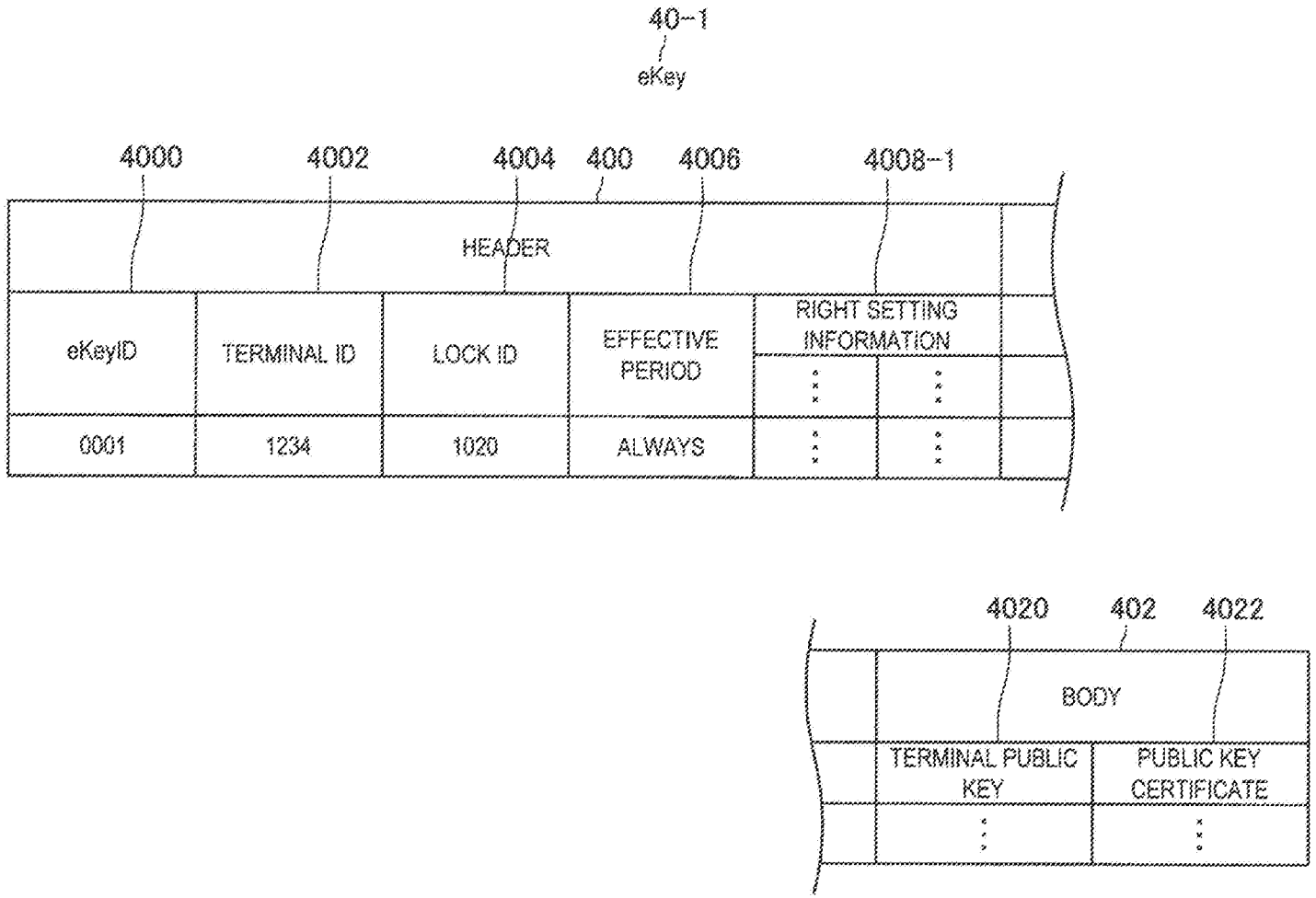

[Fig. 6]
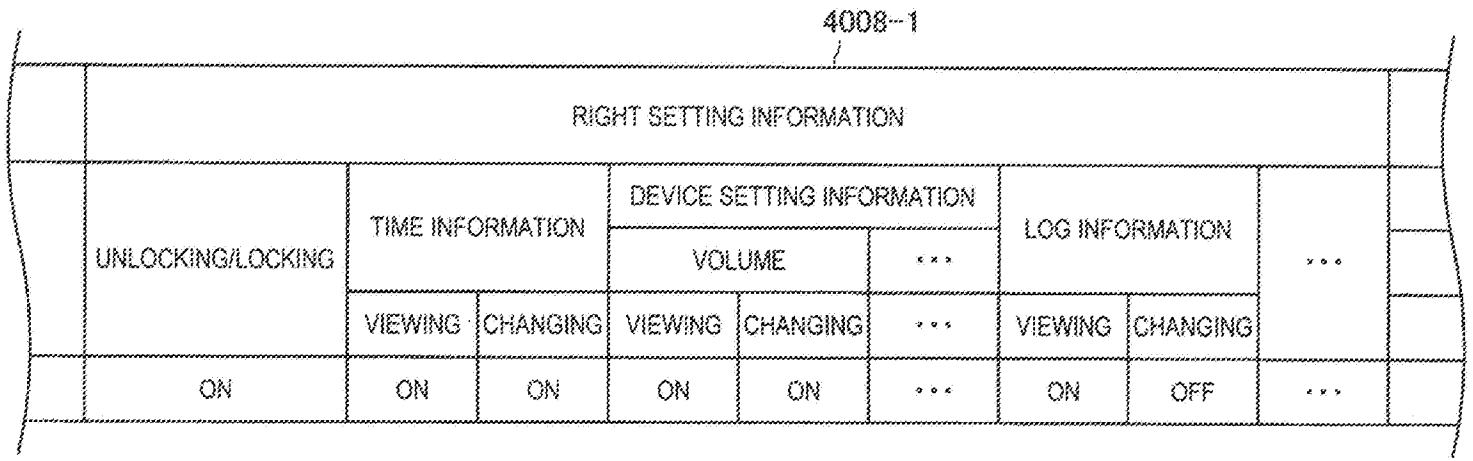

[Fig. 7]
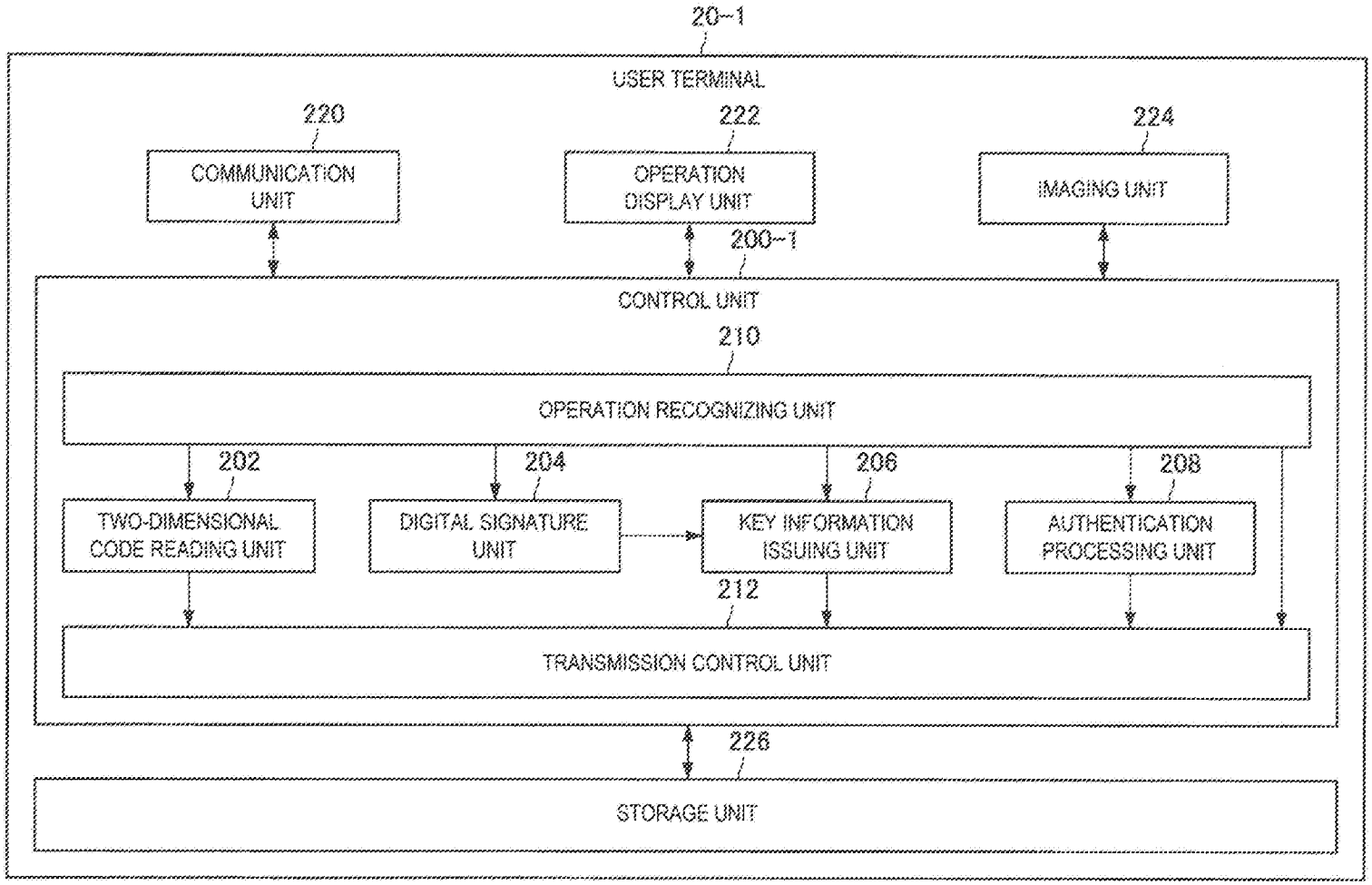

[Fig. 8]
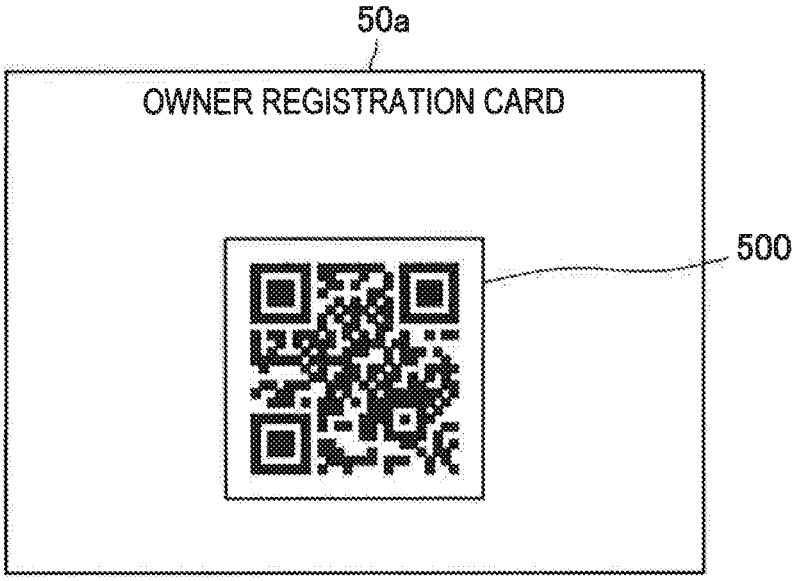
[Fig. 9]
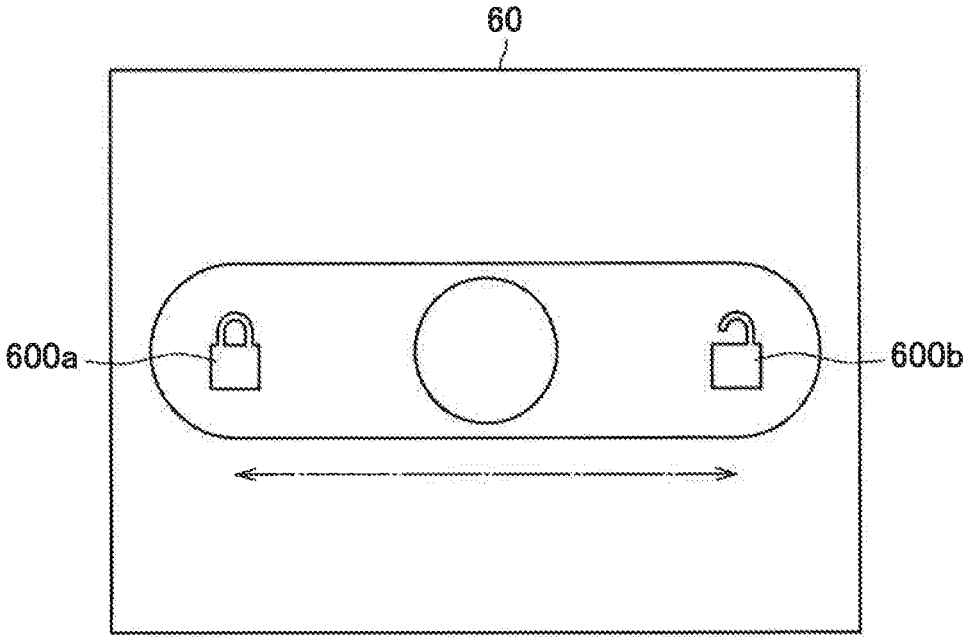

[Fig. 10]
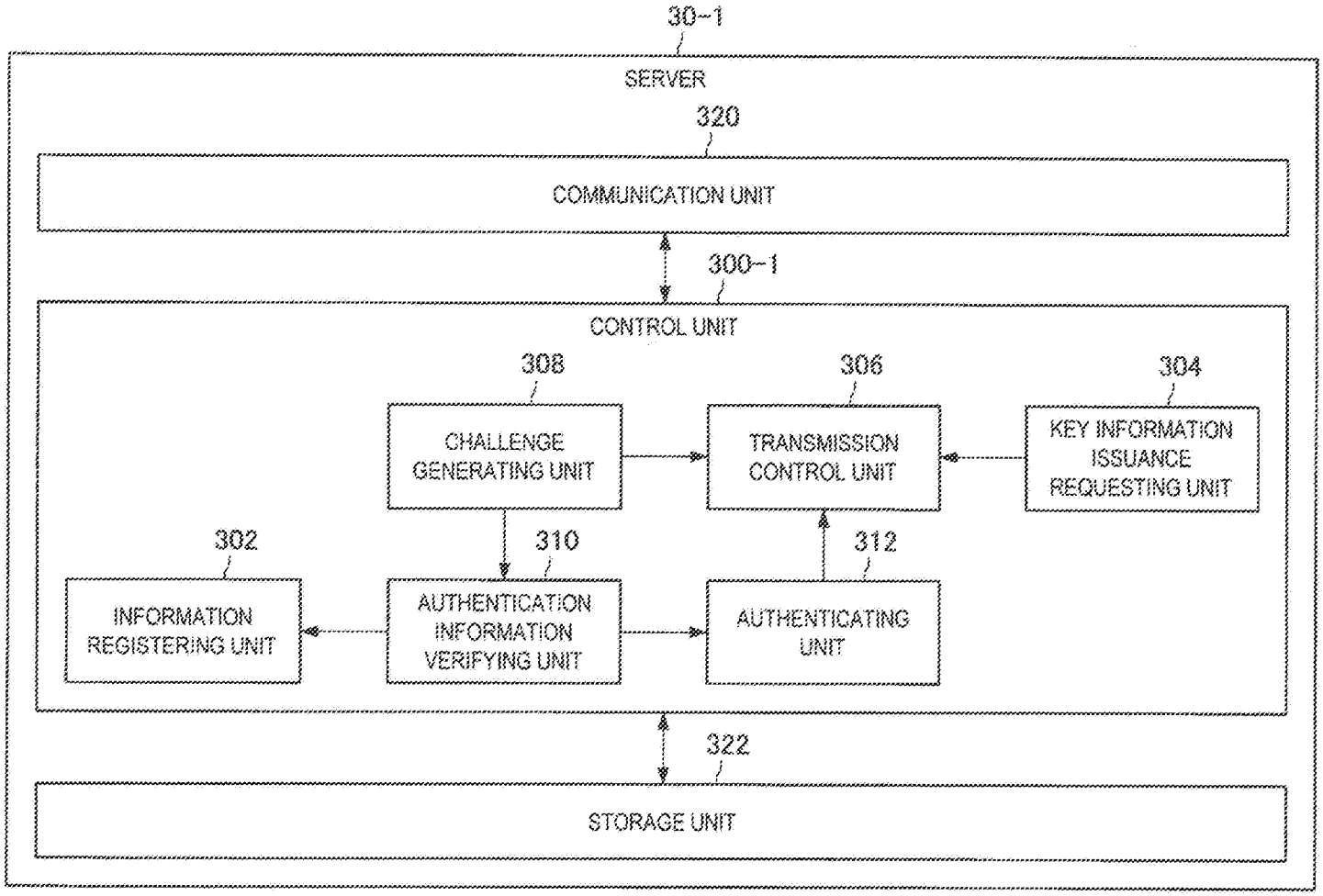

[Fig. 11]

324

| 3240 LOCK ID | 3242 LOCK PUBLIC KEY | 3244 TERMINAL ID | 3246 TERMINAL PUBLIC KEY |
|---|---|---|---|
| 1020 | ⋮ | 1234 | ⋮ |
| 2030 | ⋮ | 3456 | ⋮ |
| ··· | ··· | ··· | ··· |

[Fig. 12]
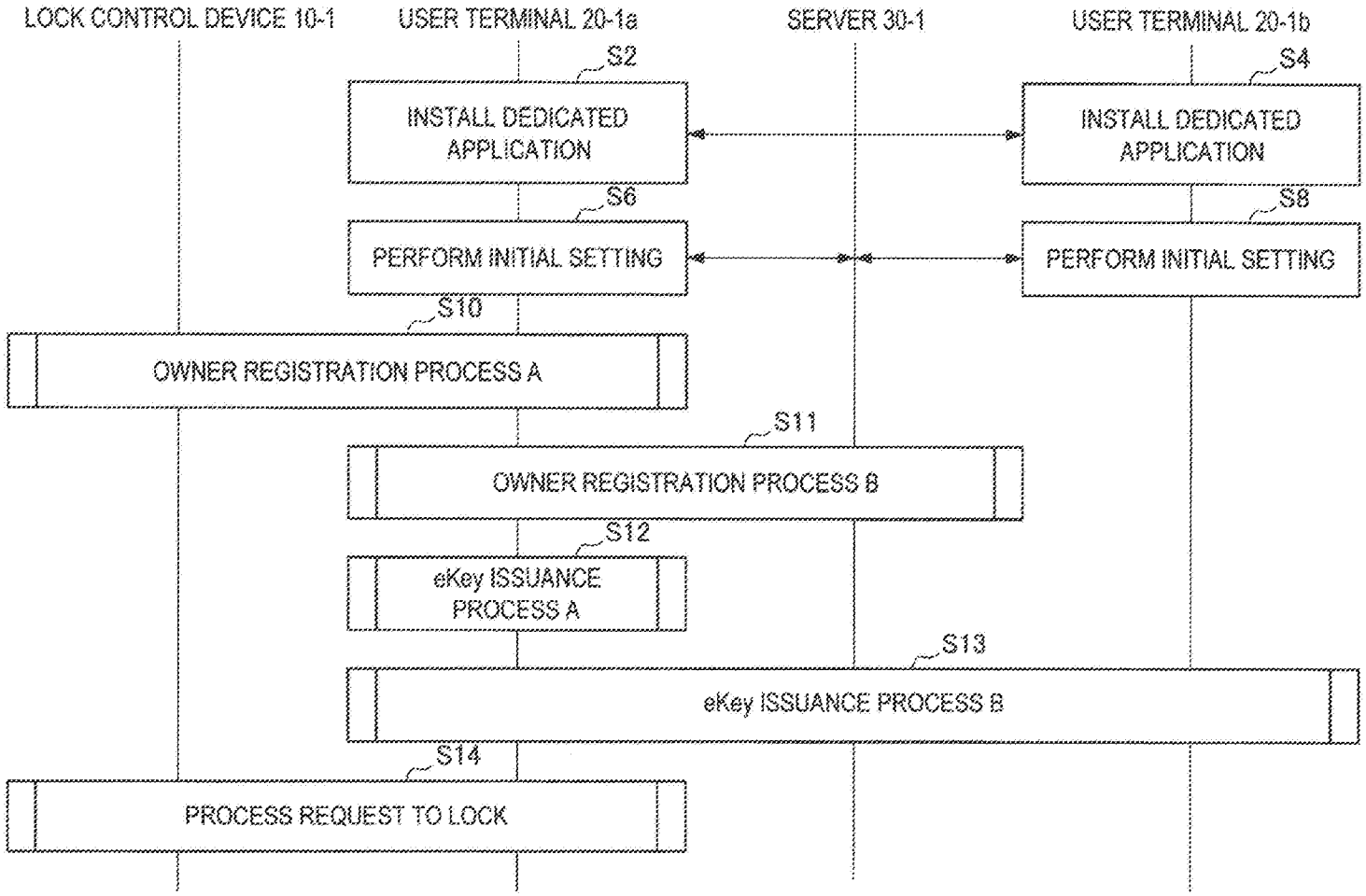

[Fig. 13]
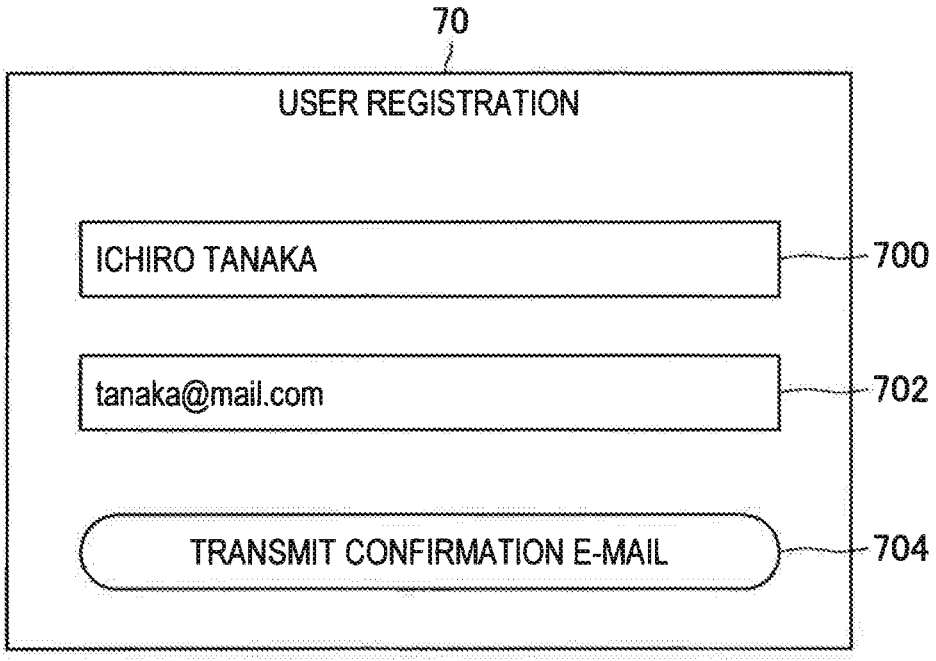
[Fig. 14]
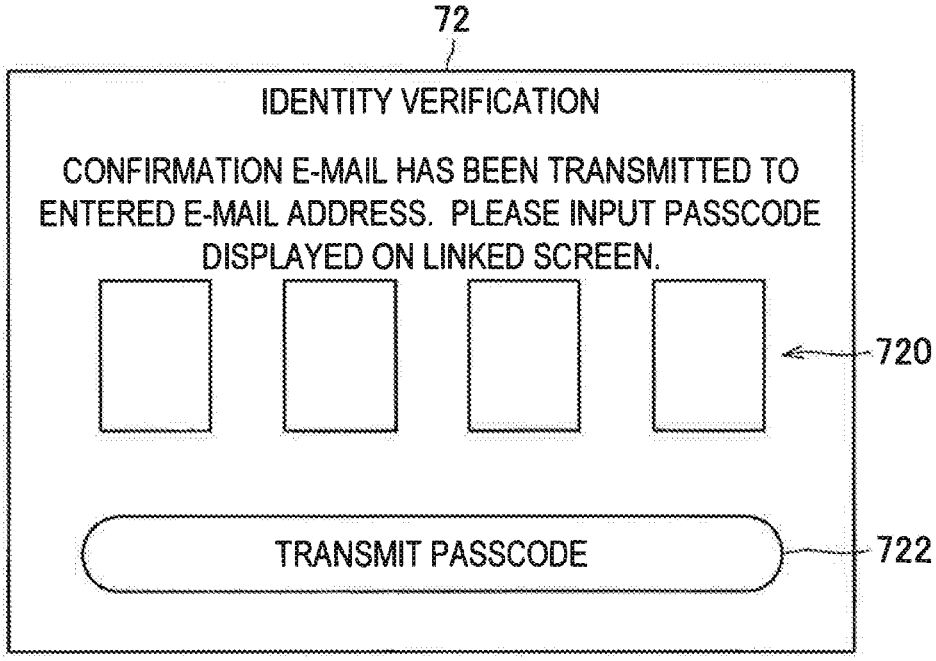

[Fig. 15]
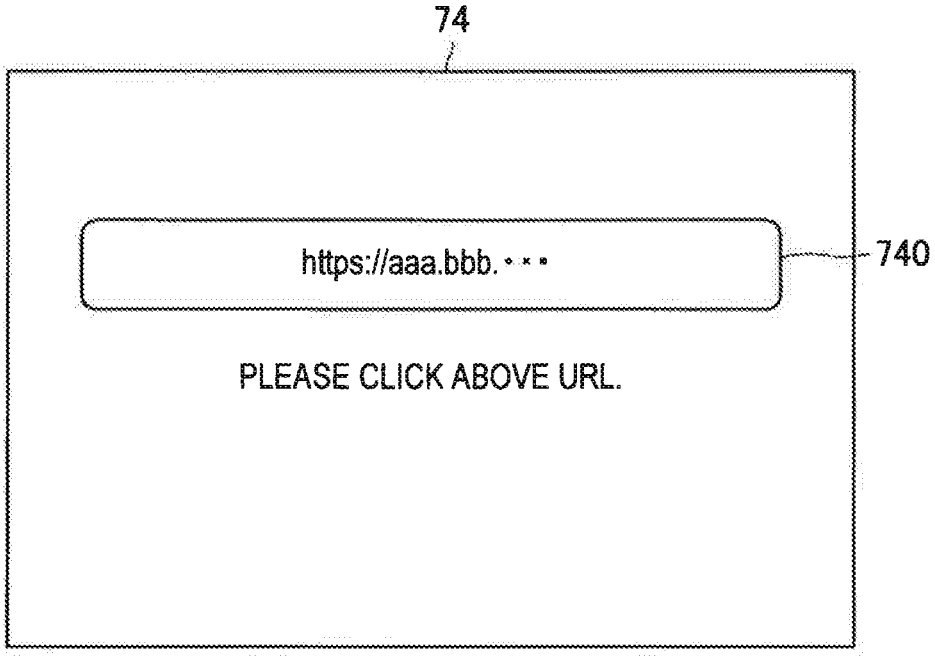
[Fig. 16]
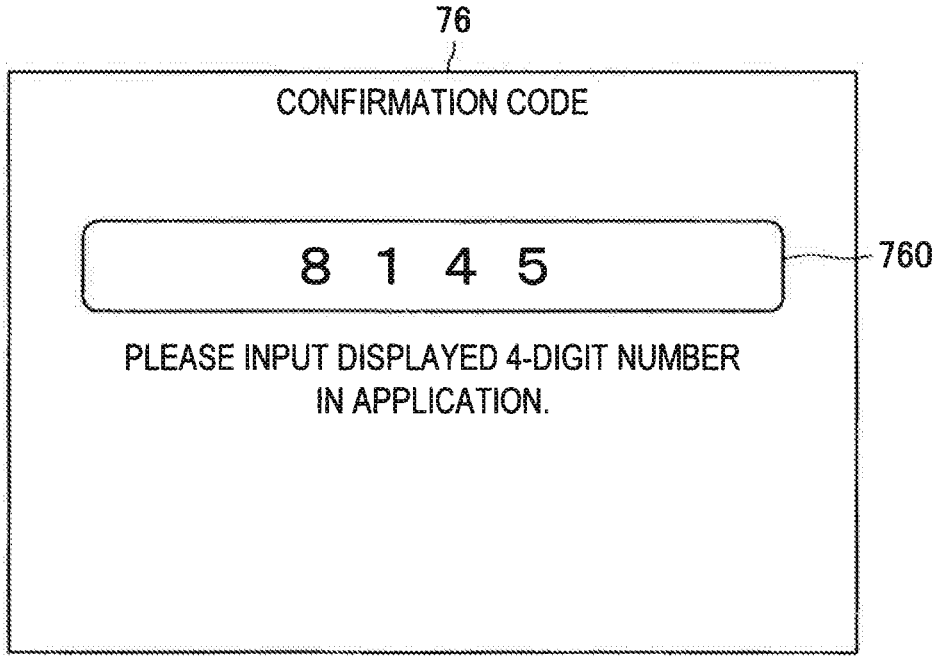

[Fig. 17]
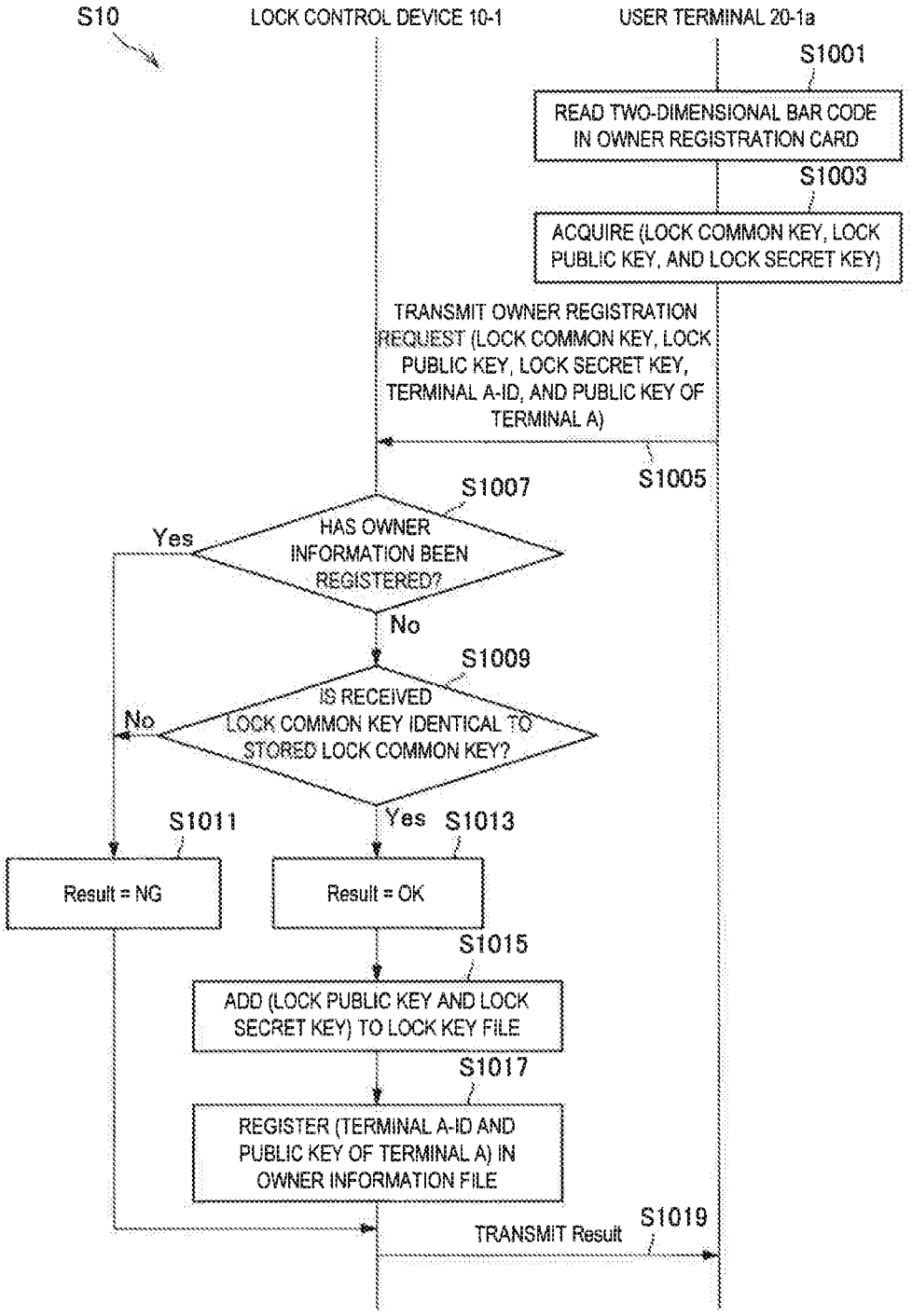

[Fig. 18]
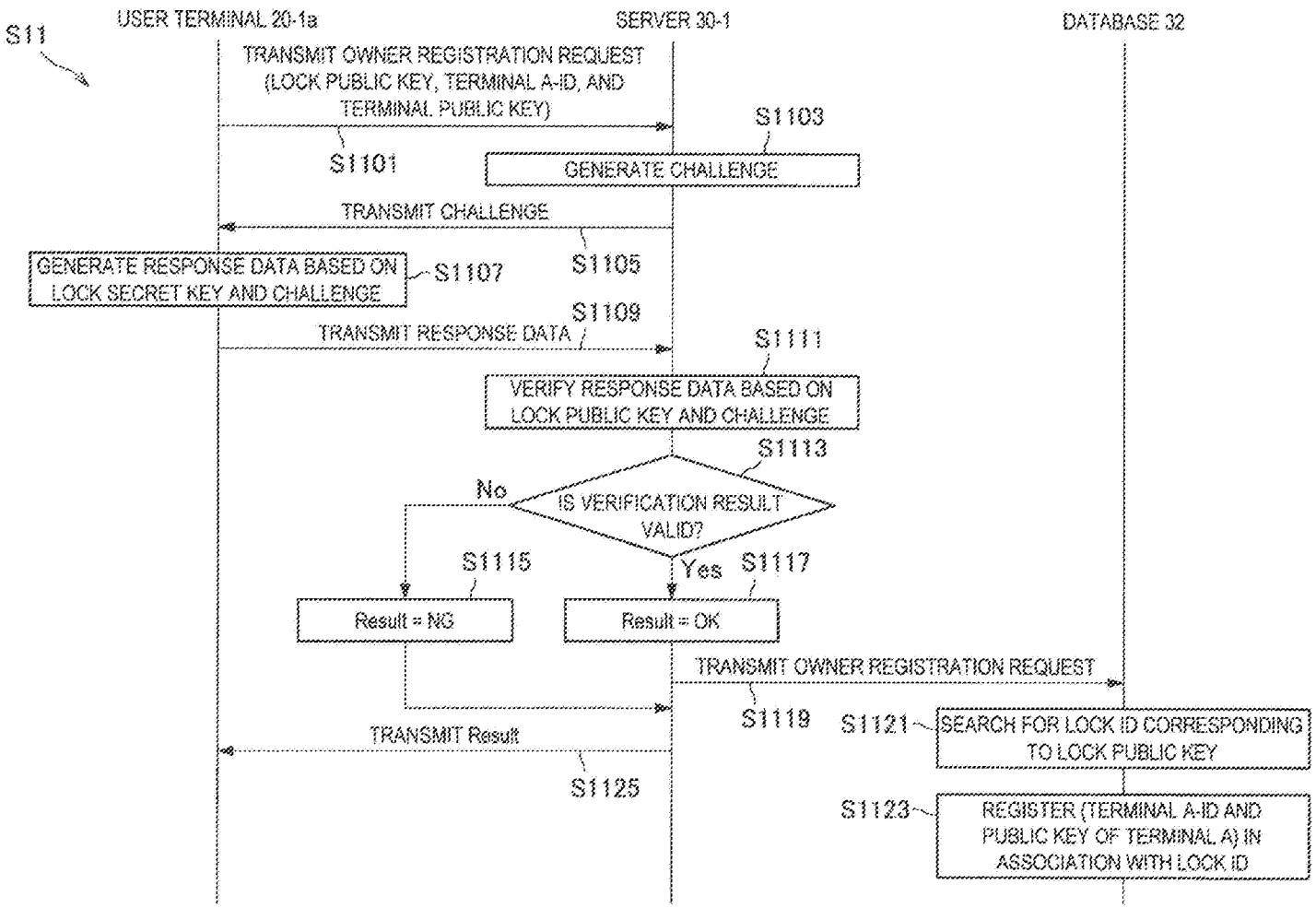

[Fig. 19]
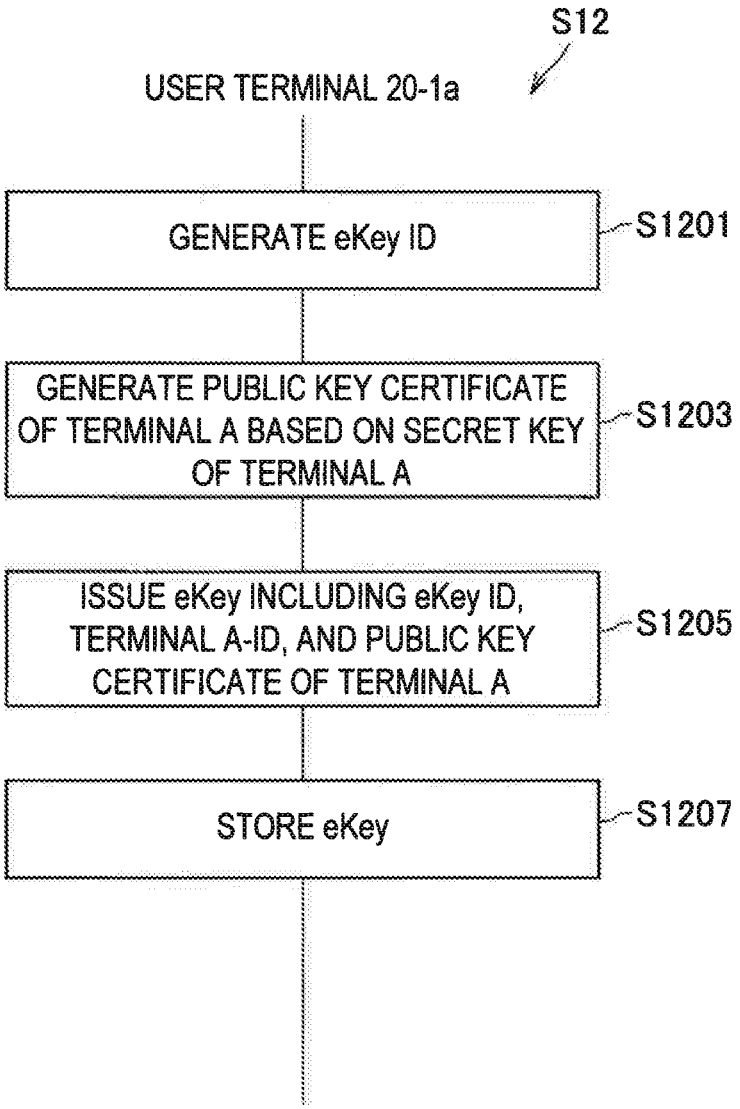

[Fig. 20]
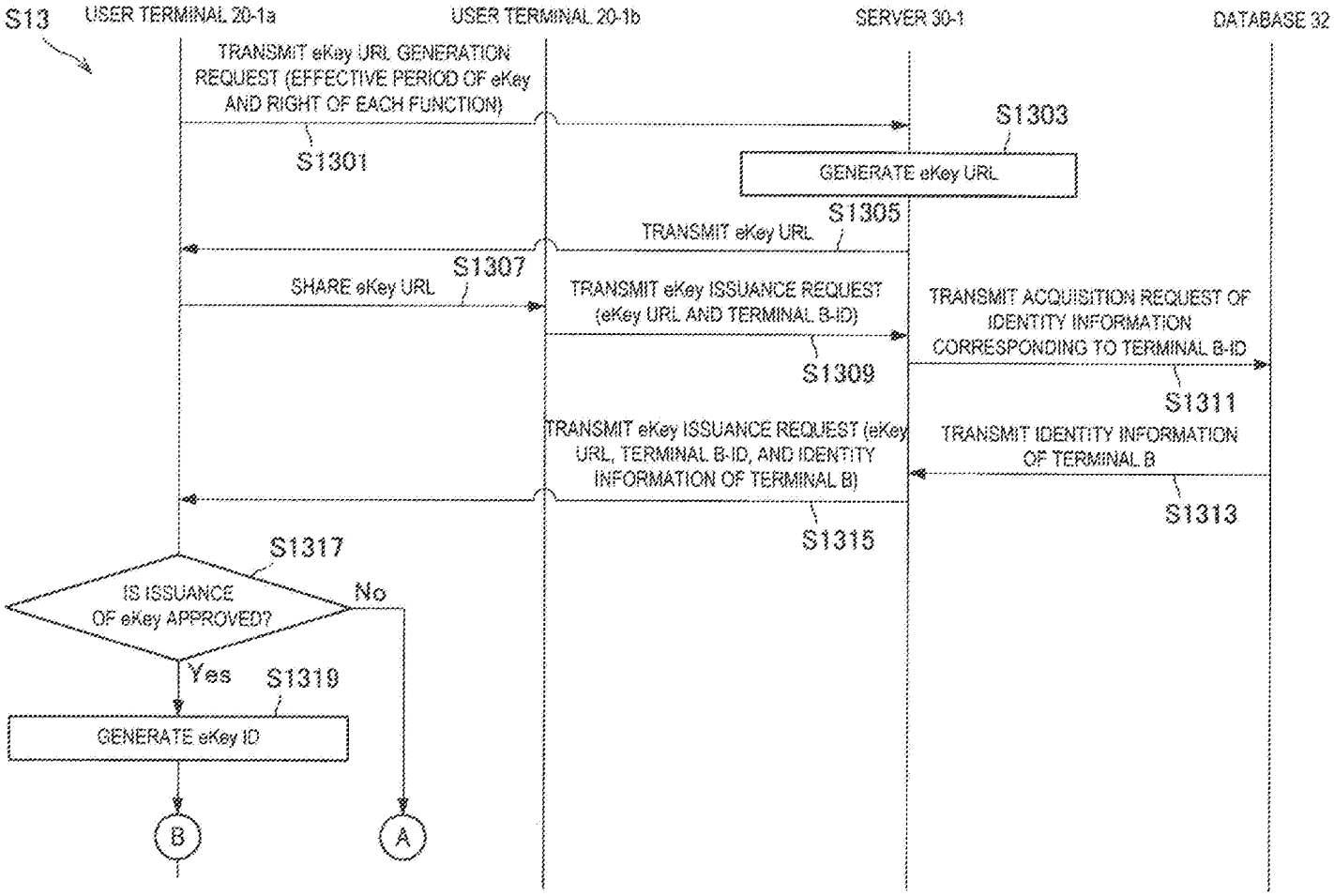

[Fig. 21]
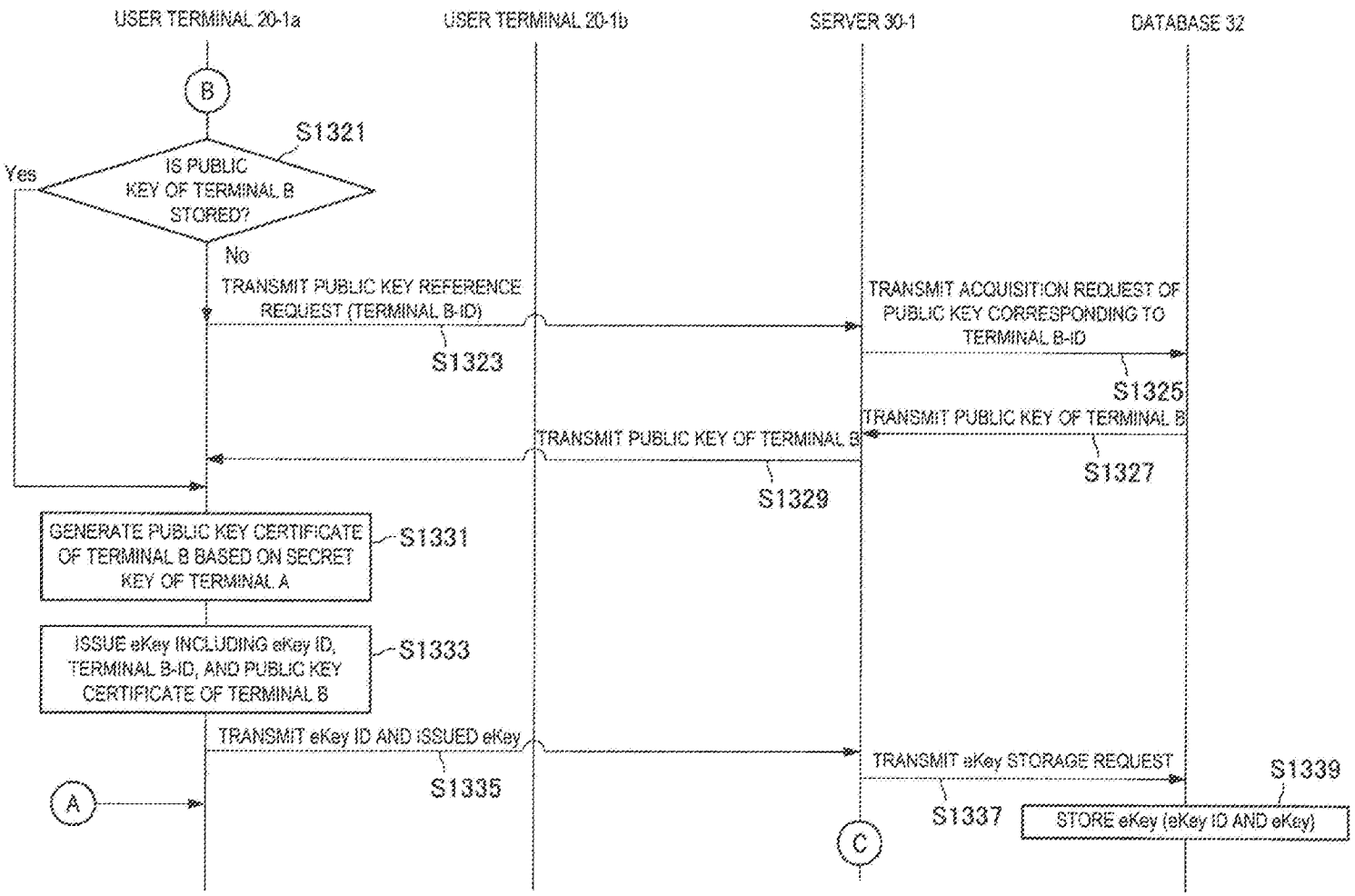

[Fig. 22]
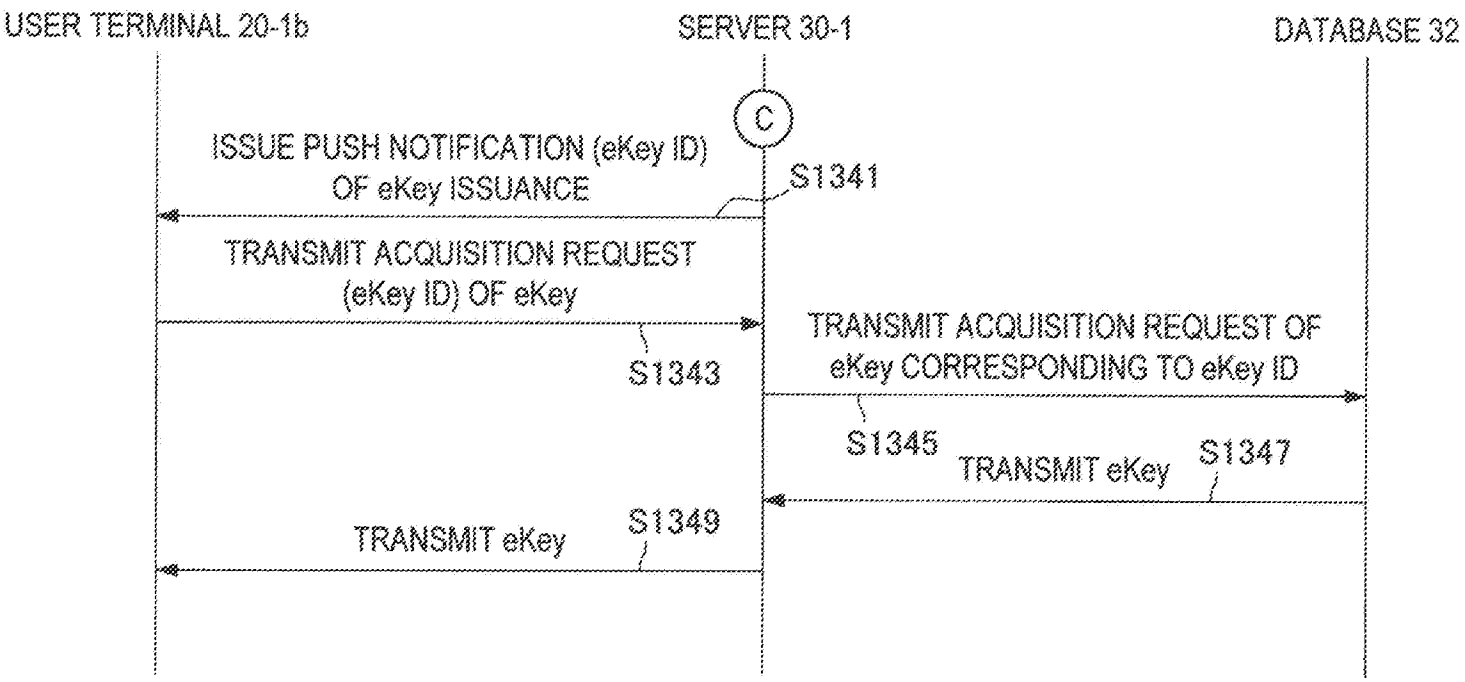

[Fig. 23]
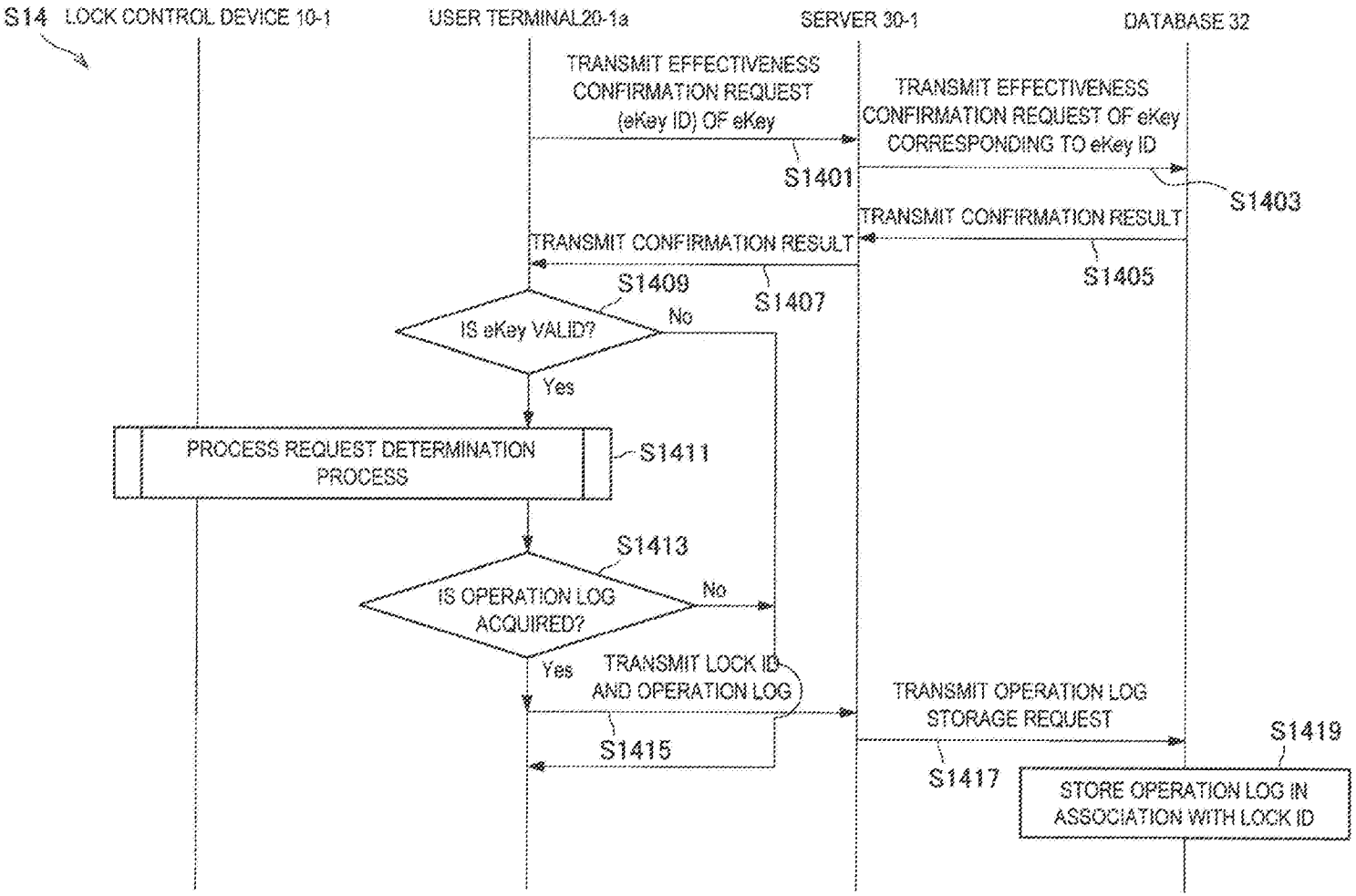

[Fig. 24]
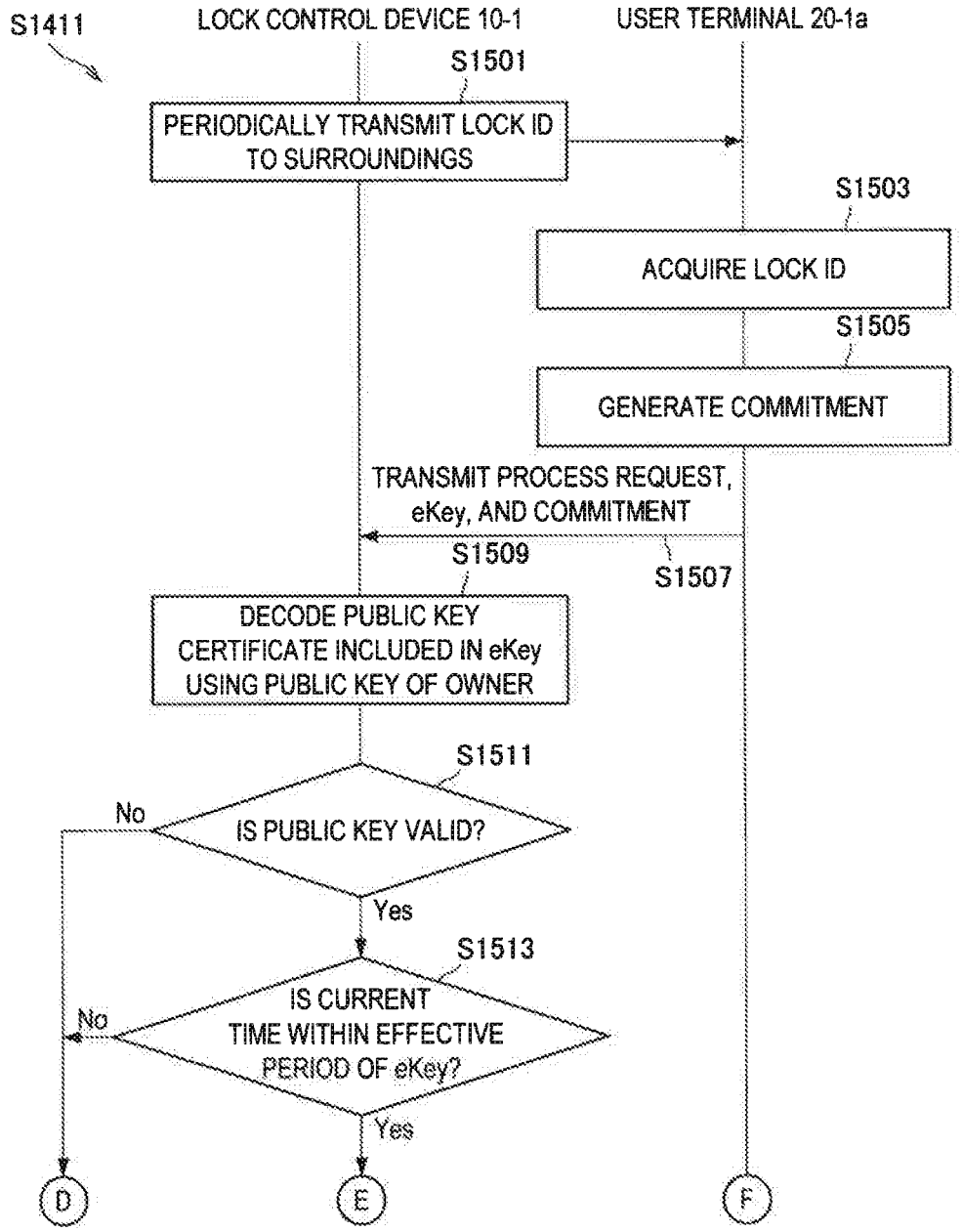

[Fig. 25]
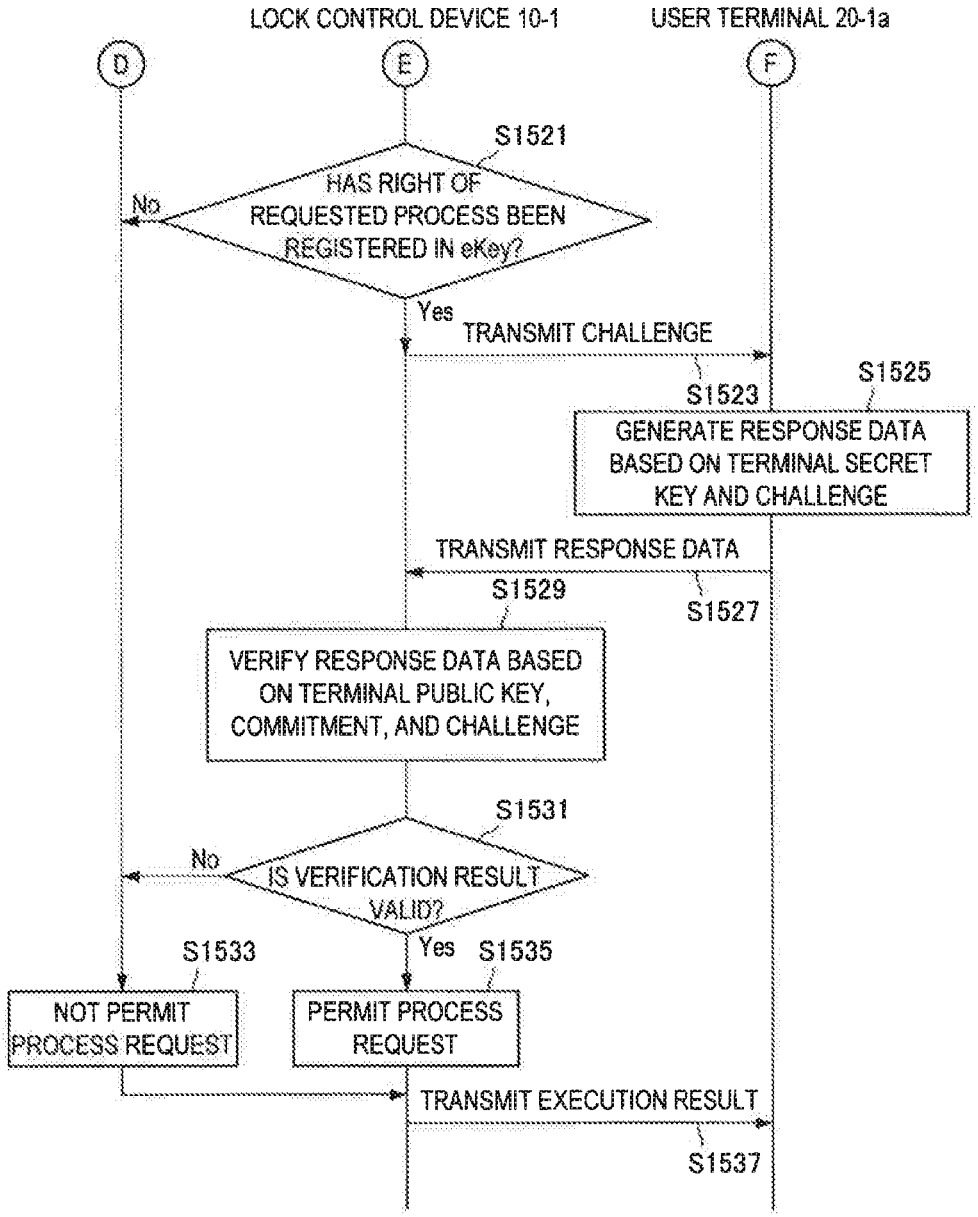

[Fig. 26]
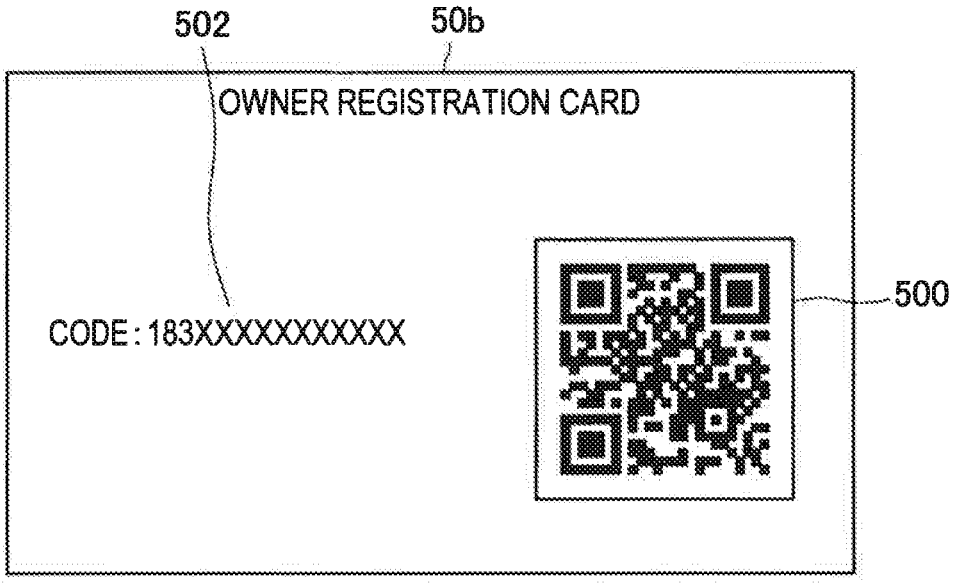
[Fig. 27]
126b
| 1260 | 1262 | 1264 | 1266 |
|---|---|---|---|
| LOCK ID | LOCK COMMON KEY | LOCK SECRET KEY | LOCK PUBLIC KEY |
| 1020 | 183xxx | abc123xxx | xyz246xxx |

[Fig. 28]
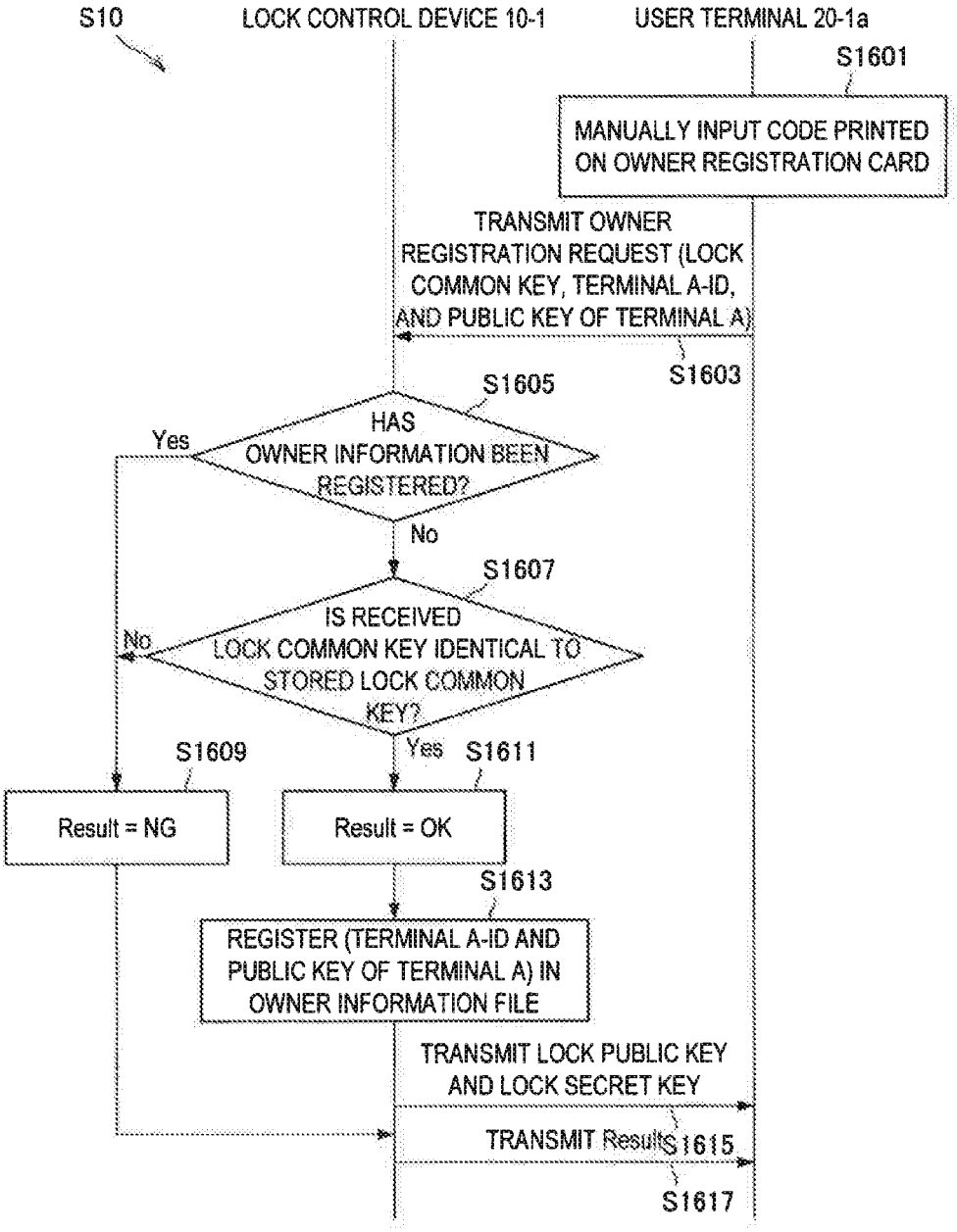

[Fig. 29]
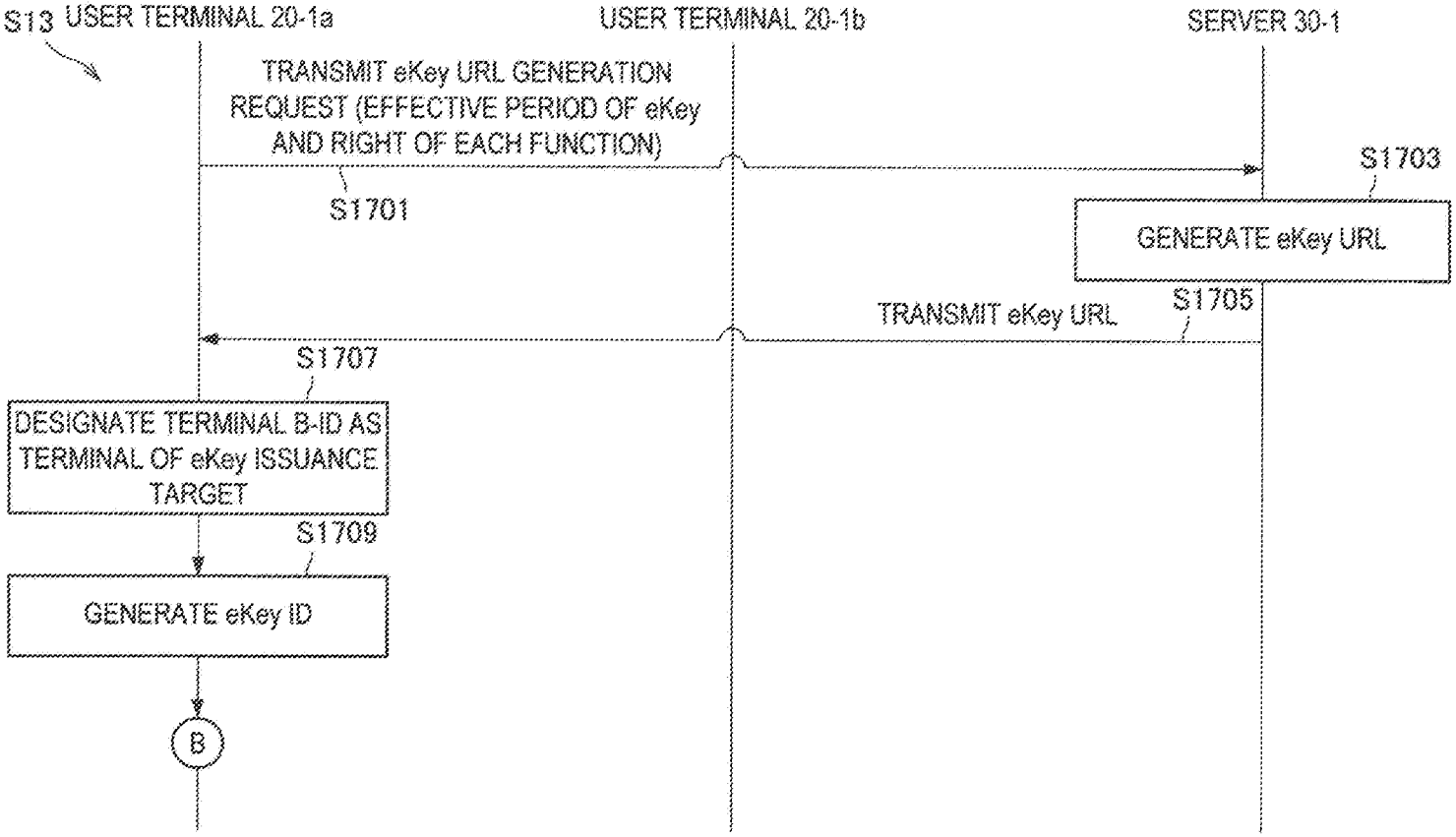

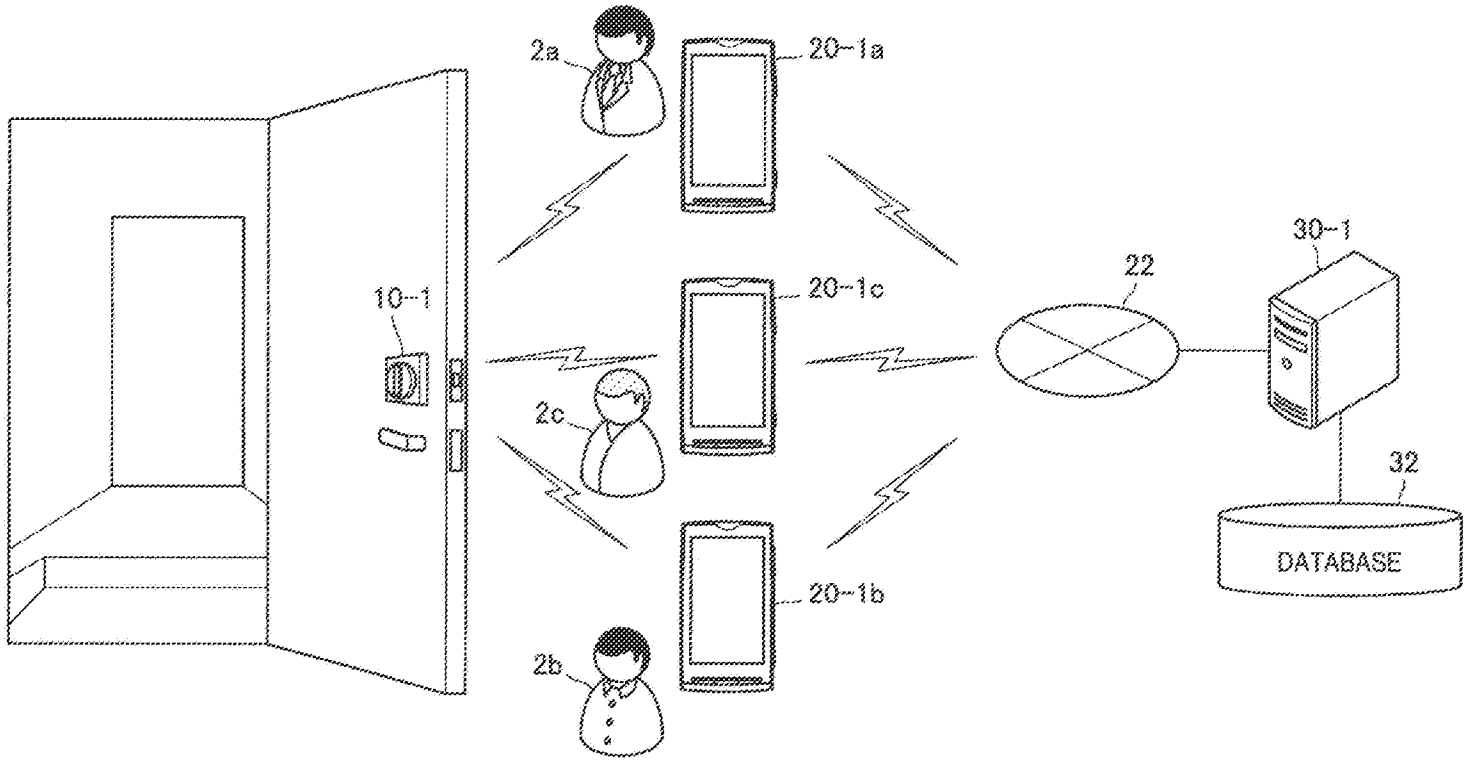
[Fig. 30]

[Fig. 31]
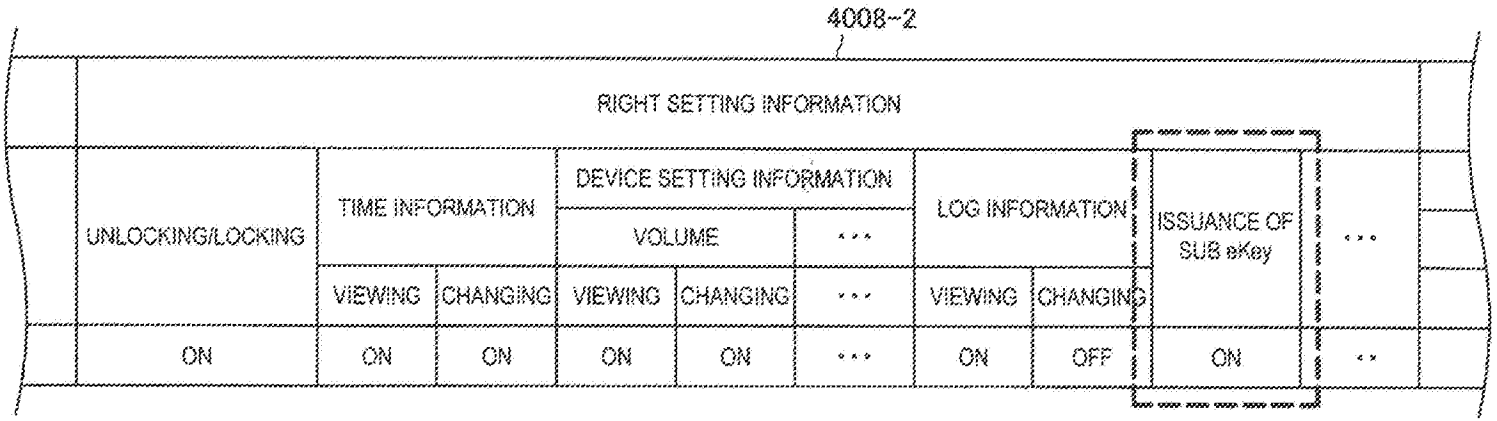

[Fig. 32]
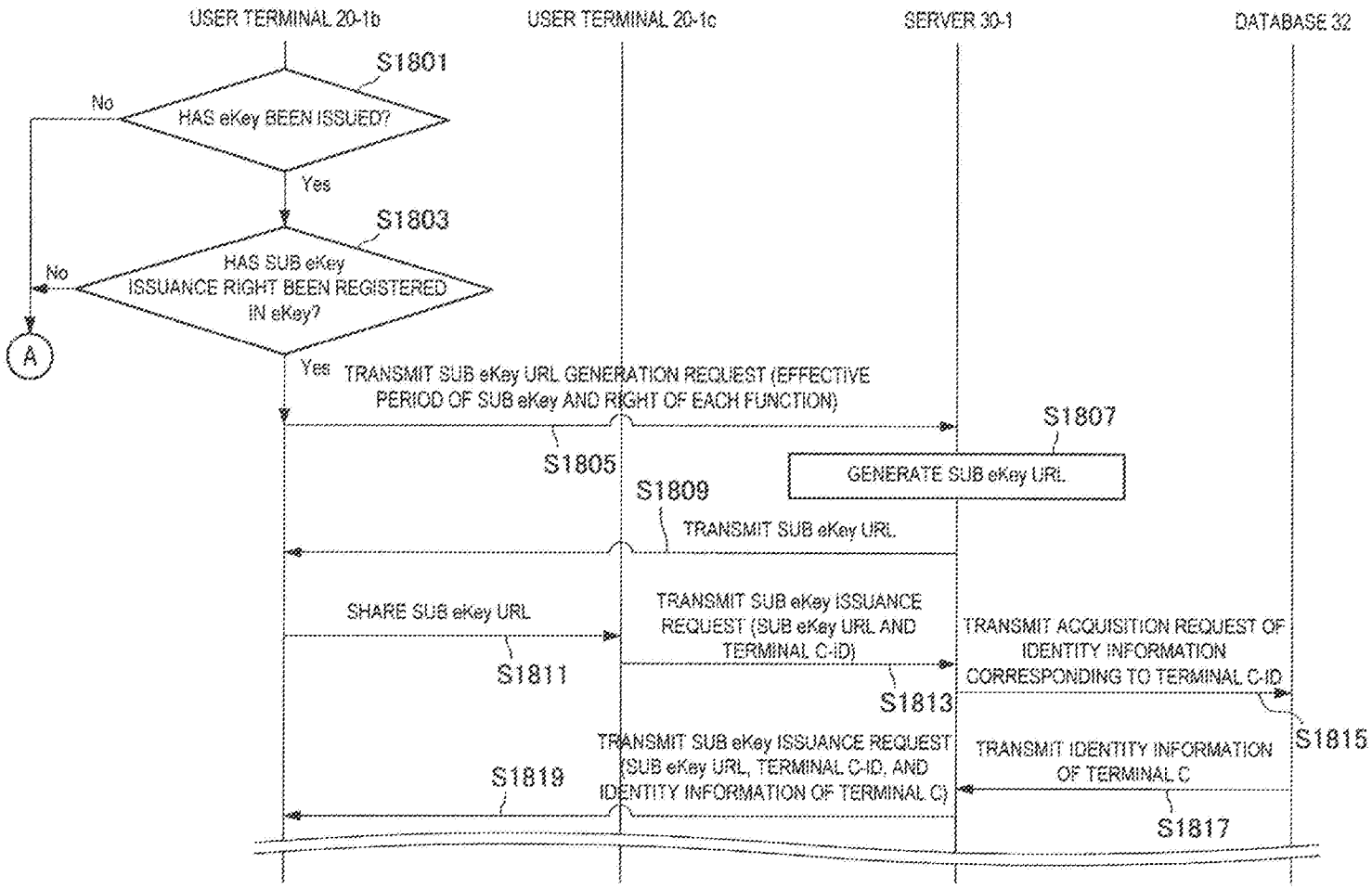

[Fig. 33]
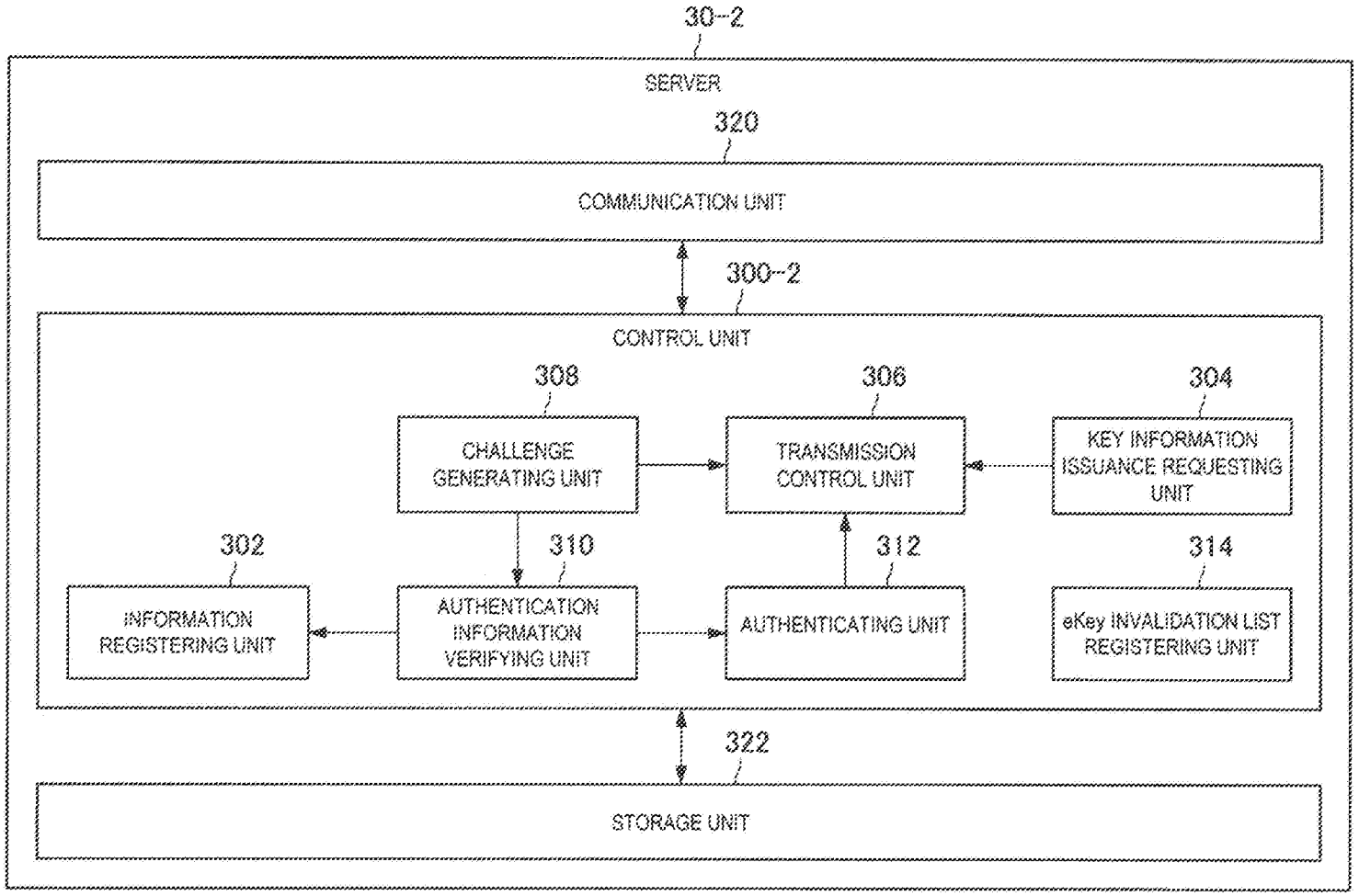

[Fig. 34]
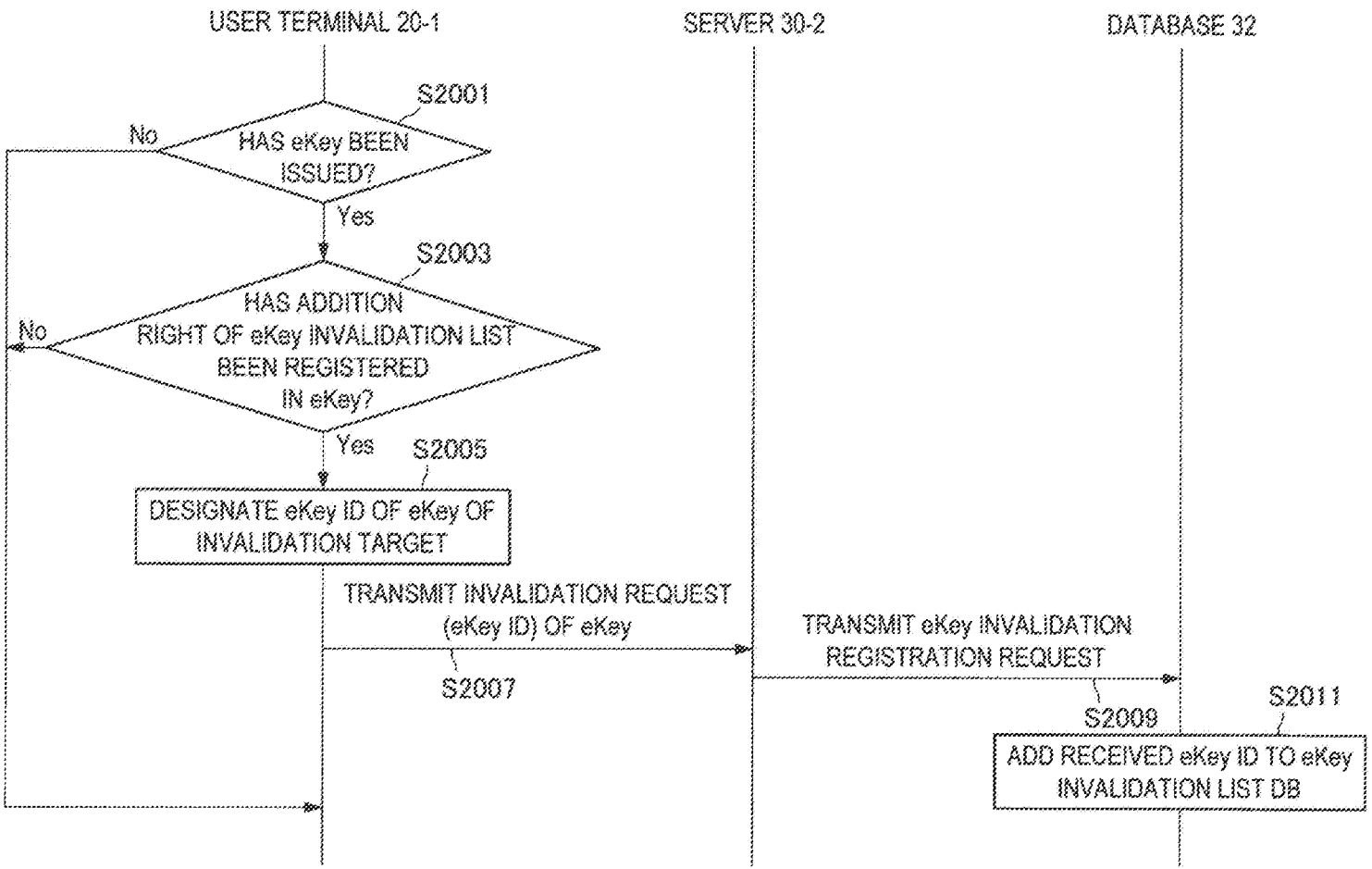

[Fig. 35]
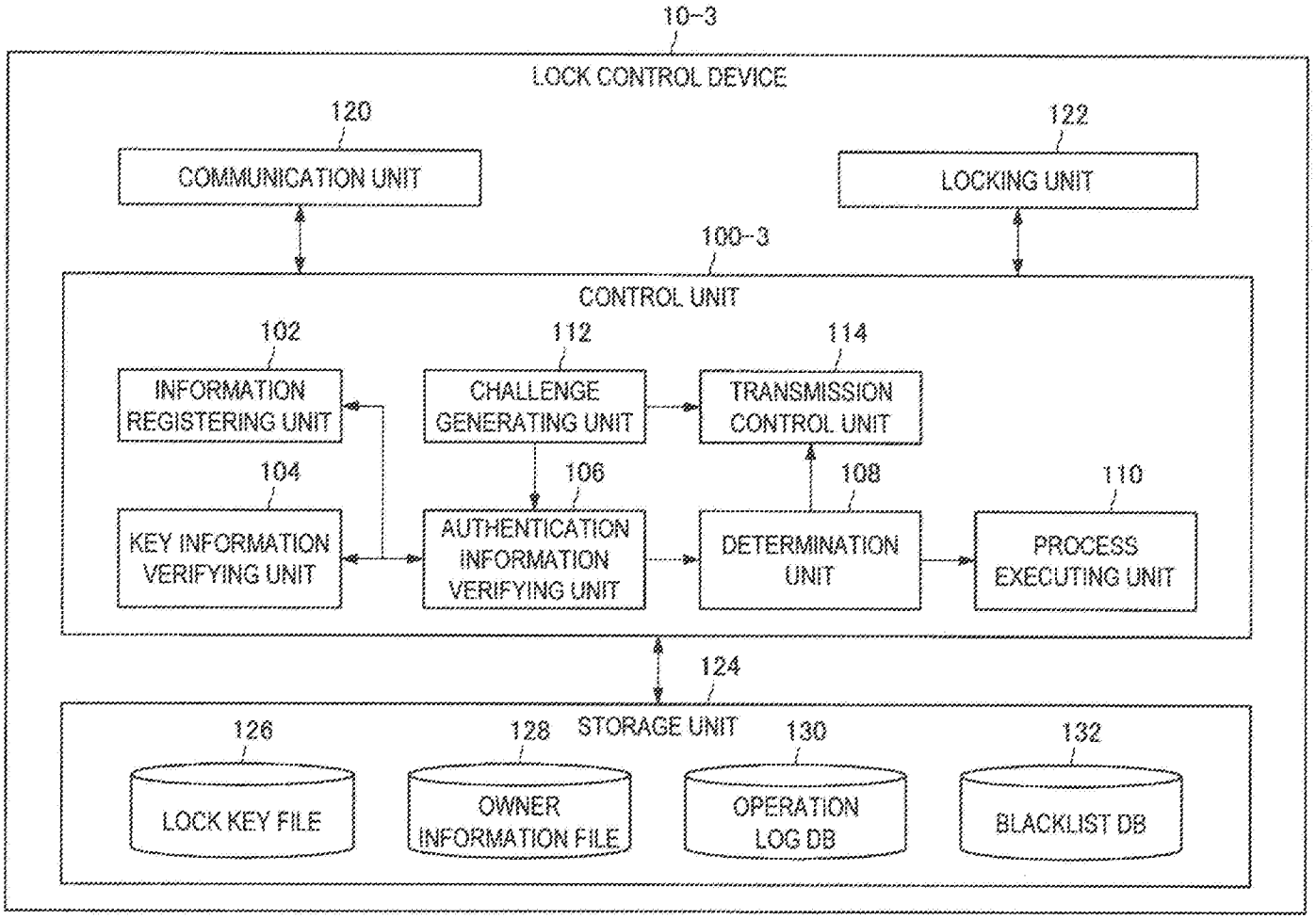

[Fig. 36]
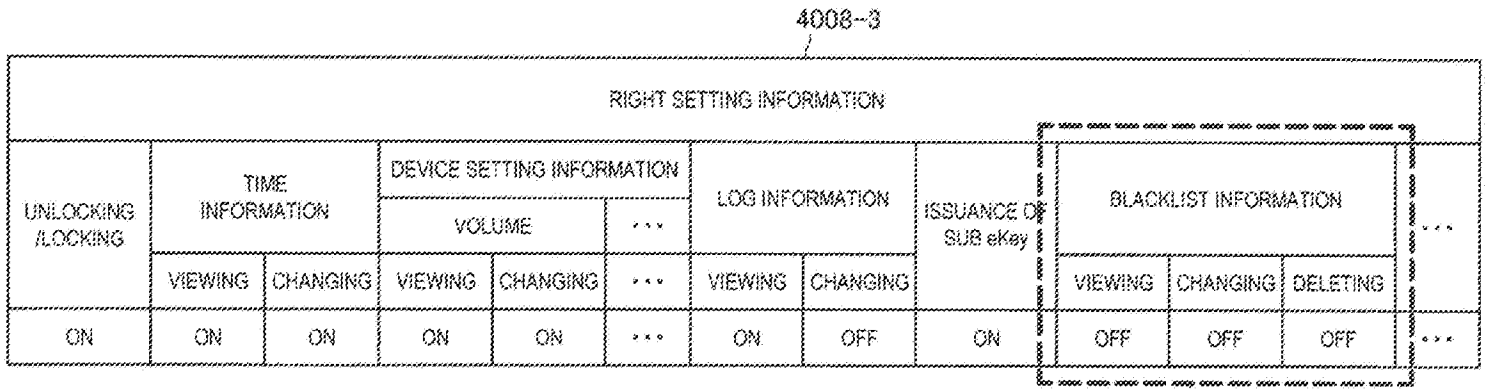

[Fig. 37]
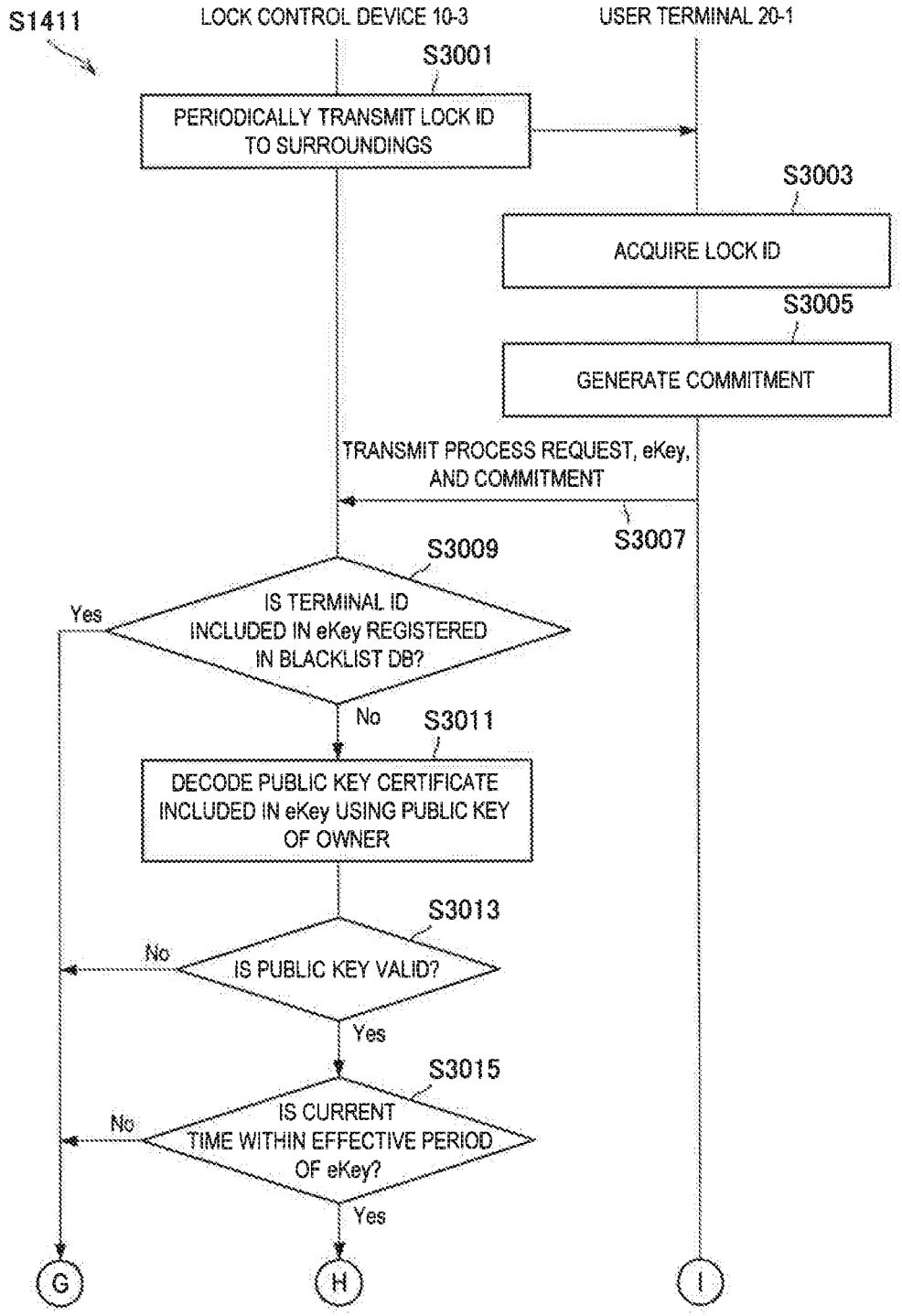

[Fig. 38]
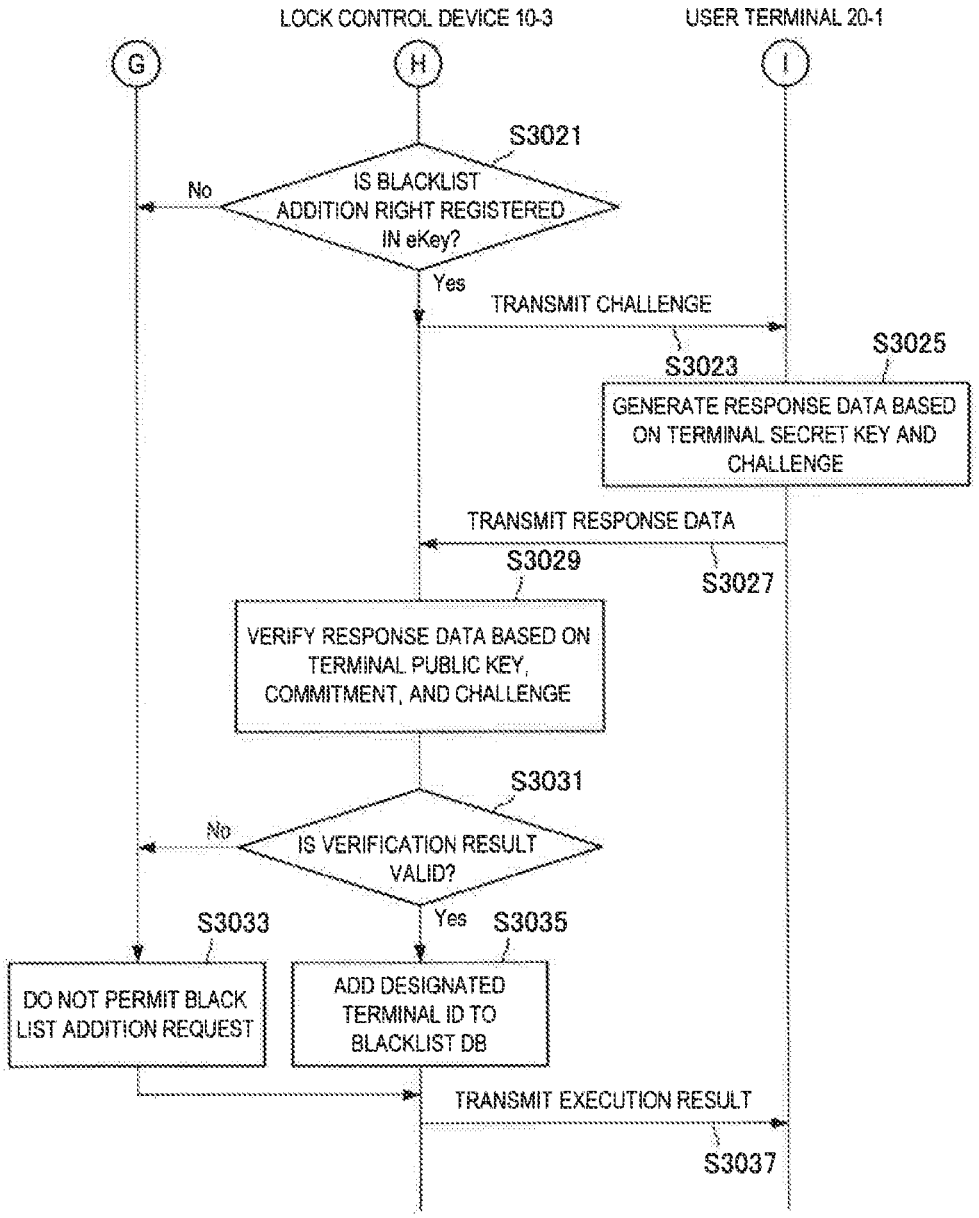

[Fig. 39]
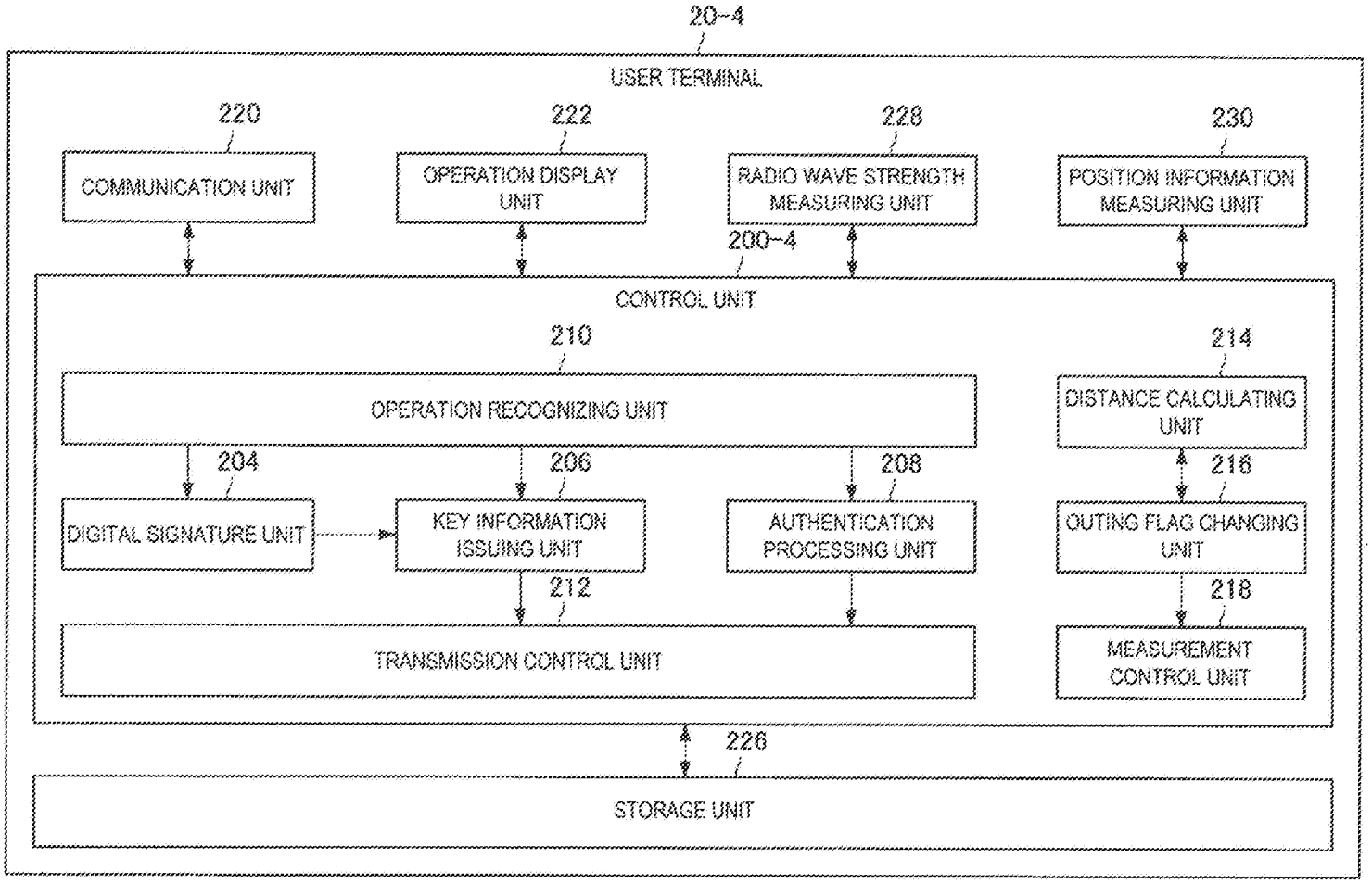

[Fig. 40]
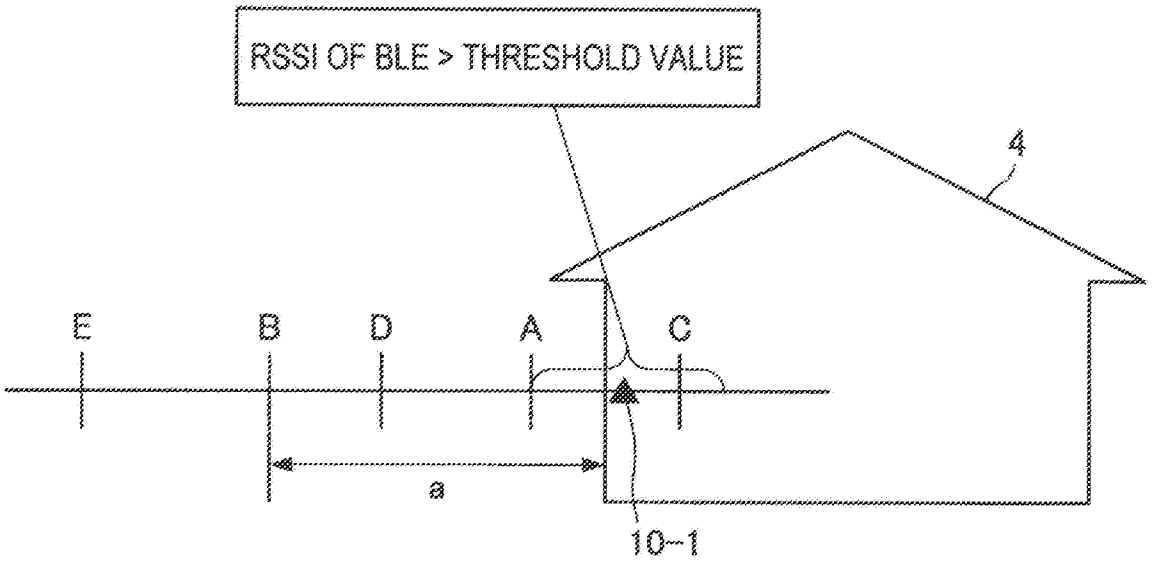

[Fig. 41]
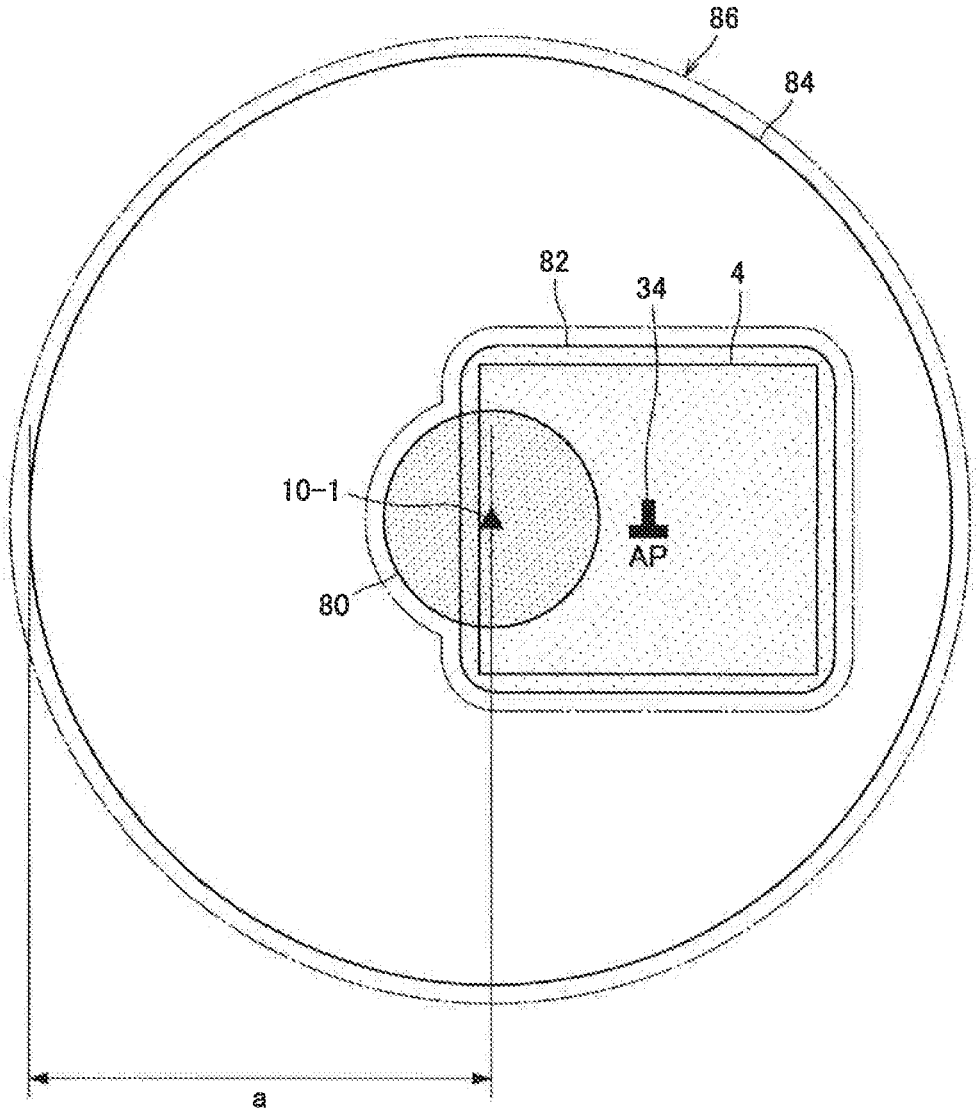

[Fig. 42]
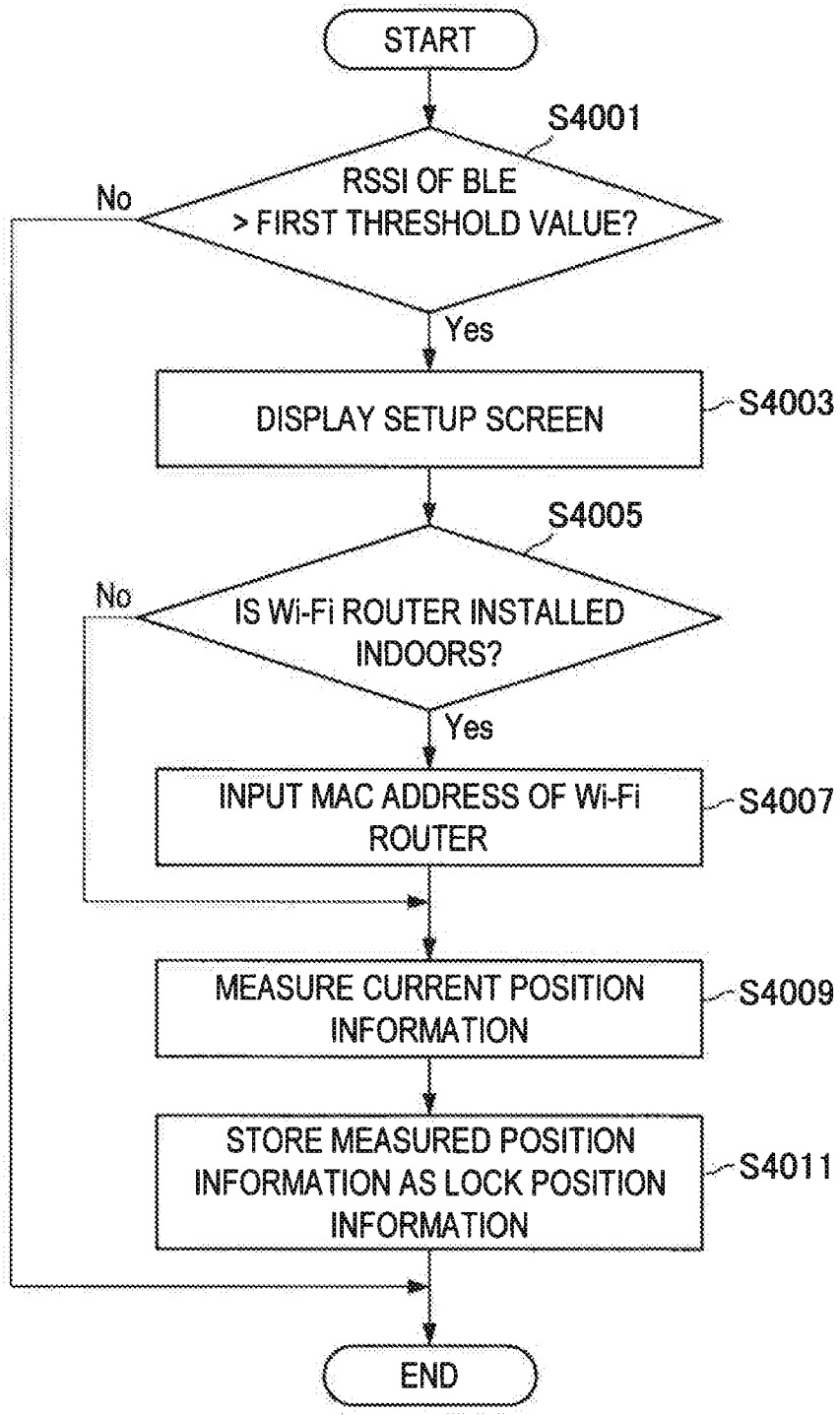

[Fig. 43]
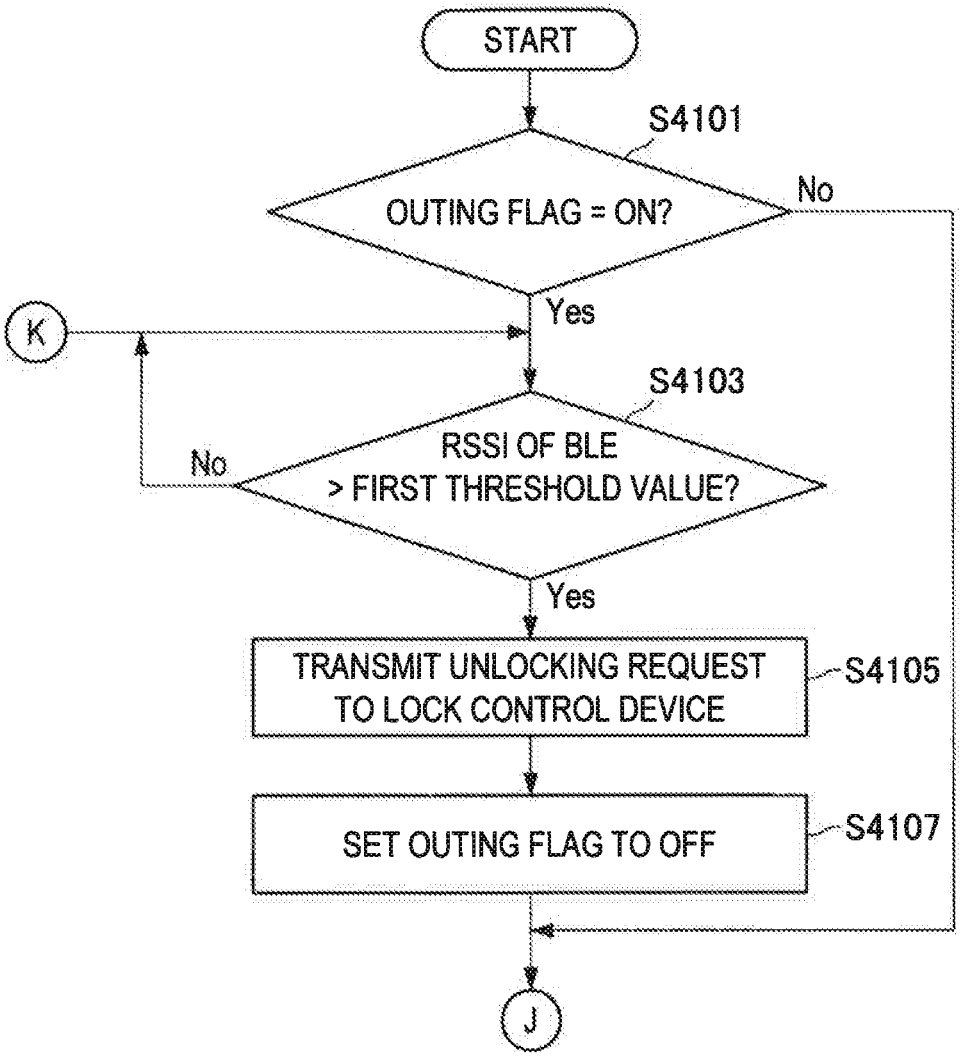

[Fig. 44]
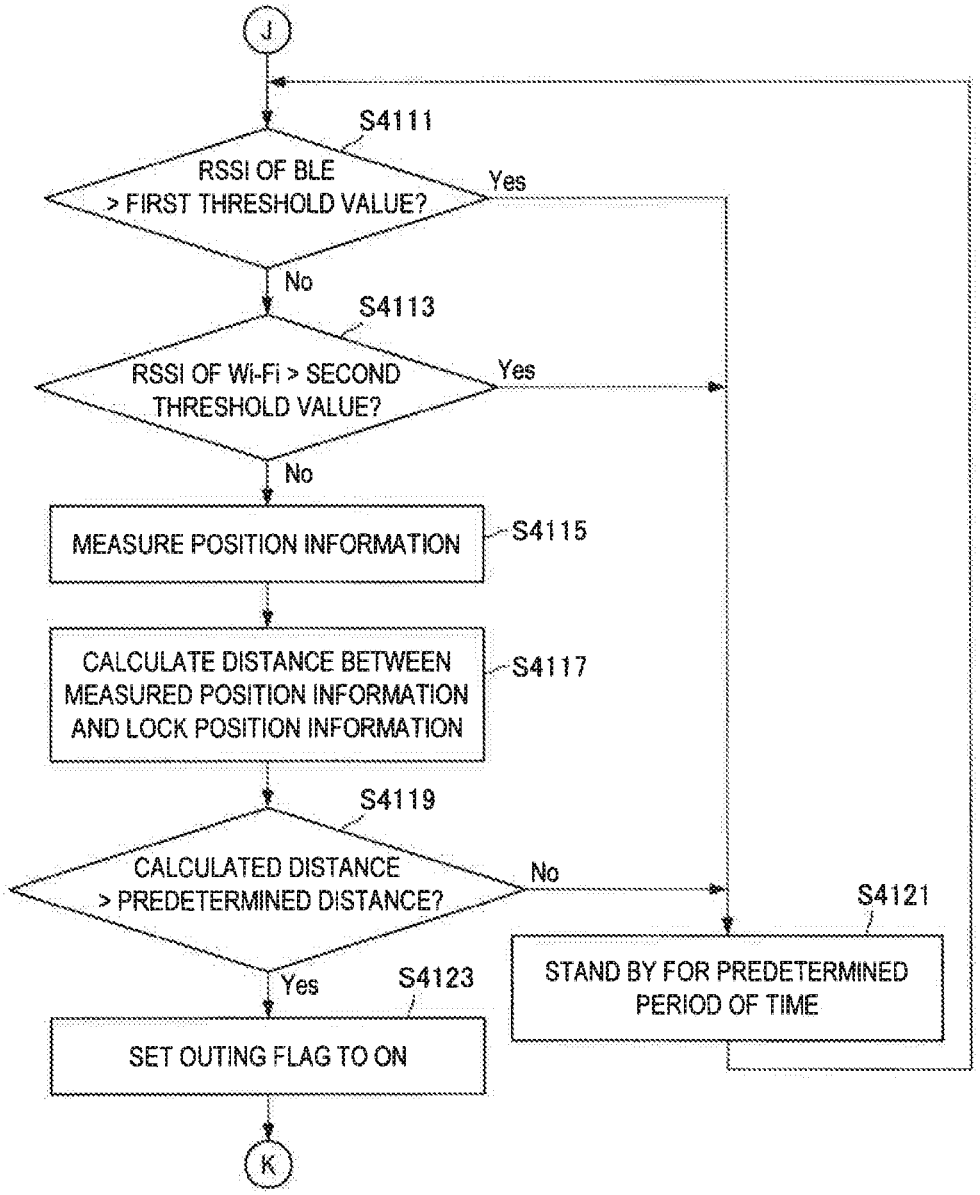

LOCK CONTROL DEVICE, INFORMATION PROCESSING METHOD, PROGRAM, AND COMMUNICATION TERMINAL

CROSS REFERENCE TO RELATED APPLICATIONS

This application is a divisional of U.S. patent application Ser. No. 15/556,027 filed Sep. 6, 2017, which is a National Stage Patent Application of PCT International Patent Application No. PCT/JP2016/002286 filed on May 10, 2016 under 35 U.S.C. § 371, which claims the benefit of Japanese Priority Patent Application JP 2015-112092 filed Jun. 2, 2015, the entire contents of which are incorporated herein by reference.

TECHNICAL FIELD

The present disclosure relates to a lock control device, an information processing method, a program, and a communication terminal.

BACKGROUND ART

In the past, lock control devices capable of locking and unlocking doors electrically have been developed. For example, PTL 1 discloses a technology that performs an unlocking control in which, when a portable device is placed over an electrical lock, the electrical lock reads key data from the portable device and then matches the read key data to authentication key data.

CITATION LIST

Patent Literature

[PTL 1]
JP 2007-239347A

SUMMARY

Technical Problem

However, in the technology disclosed in PTL 1, the same right related to a function of the electrical lock is set in the key data independent of the portable device. Thus, in the technology disclosed in PTL 1, the electrical lock hardly makes a different determination as to whether a request received from the portable device is permitted according to the portable device.

In this regard, in the present disclosure, it is desirable to propose a lock control device, an information processing method, a program, and a communication terminal, which are novel and improved and capable of adaptively determining a right set for each communication terminal with respect to a function of a lock control device when a process request is received from a communication terminal.

Solution to Problem

According to an embodiment of the present disclosure, there is provided a lock control device attachable to a locking mechanism, the lock control device including circuitry configured to receive key information and a process request from a first communication device, the key information including authorization information of the first communication device related to a plurality of types of functions of the lock control device, and determine whether the process request is permitted based on the key information, wherein the key information further includes identification information of the first communication device.

According to an embodiment of the present disclosure, there is provided an information processing method implemented via at least one processor, the method including receiving, by a lock control device and from a first communication device, key information and a process request, the key information including authorization information of the first communication device related to a plurality of types of functions of the lock control device and determining whether the process request is permitted based on the key information, wherein the key information further includes identification information of the first communication device.

According to an embodiment of the present disclosure, there is provided a non-transitory computer-readable medium having embodied thereon a program, which when executed by a processor of a computer causes the computer to execute a method, the method including receiving, by a lock control device and from a first communication device, key information and a process request, the key information including authorization information of the first communication device related to a plurality of types of functions of the lock control device; and determining whether the process request is permitted based on the key information, wherein the key information further includes identification information of the first communication device.

According to an embodiment of the present disclosure, there is provided a communication device, including circuitry configured to obtain signal strength information associated with a first signal received from a lock control device; and initiate transmission of an unlocking request to the lock control device based on the signal strength information associated with the first signal.

Advantageous Effects of Invention

As described above, according to embodiments of the present disclosure, it is possible to adaptively determine a right set for each communication terminal with respect to a function of a lock control device when a the process request is received from a communication terminal. The effect described herein is not necessarily limited and may include any effect described in the present disclosure.

BRIEF DESCRIPTION OF DRAWINGS

FIG. 1 is an explanatory diagram illustrating an exemplary configuration of an information processing system according to an embodiment of the present disclosure.

FIG. 2 is a functional block diagram illustrating an exemplary configuration of a lock control device 10-1 according to an embodiment.

FIG. 3 is an explanatory diagram illustrating an exemplary configuration of a lock key file 126 according to an embodiment.

FIG. 4 is an explanatory diagram illustrating an exemplary configuration of an owner information file 128 according to an embodiment.

FIG. 5 is an explanatory diagram illustrating an exemplary configuration of an eKey according to an embodiment.

FIG. 6 is an explanatory diagram illustrating an exemplary configuration of right setting information included in the eKey according to an embodiment.

FIG. 7 is a functional block diagram illustrating an exemplary configuration of a user terminal 20-1 according to an embodiment.

FIG. 8 is an explanatory diagram illustrating an example of an owner registration card according to an embodiment.

FIG. 9 is an explanatory diagram illustrating a display example of a locking or unlocking request screen according to an embodiment.

FIG. 10 is a functional block diagram illustrating an exemplary configuration of a server 30-1 according to an embodiment.

FIG. 11 is an explanatory diagram illustrating an exemplary configuration of an owner information DB 324 according to an embodiment.

FIG. 12 is a sequence diagram illustrating an overall operation according to an embodiment.

FIG. 13 is an explanatory diagram illustrating a display example of an account registration screen according to an embodiment.

FIG. 14 is an explanatory diagram illustrating a display example of an identity verification screen according to an embodiment.

FIG. 15 is an explanatory diagram illustrating a display example of an electronic mail transmitted after an input to the account registration screen according to an embodiment.

FIG. 16 is an explanatory diagram illustrating a display example of a passcode display screen according to an embodiment.

FIG. 17 is a sequence diagram illustrating an operation at the time of owner registration in the lock control device 10-1 according to an embodiment.

FIG. 18 is a sequence diagram illustrating an operation at the time of owner registration in a server 30-1 according to an embodiment.

FIG. 19 is a sequence diagram illustrating an operation at the time of issuance of an eKey to its own terminal according to an embodiment.

FIG. 20 is a sequence diagram illustrating a part of an operation at the time of issuance of an eKey to another user terminal 20-1 according to an embodiment.

FIG. 21 is a sequence diagram illustrating a part of an operation at the time of issuance of an eKey to another user terminal 20-1 according to an embodiment.

FIG. 22 is a sequence diagram illustrating a part of an operation at the time of issuance of an eKey to another user terminal 20-1 according to an embodiment.

FIG. 23 is a sequence diagram illustrating an operation at the time of a process request to the lock control device 10-1 according to an embodiment.

FIG. 24 is a sequence diagram illustrating a part of an operation of a process request determination process according to an embodiment.

FIG. 25 is a sequence diagram illustrating a part of an operation of a process request determination process according to an embodiment.

FIG. 26 is an explanatory diagram illustrating an example of an owner registration card according to Modification 1 of an embodiment.

FIG. 27 is an explanatory diagram illustrating a storage example of initial state information in a lock key file 126 according to Modification 1 of an embodiment.

FIG. 28 is a sequence diagram illustrating an operation at the time of owner registration in the lock control device 10-1 according to Modification 1 of an embodiment.

FIG. 29 is a sequence diagram illustrating a part of an operation at the time of issuance of an eKey to another user terminal 20-1 according to Modification 2 of an embodiment.

FIG. 30 is an explanatory diagram illustrating an exemplary configuration of an information processing system according to an application example of an embodiment.

FIG. 31 is an explanatory diagram illustrating an exemplary configuration of right setting information included in an eKey according to an application example.

FIG. 32 is a sequence diagram illustrating a part of an operation at the time of issuance of a sub eKey to another user terminal 20-1 according to an application example.

FIG. 33 is an explanatory diagram illustrating an exemplary configuration of a server 30-2 according to an embodiment of the present disclosure.

FIG. 34 is a sequence diagram illustrating an operation at the time of an eKey invalidation request according to an embodiment.

FIG. 35 is an explanatory diagram illustrating an exemplary configuration of a lock control device 10-3 according to an embodiment of the present disclosure.

FIG. 36 is an explanatory diagram illustrating an exemplary configuration of right setting information included in an eKey according to an embodiment.

FIG. 37 is a sequence diagram illustrating a part of an operation at the time of a terminal ID addition request to a blacklist DB 132 according to an embodiment.

FIG. 38 is a sequence diagram illustrating a part of an operation at the time of a terminal ID addition request to a blacklist DB 132 according to an embodiment.

FIG. 39 is an explanatory diagram illustrating an exemplary configuration of a user terminal 20-4 according to an embodiment of the present disclosure.

FIG. 40 is an explanatory diagram illustrating an example of a positional relation between the lock control device 10-1 and the user terminal 20-4 when automatic unlocking is performed according to an embodiment.

FIG. 41 is an explanatory diagram illustrating an example of a range in which position information is measured by the user terminal 20-4 according to an embodiment.

FIG. 42 is a flowchart illustrating an operation at the time of initial setting according to an embodiment.

FIG. 43 is a flowchart illustrating a part of an operation when automatic unlocking is used according to an embodiment.

FIG. 44 is a flowchart illustrating a part of an operation when automatic unlocking is used according to an embodiment.

DESCRIPTION OF EMBODIMENTS

Hereinafter, embodiments of the present disclosure will be described in detail with reference to the appended drawings. In this specification and the appended drawings, structural elements that have substantially the same function and structure are denoted with the same reference numerals, and repeated explanation of these structural elements is omitted.

Also, in the present specification and drawings, a plurality of structural elements that have substantially the same function and structure are sometimes distinguished by adding different alphabets after a same reference numeral. For example, a plurality of configurations having substantially same function and structure are distinguished as appropriate, like the user terminal 20-1*a* and the user terminal 20-1*b*. However, when a plurality of structural elements that have substantially the same function and structure are needless to be distinguished from each other, only a same reference sign is assigned. For example, when a user terminal 20-1*a* and a user terminal 20-1*b* are needless to be distinguished particularly, they are simply referred to as user terminal 20-1.

Also, "Description of Embodiments" will be described in accordance with the item order listed below.

1. First Embodiment
2. Second Embodiment
3. Third Embodiment
4. Fourth Embodiment
5. Modifications

1. First Embodiment

An embodiment of the present disclosure can be embodied in various forms, as described in detail in "1. First Embodiment" to "4. Fourth Embodiment" as one example. First, the first embodiment will be described.

<1-1. System Configuration>

FIG. 1 is an explanatory diagram illustrating the configuration of an information processing system according to the first embodiment. As illustrated in FIG. 1, the information processing system according to the first embodiment includes a lock control device 10-1, user terminals 20-1, a communication network 22, a server 30-1, and a database 32.

{1-1-1. Lock Control Device 10-1}

The lock control device 10-1 is a device that is attached to, for example, a front door of a house and controls locking and unlocking. For example, the lock control device 10-1 is a device that controls locking and unlocking of a deadbolt (not illustrated) installed in a door. Alternatively, the lock control device 10-1 may be a lock mechanism installed in a door without a deadbolt installed in a door.

Further, the lock control device 10-1 performs various kinds of processes such as a locking process and an unlocking process based on a process request received from a user terminal 20-1, which will be described later.

{1-1-2. User Terminal 20-1}

The user terminal 20-1 is an example of a communication terminal in the present disclosure. The user terminal 20-1 is basically a portable terminal owned by a user 2. Examples of the user terminal 20-1 include a mobile phone such as a smartphone, a table terminal, a wristwatch type device, a glasses type device, and a headphone with a communication function according to, for example, Bluetooth (a registered trademark).

Applications for making various kinds of process requests such as an unlocking request to the lock control device 10-1 may be installed in the user terminal 20-1. The user terminal 20-1 may communicate with server 30-1 via the communication network 22, which will be described later, for example, through wireless communication.

{1-1-3. Communication Network 22}

The communication network 22 is a wired or wireless transmission channel of information transmitted from devices connected to the communication network 22. For example, the communication network 22 may include a public line network such as a telephone line network, the Internet, and a satellite communication network, various types of local area networks (LAN) including Ethernet (registered trademark), and a wide area network (WAN). Also, the communication network 22 may include a dedicated line network, such as an internet protocol-virtual private network (IP-VPN).

{1-1-4. Server 30-1}

The server 30-1 is a device that is configured with, for example, a web system and manages a key sharing service. For example, the server 30-1 newly registers an account of the user in the key sharing service based on a request received from the user terminal 20-1. Further, the server 30-1 performs authentication when the user terminal 20-1 logs into the key sharing service.

{1-1-5. Database 32}

The database 32 is a device that stores various information used in the key sharing service according to an instruction received from the server 30-1. For example, the database 32 stores information of the user terminal 20-1 registered as an owner terminal in association with an individual lock control device 10-1.

Note that the information processing system according to the first embodiment is not limited to the above configuration. For example, the database 32 may be stored in the server 30-1, instead of being configured as an independent device.

The configuration of the information processing system according to the first embodiment has been described above. The lock control device 10-1 according to the first embodiment may adaptively determine whether the process request received from the user terminal 20-1 is permitted according to a right set for each user terminal 20-1 with respect to a plurality of types of functions of the lock control device 10-1. The first embodiment will sequentially be described below in detail.

<1-2. Configuration>

{1-2-1. Lock Control Device 10-1}

Next, the configuration according to the first embodiment will be described in detail. FIG. 2 is a functional block diagram illustrating the configuration of the lock control device 10-1 according to the first embodiment. As illustrated in FIG. 2, the lock control device 10-1 includes a control unit 100-1, a communication unit 120, a locking unit 122, and a storage unit 124.

(1-2-1-1. Control Unit 100-1)

The control unit 100-1 generally controls the operation of the lock control device 10-1, using hardware, such as a central processing unit (CPU) and a random access memory (RAM) for example, which are built into the lock control device 10-1. As illustrated in FIG. 2, the control unit 100-1 includes an information registering unit 102, a key information verifying unit 104, an authentication information verifying unit 106, a determination unit 108, a process executing unit 110, a challenge generating unit 112, and a transmission control unit 114.

(1-2-1-2. Information Registering Unit 102)

The information registering unit 102 registers the user terminal 20-1 as the owner terminal of the lock control device 10-1 based on a result of an authentication process using a common key received from the user terminal 20-1 and a common key of the lock control device 10-1 stored in a lock key file 126, which will be described later. For example, when the common key received from the user terminal 20-1 is identical to the common key of the lock control device 10-1 stored in the lock key file 126, the information registering unit 102 registers the user terminal 20-1 as the owner terminal of the lock control device 10-1. Further, when the received common key is not identical to the common key of the lock control device 10-1 stored in the lock key file 126, the information registering unit 102 does not register the user terminal 20-1 as the owner terminal. As a specific authentication method, in addition to the method of verifying whether the common keys are identical to each other as described above, a common key authentication technique described in ISO/IEC 9798-2 may be used.

Further, when the user terminal 20-1 is registered as the owner terminal, the information registering unit 102 stores a public key of the user terminal 20-1 received from the user terminal 20-1 in an owner information file 128, which will be described later. For example, when the owner terminal is registered, first, the information registering unit 102 generates the owner information file 128, and stores the public key of the user terminal 20-1 received from the user terminal 20-1 in the generated owner information file 128.

Lock Key File 126

The lock key file 126 is a file in which information of an authentication key specific to the lock control device 10-1 is stored. Here, an exemplary configuration of the lock key file 126 will be described with reference to FIG. 3. As illustrated in FIG. 3, in the lock key file 126, for example, a lock ID 1260, a lock common key 1262, a lock secret key 1264, and a lock public key 1266 are associated with one another. Here, the lock ID 1260 stores an ID of the lock control device 10-1 that is decided in advance. The lock common key 1262, the lock secret key 1264, and the lock public key 1266 store the common key, the secret key, and the public key that are issued in advance in association with each lock control device 10-1.

FIG. 3 illustrates a storage example of initial state information in the lock key file 126, for example, at the time of product shipping. As illustrated in FIG. 3, in the initial state, the lock ID and the common key of the lock control device 10-1 are stored in the lock key file 126.

Owner Information File 128

The owner information file 128 is a file in which information of the user terminal 20-1 registered as the owner terminal of the lock control device 10-1 by the information registering unit 102 is stored. Here, an exemplary configuration of the owner information file 128 will be described with reference to FIG. 4. As illustrated in FIG. 4, in the owner information file 128, for example, a terminal ID 1280 and a terminal public key 1282 are associated with each other. Here, a terminal ID of the user terminal 20-1 registered as the owner terminal of the lock control device 10-1 by the information registering unit 102 is stored in the terminal ID 1280. The public key of the user terminal 20-1 registered as the owner terminal is stored in the terminal public key 1282.

FIG. 4 illustrates the example in which one public key of the user terminal 20-1 of the corresponding terminal ID is stored in the terminal public key 1282, but the present disclosure is not limited to this example. As a modification, public keys for a plurality of types of public key authentication algorithms generated in association with the user terminal 20-1 of the corresponding terminal ID may be stored in the terminal public key 1282. Here, examples of the public key authentication algorithm include RSA, DSA, ECDSA, and MQ authentication schemes, an authentication scheme based on lattice-based cryptography, and an authentication scheme based on cryptography using a code.

According to this storage example, in a verification process performed by the key information verifying unit 104 and the authentication information verifying unit 106, which will be described later, the verification process according to a plurality of types of public key authentication algorithms may be performed. Further, when verification by all types of registered public key authentication algorithms is passed, the whole verification may be passed. Thus, even when security of one type of public key authentication algorithm is breached, it is possible to prevent overall security from being breached as long as security of at least one of the other registered public key authentication algorithms is not breached.

(1-2-1-3. Key Information Verifying Unit 104)

The key information verifying unit 104 is an example of a key verifying unit in an embodiment of the present disclosure. The key information verifying unit 104 determines the rightfulness of an eKey received from the user terminal 20-1. As will be described later in detail, the user terminal 20-1 registered in the server 30-1 as the owner terminal of the lock control device 10-1 may issue an eKey corresponding to the lock control device 10-1.

Verification Example 1

For example, the key information verifying unit 104 verifies the validity of a received eKey by verifying signature information for the public key of the user terminal 20-1 which is included in the eKey. For example, it is determined whether the public key of the user terminal 20-1 included in the eKey is valid based on the result of verifying the signature information for the public key of the user terminal 20-1 included in the received eKey through the authentication information verifying unit 106, which will be described later. The signature information for the public key of the user terminal 20-1 is basically signature information by a user terminal 20-1*a* (that is, the owner terminal) that issued the eKey. As will be described later in detail, the user terminal 20-1 registered as the owner terminal of the lock control device 10-1 may issue an eKey 40-1 to its own terminal as well. In this case, the signature information of the user terminal 20-1 for the public key of the user terminal 20-1 is recorded in a public key certificate 4022.

Verification Example 2

The key information verifying unit 104 determines that the eKey is valid when the current time is within an effective period with reference to information of the effective period included in the received eKey. For example, when a crystal oscillator is mounted outside a CPU of the lock control device 10-1, the key is information verifying unit 104 acquires an accurate time using the crystal oscillator, and determines whether the current time is within the effective period of the eKey.

eKey

Here, an exemplary configuration of the eKey (the eKey 40-1) will be described with reference to FIG. 5. As illustrated in FIG. 5, the eKey 40-1 includes, for example, a header 400 and a body 402. The header 400 includes an eKey ID 4000, a terminal ID 4002, a lock ID 4004, an effective period 4006, and right setting information 4008-1. The body 402 includes a terminal public key 4020 and the public key certificate 4022.

Here, an eKey ID corresponding to the eKey 40-1 is recorded in the eKey ID 4000. The eKey ID is, for example, an ID that is decided in association with the eKey 40-1 by the owner terminal. The terminal ID of the user terminal 20-1 serving as an issuance target of the eKey 40-1 is recorded in the terminal ID 4002. An ID of the lock control device 10-1 of a use target (associated with the eKey 40-1) is recorded in the lock ID 4004. An effective period set for the eKey 40-1, for example, by the user of the owner terminal, is recorded in the effective period 4006. For example, a date, a day of the week, or a time zone in which the eKey 40-1 may be used is recorded in the effective period 4006. FIG. 5 illustrates an example in which "ALWAYS" indicating that the effective period is unlimited is registered as the effective period 4006.

Further, information of a right set for the user terminal 20-1 serving as the issuance target of the eKey 40-1 with respect to each of a plurality of types of functions of the lock control device 10-1 is recorded in the right setting information 4008-1. For example, the presence or absence of the right of the user terminal 20-1 related to each of a plurality of types of functions of the lock control device 10-1 is stored in the right setting information 4008-1. Here, an exemplary configuration of the right setting information 4008-1 will be described with reference to FIG. 6. As illustrated in FIG. 6, for example, the presence or absence (ON/OFF) of the right of the user terminal 20-1 related to unlocking and locking, viewing or changing time information, viewing or changing setting information of each of a plurality of devices mounted in the lock control device such as a speaker or a light emitting diode (LED), viewing or changing log information stored in an operation log DB 130, which will be described later, or setting a rotational amount of a deadbolt is stored in the right setting information 4008-1.

The public key of the user terminal 20-1 of the issuance target of the eKey 40-1 is recorded in the terminal public key 4020 (illustrated in FIG. 5). For example, the signature information of the user terminal 20-1*a* (that is, the owner terminal) that has issued the eKey 40-1 for the public key stored in the terminal public key 4020 is recorded in the public key certificate 4022.

FIG. 5 illustrates the example in which one terminal public key 4020 and one public key certificate 4022 are stored, but the present disclosure is not limited to this example. For example, the public keys of the user terminal 20-1 generated by a plurality of types of public key authentication algorithms and the signature information of the owner terminal for the public keys of the user terminal 20-1 may be stored in the terminal public key 4020 and the public key certificate 4022.

(1-2-1-4. Authentication Information Verifying Unit 106)

The authentication information verifying unit 106 is an example of a verification processing unit in the present disclosure. When information (hereinafter, also referred to as "response data") generated by the secret key of the user terminal 20-1 is received, the authentication information verifying unit 106 verifies the validity of the received information based on the public key of the user terminal 20-1 and a predetermined public key authentication algorithm. For example, when the response data is received from the user terminal 20-1 after a challenge generated by the challenge generating unit 112, which will be described later, is transmitted to the user terminal 20-1, the authentication information verifying unit 106 verifies the validity of the received response data based on the public key of the user terminal 20-1, the original challenge, and a predetermined public key authentication algorithm.

The authentication information verifying unit 106 may decode the signature information for the public key of the user terminal 20-1 which is included in the eKey received from the user terminal 20-1. For example, the authentication information verifying unit 106 decodes the signature information of the user terminal 20-1*a* (the owner terminal) for a public key of a user terminal 20-1*b* which is included in the received eKey using the public key of the user terminal 20-1*a* stored in the owner information file 128.

(1-2-1-5. Determination Unit 108)

The determination unit 108 determines whether the process request received from the user terminal 20-1 is permitted based on the result of verifying the eKey received from the user terminal 20-1 through the key information verifying unit 104 and content of the right setting information of the user terminal 20-1 included in the eKey. For example, when the key information verifying unit 104 determines that the public key of the user terminal 20-1 is valid, and the presence of the right of the user terminal 20-1 with respect to the received process request is stored in the right setting information, the determination unit 108 permits the received process request. For example, when the public key of the user terminal 20-1 is determined to be valid, the presence of the right of the user terminal 20-1 with respect to the received process request is stored in the right setting information, and the authentication information verifying unit 106 determines that the received response data is valid, the determination unit 108 permits the received process request. Further, when any one of the above conditions is not satisfied, the determination unit 108 does not permit the received process request.

(1-2-1-6. Process Executing Unit 110)

The process executing unit 110 executes a process according to the received process request based on the determination result by the determination unit 108. For example, when the received process request is an unlocking request or a locking request to the locking unit 122, and the determination unit 108 determines that the process request is permitted, the process executing unit 110 causes the locking unit 122 to perform unlocking or locking.

(1-2-1-7. Challenge Generating Unit 112)

The challenge generating unit 112 generates, for example, a challenge serving as a uniform random number within a predetermined range or the like. For example, when the key information verifying unit 104 determines that the public key included in the eKey received from the user terminal 20-1 is valid, the challenge generating unit 112 generates a challenge.

(1-2-1-8. Transmission Control Unit 114)

The transmission control unit 114 causes the communication unit 120 to transmit various kinds of information to the user terminal 20-1. For example, the transmission control unit 114 causes the communication unit 120 to transmit the challenge generated by the challenge generating unit 112 to the user terminal 20-1.

(1-2-1-9. Communication Unit 120)

The communication unit 120 performs transmission and reception of information with another device, by the wireless communication in accordance with Bluetooth (registered trademark) such as Bluetooth low energy (BLE), Wi-Fi (registered trademark), near field communication (NFC), or the like, for example. For example, the communication unit 120 transmits the challenge to the user terminal 20-1 according to control of the transmission control unit 114. The communication unit 120 receives the eKey, the process request, the response data, or the like from the user terminal 20-1.

(1-2-1-10. Locking Unit 122)

The locking unit 122 performs the locking process or the unlocking process according to control of the process executing unit 110.

(1-2-1-11. Storage Unit 124)

The storage unit 124 may store various kinds of data such as the lock key file 126, the owner information file 128, and the operation log DB 130 which will be described later and various kinds of software.

Operation Log DB 130

The operation log DB 130 is a database in which an operation log of the individual user terminal 20-1 on the lock control device 10-1 is stored. For example, an operation date and time, the terminal ID of the user terminal 20-1, and operation content are stored in the operation log DB 130 in association with one another. In addition to a history of an operation on the lock control device 10-1 using the user terminal 20-1, for example, a history of a manual operation of the user on a knob, a button, or the like included in the lock control device 1.0-1 may also be stored in the operation log DB 130.

{1-2-2. User Terminal 20-1}

FIG. 7 is a functional block diagram illustrating the configuration of the user terminal 20-1 according to the first embodiment. As illustrated in FIG. 7, the user terminal 20-1 includes a control unit 200-1, a communication unit 220, an operation display unit 222, an imaging unit 224, and a storage unit 226.

(1-2-2-1. Control Unit 200-1)

The control unit 200-1 controls the operation of the user terminal 20-1 in general using hardware such as a CPU and a RAM mounted in the user terminal 20-1. As illustrated in FIG. 7, the control unit 200-1 includes a two-dimensional code reading unit 202, a digital signature unit 204, a key information issuing unit 206, an authentication processing unit 208, an operation recognizing unit 210, and a transmission control unit 212.

(1-2-2-2. Two-Dimensional Code Reading Unit 202)

The two-dimensional code reading unit 202 analyzes an image of a two-dimensional code imaged by the imaging unit 224, which will be described later, and acquires information stored in the two-dimensional code. For example, the two-dimensional code reading unit 202 analyzes an image obtained by imaging a two-dimensional code printed on an owner registration card illustrated in FIG. 8 which is provided to a specific user through the imaging unit 224, and then acquires information stored in the two-dimensional code such as the common key, the public key, and the secret key of the lock control device 10-1. The specific user is a user that is permitted in advance to register owner information in the lock control device 10-1, for example, a purchaser of the lock control device 10-1 or the like. The owner registration card may be delivered to the specific user in a state in which it is packaged together with, for example, the lock control device 10-1.

(1-2-2-3. Digital Signature Unit 201)

When the user terminal 20-1*a* is registered in the server 30-1 as the owner terminal, the digital signature unit 204 may perform a digital signature on the public key of another user terminal 20-1*b* or the public key of its own terminal (the user terminal 20-1*a*). For example, in the above case, the digital signature unit 204 perform the digital signature by encrypting the public key of the user terminal 20-1*b* based on the secret key of the user terminal 20-1*a*.

(1-2-2-4. Key Information Issuing Unit 206)

When the user terminal 20-1*a* is registered as the owner terminal, the key information issuing unit 206 may issue the eKey in association with another user terminal 20-1*b* or its own terminal. For example, when an eKey issuance request for issuing the eKey to another user terminal 20-1*b* is received from the server 30-1, which will be described later, the key information issuing unit 206 issues the eKey in association with the user terminal 20-1*b*. More specifically, in the above case, the key information issuing unit 206 issues the eKey so that the eKey includes the signature information for the public key of the user terminal 20-1*b* generated by the digital signature unit 204.

(1-2-2-5. Authentication Processing Unit 208)

The authentication processing unit 208 generates the response data, for example, based on the challenge received from the lock control device 10-1 and a predetermined public key authentication algorithm. For example, the authentication processing unit 208 generates the response data based on the received challenge, the secret key of the user terminal 20-1 stored in the storage unit 226, which will be described later, and a predetermined public key authentication algorithm. The predetermined public key authentication algorithm is basically the same type of algorithm as the public key authentication algorithm installed in the lock control device 10-1.

(1-2-2-6. Operation Recognizing Unit 210)

The operation recognizing unit 210 recognizes, for example, content of various kinds of operations by the user on the operation display unit 222, which will be described later. For example, the operation recognizing unit 210 recognizes content of the process request to the lock control device 10-1 which is input by the user on the process request screen displayed on the operation display unit 222.

FIG. 9 is an explanatory diagram illustrating an example (a locking or unlocking request screen 60) of the process request screen. The locking or unlocking request screen 60 is a screen for requesting the lock control device 10-1 to perform locking or unlocking. As illustrated in FIG. 9, the locking or unlocking request screen 60 includes, for example, a locking icon 600*a* and an unlocking icon 600*b*. For example, when the user performs a swipe operation from the locking icon 600*a* to the unlocking icon 600*b* in the locking or unlocking request screen 60, the operation recognizing unit 210 recognizes that the user has input the unlocking request. Similarly, when the user performs a swipe operation from the unlocking icon 600*b* to the locking icon 600*a* in the locking or unlocking request screen 60, the operation recognizing unit 210 recognizes that the user has input the locking request.

(1-2-2-7. Transmission Control Unit 212)

The transmission control unit 212 causes the communication unit 220 to transmit various kinds of information to the lock control device 10-1 or the server 30-1. For example, the transmission control unit 212 causes the communication unit 220 to transmit the process request recognized by the operation recognizing unit 210 to the lock control device 10-1. Further, the transmission control unit 212 causes the communication unit 220 to transmit the response data generated by the authentication processing unit 208 to the lock control device 10-1. Furthermore, the transmission control unit 212 causes the communication unit 220 to transmit the eKey of another user terminal 20-1*b* issued by the key information issuing unit 206 to the server 30-1.

(1-2-2-8. Communication Unit 220)

The communication unit 220 performs transmission and reception of information with another device, by wireless communication in accordance with Bluetooth, Wi-Fi, NFC, or the like, for example. For example, the communication unit 220 transmits the response data generated by the authentication processing unit 208 to the lock control device 10-1 according to the control of the transmission control unit 212. Further, when the user terminal 20 is a terminal other than the owner terminal, the communication unit 220 receives the eKey issued by the owner terminal from the server 30-1.

(1-2-2-9. Operation Display Unit 222)

The operation display unit 222 is configured with a touch panel display, for example. The operation display unit 222 is controlled by the control unit 200-1, to display various types of display screen images. Also, the operation display unit 222 accepts various types of input by the user, such as selection of selection buttons displayed on the display screen image, for example.

(1-2-2-10. Imaging Unit 224)

The imaging unit 224 causes an image of an external video to be formed on an imaging element such as a charge coupled device (CCD) type or a complementary metal oxide semiconductor (CMOS) type through a lens, and records it as a digital image.

(1-2-2-11. Storage Unit 226)

The storage unit 226 stores various kinds of data such as the public key and the secret key of the user terminal 20-1, the eKey issued to the user terminal 20-1, and various kinds of software.

{1-2-3. Server 30-1}

FIG. 10 is a functional block diagram illustrating the configuration of the server 30-1 according to the first embodiment. As illustrated in FIG. 10, the server 30-1 includes a control unit 300-1, a communication unit 320, and a storage unit 322.

(1-2-3-1. Control Unit 300-1)

The control unit 300-1 controls the operation of the server 30-1 in general using hardware such as a CPU and a RAM mounted in the server 30-1. As illustrated in FIG. 10, the control unit 300-1 includes an information registering unit 302, a key information issuance requesting unit 304, a transmission control unit 306, a challenge generating unit 305, an authentication information verifying unit 310, and an authenticating unit 312.

(1-2-3-2. Information Registering Unit 302)

When the public key of the lock control device 10-1, the terminal ID of the user terminal 20-1, and the public key of the user terminal 20-1 are received from the user terminal 20-1, the information registering unit 302 registers the user terminal 20-1 of the received terminal ID as the owner terminal of the lock control device 10-1 corresponding to the received public key of the lock control device 10-1.

Further, when the user terminal 20-1 is registered as the owner terminal, the information registering unit 302 stores the lock ID of the lock control device 10-1 corresponding to the public key of the lock control device 10-1 received from the user terminal 20-1, the public key of the lock control device 10-1, and the public key of the user terminal 20-1 in an owner information DB 324, which will be described later, in association with one another. A correspondence relation between the lock ID of the lock control device 10-1 and the public key of the lock control device 10-1 may be registered in the owner information DB 324, for example, by a system administrator, or may not be registered.

Owner Information DB 324

The owner information DB 324 is a database in which the information of the user terminal 20-1 registered as the owner terminal by the information registering unit 302, for example, with respect to a manufactured individual lock control device 10-1 is stored. The owner information DB 324 is stored, for example, in the database 32.

Here, an exemplary configuration of the owner information DB 324 will be described with reference to FIG. 11. As illustrated in FIG. 11, in the owner information DB 324, for example, a lock ID 3240, a lock public key 3242, a terminal ID 3244, and a terminal public key 3246 are associated with one another. Here, for example, the lock ID registered in the database 32 is stored in the lock ID 3240 in association with the public key of the lock control device 10-1 received from the user terminal 20. Alternatively, when the lock ID of the lock control device 10-1 is received from the user terminal 20 together with the public key of the lock control device 10-1, the lock ID of the lock control device 10-1 received from the user terminal 20 may be stored in the lock ID 3240.

The received public key of the lock control device 10-1 is stored in the lock public key 3242. The terminal ID of the received user terminal 20-1 is stored in the terminal ID 3244. The received public key of the user terminal 20-1 is stored in the terminal public key 3246.

FIG. 11 illustrates an example in which one public key of the user terminal 20-1 of the corresponding terminal ID is stored in the terminal public key 3246, the present disclosure is not limited to this example. As a modification, public keys for a plurality of types of public key authentication algorithms generated in association with the user terminal 20-1 of the corresponding terminal ID may be stored in the terminal public key 3246.

(1-2-3-3. Key Information Issuance Requesting Unit 304)

The key information issuance requesting unit 304 generates an eKey URL when an eKey URL generation request is received from the user terminal 20-1 registered as the owner terminal. The eKey URL is link information corresponding to an eKey that may be issued by the user terminal 20-1 (registered as the owner terminal). Here, a relation between the eKey URL and the eKey issued by the user terminal 20 in association with the eKey URL is a 1 to N relation. For example, the eKey URL corresponds to an event such as a Christmas party. The user terminal 20-1 may issue separate eKeys for an event to each of a plurality of users who take part in the event.

Further, when the generated eKey URL is received from the user terminal 20-1*b* other than the owner terminal, the key information issuance requesting unit 304 generates an issuance request for issuing the eKey corresponding to the received eKey URL to the owner terminal.

(1-2-3-4. Transmission Control Unit 306)

The transmission control unit 306 causes the communication unit 320 to transmit various kinds of information to the user terminal 20-1. For example, the transmission control unit 306 causes the communication unit 320 to transmit the eKey issuance request generated by the key information issuance requesting unit 304 to the user terminal 20-1 registered as the owner terminal.

(1-2-3-5. Challenge Generating Unit 308)

The challenge generating unit 308 generates, for example, a challenge serving as a uniform random number within a predetermined range or the like. For example, when an owner terminal registration request is received from the user terminal 20-1, the challenge generating unit 308 generates a challenge.

(1-2-3-6. Authentication Information Verifying Unit 310)

When the response data is received from the user terminal 20-1, the authentication information verifying unit 310 verifies the validity of the received response data based on the public key of the user terminal 20-1 and a predetermined public key authentication algorithm. For example, when the response data is received from the user terminal 20-1 after the challenge generated by the challenge generating unit 308 is transmitted to the user terminal 20-1, the authentication information verifying unit 310 verifies the validity of the received response data based on the public key of the user terminal 20-1, the original challenge, and a predetermined public key authentication algorithm. The predetermined public key authentication algorithm is basically the same type of algorithm as the public key authentication algorithm installed in the lock control device 10-1.

(1-2-3-7. Authenticating Unit 312)

The authenticating unit 312 performs authentication on the user terminal 20-1 based on the result of verifying the response data received from the user terminal 20-1 through the authentication information verifying unit 310. For example, the authenticating unit 312 authenticates the user terminal 20-1 when the authentication information verifying unit 310 verifies the received response data to be valid, and does not authenticate the user terminal 20-1 when the authentication information verifying, unit 310 verifies the received response data not to be valid.

(1-2-3-8. Communication Unit 320)

The communication unit 320 performs transmission and reception of information with another device connected to the communication network 22, for example. For example, the communication unit 320 transmits the eKey issuance request to the user terminal 20-1 with the right of issuing the eKey according to control of the transmission control unit 306.

(1-2-3-9. Storage Unit 322)

The storage unit 322 stores various types of data and the software. Note that, as a modification, the storage unit 322 is also capable of storing the database 32.

<1-3. Operation>

In the above, the configuration according to the first embodiment has been described. Next, the operation according to the first embodiment will be described in the following order with reference to FIGS. 12 to 29.

1. Flow of Overall Operation
2. Operation at Time of Account Registration
3. Operation at Time of Owner Registration in Lock Control Device 10-1
4. Operation at Time of Owner Registration in Server 30-1
5. Operation at Time of Issuance of eKey to Its Own Terminal
6. Operation at Time of Issuance of eKey to Another User Terminal 20-1
7. Operation at Time of Process Request to Lock Control Device 10-1

FIGS. 12 to 29 illustrate an example in which the user terminal 20-1*a* is a user terminal 20-1 that is registered (or has been registered) as the owner terminal of the lock control device 10-1, and the user terminal 20-1*b* is a user terminal 20-1 other than the owner terminal unless otherwise set forth.

{1-3-1. Flow of Overall Operation}

FIG. 12 is a sequence diagram illustrating the flow of an overall operation according to the first embodiment. As illustrated in FIG. 12, first, each of the user terminal 20-1*a* and the user terminal 20-1*b* accesses, for example, the server 30-1 based on an operation of each user, and downloads a dedicated application for using the key sharing service. Then, the user terminal 20-1*a* and the user terminal 20-1*b* install the dedicated application (S2 to S4).

Thereafter, the control unit 100-1 of the user terminal 20-1*a* generates a public key and a secret key of the user terminal 20-1*a*, for example, based on the operation of the user on the dedicated application installed in S2. Then, the control unit 100-1 stores the generated public key and the secret key in the storage unit 226. Thereafter, the control unit 200-1 performs an "account registration process," which will be described later, on the server 30-1 based on the operation of the user on the dedicated application (S6). The user terminal 20-1*a* also performs the same operation as S6 (S8).

Thereafter, the user terminal 20-1*a* performs an "owner registration process A," which will be described later, for requesting the lock control device 10-1 to register the owner terminal (S10).

Thereafter, the user terminal 20-1*a* performs an "owner registration process B," which will be described later, for requesting the server 30-1 to register the owner terminal of the lock control device 10-1 (S11).

Thereafter, the user terminal 20-1*a* performs an "eKey issuance process A," which will be described later, for issuing an eKey to the user terminal 20-1*a* (S12).

Thereafter, the user terminal 20-1*a* performs an "eKey issuance process B," which will be described later, for issuing the eKey to another user terminal 20-1 (the user terminal 20-1*b*) (S13).

Thereafter, the user terminal 20-1*a* performs a "lock process request," which will be described later, for requesting the lock control device 10-1 to perform various kinds of processes, such as the unlocking process (S14).

{1-3-2. Account Registration Process}

The flow of the overall operation has been described above. Next, an operation of the "account registration process" of S6 (or S8) will be described in detail with reference to FIGS. 13 to 16. First, the user terminal 20-1*a* displays an account registration screen 70 illustrated in FIG. 13 according to a control of the dedicated application being activated. As illustrated in FIG. 13, the account registration screen 70 includes, for example, an account name input field 700, an e-mail address input field 702, and an e-mail transmission button 704. In the account registration screen 70, the user inputs a desired account name and a registration email address to the account name input field 700 and the e-mail address input field 702, and then selects the e-mail transmission button 704. Thus, the transmission control unit 212 of the user terminal 20-1*a* causes the communication unit 220 to transmit the input account name and the e-mail address to the server 30-1. At this time, the transmission control unit 212 may further cause the communication unit 220 to transmit the public key of the user terminal 20-1*a* to the server 30-1.

Thereafter, the user terminal 20-1*a* displays an identity verification screen 72 illustrated in FIG. 14 according to control of the dedicated application. Further, the transmission control unit 212 transmits an e-mail 74 of a layout illustrated in FIG. 15 to the e-mail address input to the e-mail address input field 702.

As illustrated in FIG. 14, the identity verification screen 72 includes a passcode input field 720 and a passcode transmission button 722.

Further, as illustrated in FIG. 15, the e-mail 74 includes, for example, a link selection button 740. For example, a terminal such as a personal computer (PC) or a smartphone displays the e-mail 74 based on the operation of the user. Then, when the link selection button 740 is selected by the user, the terminal communicates with a device (not illustrated) linked with the selected link selection button 740, and displays, for example, a passcode display screen 76 illustrated in FIG. 16. As illustrated in FIG. 16, the passcode display screen 76 includes, for example, a passcode display field 760 on which a 4-digit passcode is displayed.

Thereafter, the user checks the passcode displayed on the passcode display field 760, and inputs the checked passcode to the passcode input field 720 of the identity verification screen 72 displayed on the user terminal 20-1*a*. Then, the user selects the passcode transmission button 722. Thus, the authentication processing unit 208 of the user terminal 20-1*a* encrypts the input passcode based on the secret key of the user terminal 20-1*a*. Then, the communication unit 220 transmits the encrypted information to the server 30-1 according to a control of the transmission control unit 212.

Thereafter, the server 30-1 verifies the validity of the received passcode based on the public key of the user terminal 20-1*a* that is received in advance. Then, when the received passcode is verified to be valid, the server 30-1 stores the account (transmitted in the account registration screen 70) in the database 32 in association with the terminal ID of the user terminal 20-1*a*.

(1-3-2-1. Effects)

According to the above operation example, the (valid) user who viewed the e-mail 74 and then explicitly selected the link selection button 740 may perform the account registration. Thus, it is possible to prevent an account from being illegally registered in the server 30-1 by a malicious user. For example, even if the malicious user inputs an e-mail address of another user of an attack target in the account registration screen 70 illustrated in FIG. 13, and inputs a confirmation code in the passcode input field 720 illustrated in FIG. 14 in a round-robin manner, it is difficult to register an account (since the link selection button 740 has not been selected).

{1-3-3. Operation at Time of Owner Registration in Lock Control Device 10-1}

Next, an operation of the "owner registration process A" in S10 (illustrated in FIG. 12) will be described in detail with reference to FIG. 17. This operation is an operation of registering the user terminal 20-1 of a user to which an owner registration card is provided in the lock control device 10-1 as the owner terminal of the lock control device 10-1. This operation is typically performed once by the user to which the owner registration card corresponding to an individual lock control device 10-1 is provided with respect to the individual lock control device 10-1.

As illustrated in FIG. 17, for example, the imaging unit 224 of the user terminal 20-1*a* images a two-dimensional bar code printed on the owner registration card delivered in the state in which it is packaged together with the lock control device 10-1 based on an operation of the user on the operation display unit 222 (S1001). Then, the two-dimensional code reading unit 202 analyzes the imaged image, and acquires a common key, a public key, and a secret key of the lock control device 10-1 stored in the two-dimensional code (S1003).

Then, the communication unit 220 transmits an owner registration request including the common key, the public key, and the secret key of the lock control device 10-1 acquired in S1003, the terminal ID of the user terminal 20-1*a*, and the public key of the user terminal 20-1*a* to the lock control device 10-1 according to the control of the transmission control unit 212 (S1005).

Thereafter, the control unit 100-1 of the lock control device 10-1 checks whether the owner terminal of the lock control device 10-1 has already been registered (S1007). For example, the control unit 100-1 checks whether the owner information file 128 has been generated.

When the owner terminal is already registered (Yes in S1007), the lock control device 10-1 performs an operation of S1011, which will be described later.

On the other hand, when the owner terminal is not registered yet (No in S1007), the information registering unit 102 compares the common key received in S1005 with the common key of the lock control device 10-1 stored in the lock key file 126 (S1009). When a comparison results indicates that the common keys are not identical (No in S1009), the information registering unit 102 sets "NG" as a Result (=registration result) (S1011). Thereafter, the lock control device 10-1 performs an operation of S1019, which will be described later.

On the other hand, when a comparison results indicates that the common keys are identical (Yes in S1009), the information registering unit 102 sets "OK" as the Result (S1013). Then, the information registering unit 102 adds the public key and the secret key of the lock control device 10-1 received in S1005 to the lock key file 126 (S1015). Then, the information registering unit 102 generates the owner information file 128, and stores the terminal ID and the public key of the user terminal 20-1*a* received in S1005 in the generated owner information file 128 (S1017).

Thereafter, the communication unit 120 transmits the Result set in S1011 or S1013 to the user terminal 20-1*a* according to the control of the transmission control unit 114 (S1019).

{1-3-4. Operation at Time of Owner Registration in Server 30-1}

Next, an operation of the "owner registration process B" in S11 (illustrated in FIG. 12) will be described in detail with reference to FIG. 18. This operation is an operation in which the user terminal 20-1*a* registered as the owner terminal by the lock control device 10-1 transmits the registration request of the owner terminal of the lock control device 10-1 to the server 30-1. This operation is typically performed once by each user terminal 20-1 registered as the owner terminal with respect to the individual lock control device 10-1.

As illustrated in FIG. 18, first, the user terminal 20-1*a* accesses the server 30-1. Then, the communication unit 220 of the user terminal 20-1*a* transmits the owner registration request including the public key of the lock control device 10-1 of the registration target, the terminal ID of the user terminal 20-1*a*, and the public key of the user terminal 20-1*a* to the server 30-1 according to the control of the transmission control unit 212 (S1101).

Thereafter, the challenge generating unit 308 of the server 30-1 generates, for example, a challenge serving as a uniform random number (S1103). Then, the communication unit 320 transmits the challenge generated in S1103 to the user terminal 20-1*a* according to the control of the transmission control unit 306 (S1105).

Thereafter, the authentication processing unit 208 of the user terminal 20-1*a* generates response data based on the challenge received in S1105, the secret key of the lock control device 10-1, and a predetermined public key authentication algorithm (S1107). Then, the communication unit 220 transmits the response data generated in S1107 to the server 30-1 according to the control of the transmission control unit 212 (S1109).

Thereafter, the authentication information verifying unit 310 of the server 30-1 verifies the response data received in S1109 based on the public key of the lock control device 10-1 received in S1101, the challenge generated in S1103, and a predetermined public key authentication algorithm (S1111). When the received response data is determined not to be valid (No in S1113), the authenticating unit 312 sets "NG" as the Result (=authentication result) (S1115). Thereafter, the server 30-1 performs an operation of S1125, which will be described later.

On the other hand, when the received response data is determined to be valid (Yes in S1113), the authenticating unit 312 sets "OK" as the Result (S1117). Then, the communication unit 320 transmits the owner registration request including the public key of the lock control device 10-1, the terminal ID of the user terminal 20-1*a*, and the public key of the user terminal 20-1*a* received in S1101 to the database 32 according to the control of the transmission control unit 306 (S1119).

Thereafter, the database 32 searches for the lock ID corresponding to the public key of the lock control device 10-1 received in S1119 (S1121). Then, the database 32 stores the lock ID specified in S1121, the terminal ID of the user terminal 20-1*a* received in S1119, and the public key of the user terminal 20-1*a* in association with one another (S1123).

Further, the communication unit 320 of the server 30-1 transmits the Result set in S1115 or S1117 to the user terminal 20-1*a* according to the control of the transmission control unit 306 (S1125).

{1-3-5. Operation at Time of Issuance of eKey to its Own Terminal}

Next, an operation of the "eKey issuance process A" in S12 (illustrated in FIG. 12) will be described in detail with reference to FIG. 19. This operation is an operation in which the user terminal 20-1*a* that has completed the registration of the owner terminal to the server 30-1 issues the eKey to its own terminal.

As illustrated in FIG. 19, first, the key information issuing unit 206 of the user terminal 20-1*a* generates an eKey ID corresponding to the eKey of the issuance target (S1201).

Then, the digital signature unit 204 executes the digital signature on the public key of the user terminal 20-1*a* using the secret key of the user terminal 20-1*a*, and generates a public key certificate of the user terminal 20-1*a* (S1203).

Then, the key information issuing unit 206 issues the eKey including the eKey generated in S1201, the terminal ID of the user terminal 20-1*a*, and the public key certificate generated in S1203 (S1205). Then, the key information issuing unit 206 stores the issued eKey in the storage unit 226 (S1207).

{1-3-6. Operation at Time of Issuance of eKey to Another User Terminal 20-1}

Next, an operation of the "eKey issuance process B" in S13 (illustrated in FIG. 12) will be described in detail with reference to FIGS. 20 to 22. This operation is an operation in which the user terminal 20-1*a* registered as the owner terminal issues the eKey to another user terminal 20-1 (the user terminal 20-1*b*). As a specific use case, an example in which the user terminal 20-1*a* issues an "eKey for a Christmas party starting at 18:00, December 25" or an "eKey for a four-day three-night stay of a guest from August 10 to August 13" to the user terminal 20-1*b* is assumed.

As illustrated in FIG. 20, first, the key information issuing unit 206 of the user terminal 20-1*a* generates an eKey URL generation request associated with the lock control device 10-1, for example, based on the input of the user to the operation display unit 222. At this time, the user designates information of the right set for the user terminal 20-1*b* with respect to an expiration period of the eKey (issued in association with the eKey URL) and the functions of the lock control device 10-1, and then the key information issuing unit 206 generates the eKey URL generation request including the designated information.

Then, the communication unit 220 transmits the generated eKey URL generation request to the server 30-1 according to the control of the transmission control unit 212 (S1301).

Thereafter, the key information issuance requesting unit 304 of the server 30-1 generates an eKey URL corresponding to the eKey that may be issued by the user terminal 20-1*a* based on the generation request received in S1301 (S1303). Then, the communication unit 320 transmits the eKey URL generated in S1303 to the user terminal 20-1*a* according to the control of the transmission control unit 306 (S1305).

Thereafter, the user terminal 20-1*a* transmits, for example, an e-mail including the eKey URL received in S1305 or opens the eKey URL to the public through a social networking service (SNS), a home page, or the like based on the operation of the user on the operation display unit 222 (S1307). Thus, the eKey URL is transferred to the user of the user terminal 20-1*b*. The eKey URL does not have a right of performing various kinds of processes requests to the lock control device 10-1 at all, unlike the eKey. Thus, although the eKey URL is opened to the public or a third party acquires the eKey URL, the third party hardly performs the unlocking request to the lock control device 10-1.

Thereafter, when the user of the user terminal 20-1*b* desires to acquire the eKey, the user of the user terminal 20-1*b* inputs the eKey issuance request to the operation display unit 222. Then, the communication unit 220 of the user terminal 20-1*b* transmits an eKey issuance request including the eKey URL shared in S1307 and the terminal ID of the user terminal 20-1*b* to the server 30-1 according to the control of the transmission control unit 212 (S1309).

Thereafter, the communication unit 220 of the server 30-1 transmits an acquisition request of identity information corresponding to the terminal ID of the user terminal 20-1*b* received in S1309 to the database 32 according to the control of the key information issuance requesting unit 304 (S1311).

Thereafter, the database 32 extracts identity information of the user terminal 20-1*b* previously stored in association with the terminal ID of the user terminal 20-1*b* received in S1311, and transmits the extracted identity information to the server 30-1 (S1313).

Thereafter, the key information issuance requesting unit 304 of the server 30-1 generates an eKey issuance request including the eKey URL and the terminal ID of the user terminal 20-1*b* received in S1309 and the identity information of the user terminal 20-1*b* received in S1313. Then, the communication unit 320 transmits the generated eKey issuance request to the user terminal 20-1*a* according to the control of the transmission control unit 306 (S1315).

Thereafter, the user of the user terminal 20-1*a* inputs whether the issuance of the eKey is approved based on content of the eKey issuance request received in S1315 which is displayed on the operation display unit 222 (S1317). Then when it is input that the issuance of the eKey is not approved (No in S1317), the operation of the "eKey issuance process B" ends.

On the other hand, when it is input that the issuance of the eKey is approved (Yes in S1317), the key information issuing unit 206 generates an eKey ID corresponding to the eKey of the issuance target (S1319).

Here, an operation subsequent to S1319 will be described with reference to FIG. 21. As illustrated in FIG. 21, after S1319, the control unit 200-1 of the user terminal 20-1*a* checks whether the public key of the user terminal 20-1*b* is stored in the storage unit 226 (S1321). When the public key of the user terminal 20-1*b* is stored (Yes in S1321), the user terminal 20-1*a* performs an operation of S1331, which will be described later.

On the other hand, when the public key of the user terminal 20-1*b* is not stored (No in S1321), the communication unit 220 transmits a public key reference request including the terminal ID of the user terminal 20-1*b* to the server 30-1 according to the control of the key information issuing unit 206 (S1323).

Thereafter, the communication unit 220 of the server 30-1 transmits an acquisition request of the public key corresponding to the terminal ID received in S1323 according to control of the key information issuance requesting unit 304 (S1325).

Thereafter, the database 32 extracts the public key of the user terminal 20-1*b* stored in association with the terminal ID received in S1325. Then, the database 32 transmits the extracted public key to the server 30-1 (S1327).

Thereafter, the communication unit 320 of the server 30-1 transmits the public key of the user terminal 20-1*b* received in S1327 to the user terminal 20-1*a* according to the control of the transmission control unit 306 (S1329).

Thereafter, the digital signature unit 204 of the user terminal 20-1*a* executes the digital signature on the public key of the user terminal 20-1*b* received in S1329 (or stored in the storage unit 226) using the secret key of the user terminal 20-1*a*, and generates the public key certificate of the user terminal 20-1*b* (S1331).

Then, the key information issuing unit 206 issues an eKey including the eKey ID generated in S1319, the terminal ID of the user terminal 20-1*b*, and the public key certificate of the user terminal 20-1*b* generated in S1331 (S1333). Then, the communication unit 220 transmits the eKey ID generated in S1319 and the eKey issued in S1333 to the server 30-1 according to the control of the key information issuing unit 206 (S1335).

Thereafter, the communication unit 320 of the server 30-1 transmits an eKey storage request including the eKey ID and the eKey received in S1335 to the database 32 according to the control of the transmission control unit 306 (S1337).

Thereafter, the database 32 stores the eKey ID and the eKey received in S1337 in association with each other (S1339).

Here, an operation subsequent to S1339 will be described with reference to FIG. 22. As illustrated in FIG. 22, after S1339, the transmission control unit 306 of the server 30-1 transmits an eKey issuance notification including the eKey ID received in S1335 to the user terminal 20-1*b* in a push notification manner (S1341).

Thereafter, the transmission control unit 212 of the user terminal 20-1*b* causes the communication unit 220 to transmit to the server 30-1 an acquisition request of the eKey corresponding to the eKey ID transmitted in S1341, on the basis of the input of the user into the operation display unit 222, for example (S1343).

Thereafter, the communication unit 320 of the server 30-1 transmits an eKey acquisition request to the database 32 based on the acquisition request received in S1343 according to control of the transmission control unit 306 (S1345).

Thereafter, the database 32 extracts the eKey corresponding to the eKey ID included in the acquisition request received in S1345, and then transmits the extracted eKey to the server 30-1 (S1347).

Thereafter, the communication unit 320 of the server 30-1 transmits the eKey received in S1347 to the user terminal 20-1*b* according to control of the transmission control unit 306 (S1349).

{1-3-7. Operation at Time of Process Request to Lock Control Device 10-1}

Next, an operation of the "lock process request" in S14 (illustrated in FIG. 12) will be described in detail with reference to FIGS. 23 to 25. This operation is an operation in which the user terminal 20-1 possessing the eKey corresponding to the certain lock control device 10-1 approaches the lock control device 10-1 and requests the lock control device 10-1 to perform a certain process. The following description will proceed with an operation example in which the user terminal 20-1*a* registered as the owner terminal makes the unlocking request, but substantially the same applies to an operation example in which the user terminal 20-1*b* other than the owner terminal makes the unlocking request.

As illustrated in FIG. 23, first, the communication unit 220 of the user terminal 20-1*a* transmits an effectiveness confirmation request of the eKey including the eKey ID corresponding to the eKey stored in the user terminal 20-1*a* according to the control of the transmission control unit 212 (S1401).

Thereafter, the transmission control unit 306 of the server 30-1 causes the communication unit 320 to transmit to the database 32 an effectiveness confirmation request of the eKey, on the basis of the confirmation request received in S1401 (S1403).

Thereafter, the database 32 extracts the information relevant to the effectiveness of the eKey corresponding to the eKey ID included in the confirmation request received in S1403, and then transmits the extracted information to the server 30-1 (S1405).

Thereafter, the transmission control unit 306 of the server 30-1 causes the communication unit 320 to transmit to the user terminal 20-1*b* the confirmation result of the effectiveness based on the information received in S1405 (S1407).

Thereafter, the control unit 200-1 of the user terminal 20-1*a* determines whether the eKey is valid based on the confirmation result received in S1407 (S1409). When the eKey is determined not to be valid (No in S1409), the operation of the "lock process request" ends.

On the other hand, when the eKey is determined to be valid (Yes in S1409), the lock control device 10-1 and the user terminal 20-1*a* perform the "process request determination process," which will be described later (S1411).

When an operation log viewing right is set in the right setting information included in the eKey issued to the user terminal 20-1*a*, and the operation log is acquired from the lock control device 10-1 in S1411 (Yes in S1413), the transmission control unit 212 of the user terminal 20-1*a* causes the communication unit 220 to (automatically) transmit the lock ID of the lock control device 10-1 and the operation log acquired in S1411 to the server 30-1 (S1415).

Thereafter, the communication unit 320 of the server 30-1 transmits a storage request for storing the operation log received in S1415 to the database 32 according to the control of the transmission control unit 306 (S1417).

Thereafter, the database 32 stores the lock ID and the operation log included in the storage request received in S1417 in association with each other (S1419). Thus, for example, the owner terminal may access the server 30-1 and view a log of an operation on the lock control device 10-1 by another user terminal 20-1.

(1-3-7-1. Process Request Determination Process)

Here, an operation of the "process request determination process" in S1411 will be described in detail with reference to FIGS. 24 and 25. The authentication process described below is performed between the lock control device 10-1 and the user terminal 20-1*a*, for example, using BLE. Thus, the lock control device 10-1 may communicate with the user terminal 20-1*a* even in an environment in which the user terminal 20-1*a* is not connected to the Internet. For example, even when the lock control device 10-1 is installed in an environment in which a radio wave state of a mobile telephone is bad such as underground or deep in mountains, the lock control device 10-1 may communicate with the user terminal 20-1*a*.

As illustrated in FIG. 24, first, the communication unit 120 of the lock control device 10-1 periodically transmits the lock ID of the lock control device 10-1 to its surroundings according to the control of the transmission control unit 114 (S1501).

Thereafter, when the user terminal 20-1*a* approaches the lock control device 10-1, the user terminal 20-1*a* receives the lock ID transmitted in S1501, and then determines whether the received lock ID is a lock ID of the target lock control device 10-1. Then, when the received lock ID is the lock ID of the target lock control device 10-1, the user terminal 20-1*a* establishes a session with the lock control device 10-1 (S1503).

Then, the authentication processing unit 208 of the user terminal 20-1*a* generates a commitment based on a predetermined public key authentication algorithm (S1505). Then, the transmission control unit 212 causes the communication unit 220 to transmit, for example, the process request input to the operation display unit 222 by the user, the eKey stored in the storage unit 226, and the commitment generated in S1505 to the lock control device 10-1 (S1507).

Thereafter, the authentication information verifying unit 106 of the lock control device 10-1 decodes the public key certificate included in the eKey received in S1507 using the public key of the owner terminal stored in the owner information file 128 (S1509).

Then, the key information verifying unit 104 determines whether the public key of the user terminal 20-1*a* included in the eKey received in S1507 is valid based on the result of decoding in S1509 (S1511). When the public key of the user terminal 20-1*a* is determined not to be valid (No in S1511), the lock control device 10-1 performs an operation of S1533, which will be described later.

On the other hand, when the public key of the user terminal 20-1*a* is determined to be valid (Yes in S1511), the key information verifying unit 104 determines whether the current time is within the effective period with reference to the information of the effective period included in the received eKey (S1513). When the current time is not within the effective period (No in S1513), the lock control device 10-1 performs an operation of S1533, which will be described later.

On the other hand, when the current time is within the effective period (Yes in S1513), the determination unit 108 checks the right setting information included in the eKey received in S1507, and checks whether the right related to the process request received in S1507 is set for the user terminal 20-1*a* (S1521).

Here, an operation subsequent to S1521 will be described with reference to FIG. 25. In S1521, when it is confirmed that the right related to the received process request is not set for the user terminal 20-1*a* (No in S1521), the lock control device 10-1 performs an operation of S1533, which will be described later.

On the other hand, when it is confirmed that the right related to the received process request is set for the user terminal 20-1*a* (Yes in S1521), the challenge generating unit 112 generates, for example, the challenge serving as the uniform random number. Then, the communication unit 120 transmits the generated challenge to the user terminal 20-1*a* according to the control of the transmission control unit 114 (S1523).

Thereafter, the authentication processing unit 208 of the user terminal 20-1*a* generates the response data based on the challenge received in S1523, the secret key of the user terminal 20-1*a*, and a predetermined public key authentication algorithm (S1525). Then, the communication unit 220 transmits the generated response data to the lock control device 10-1 according to the control of the transmission control unit 212 (S1527).

Thereafter, the authentication information verifying unit 106 of the lock control device 10-1 verifies the validity of the response data received in S1527 based on the public key of the user terminal 20-1*a* included in the eKey received in S1507, the commitment received in S1507, the challenge generated in S1523, and a predetermined public key authentication algorithm (S1529). When the received response data is determined not to be valid (No in S1531), the determination unit 108 does not permit the process request received in S1507 (S1533). Then, the lock control device 10-1 performs an operation of S1537, which will be described later.

On the other hand, when the received response data is determined to be valid (Yes in S1531), the determination unit 108 permits the process request received in S1507. Then, the process executing unit 110 executes a process according to the process request (S1535).

Thereafter, the communication unit 120 transmits the execution result of S1533 or S1535 to the user terminal 20-1*a* according to the control of the transmission control unit 114 (S1537).

<1-4. Effects>

{1-4-1. Effect 1}

As described above, for example, with reference to FIG. 2, FIGS. 12 to 29, and the like, the lock control device 10-1 according to the first embodiment receives the eKey including the right setting information of the user terminal 20-1 with respect to a plurality of types of functions of the lock control device 10-1 and the process request on the lock control device 10-1 from the user terminal 20-1, and determines whether the received process request is permitted based on the right setting information. Thus, the lock control device 10-1 adaptively determines whether the process request received from the user terminal 20-1 is permitted according to the right set for each user terminal 20-1 with respect to a plurality of types of functions of the lock control device 10-1. For example, the lock control device 10-1 may permit only unlocking and locking to the user terminal 20-1*b* other than the owner terminal based on the right setting information of the user terminal 20-1*b*. Further, the lock control device 10-1 may permit various kinds of requests such as changing of time information stored in the lock control device 10-1 or viewing of the operation log stored in the operation log DB 130 in addition to unlocking and locking to the user terminal 20-1*a* serving as the owner terminal based on the right setting information of the user terminal 20-1*a*.

{1-4-2. Effect 2}

The lock control device 10-1 can authenticate the user terminal 20-1 without receiving information having high confidentiality such as the secret key of the user terminal 20-1 or the like from the user terminal 20-1, and thus authentication security is high.

Further, at the time of registration of the owner terminal, the user terminal 20-1 does not register information having high confidentiality such as the secret key of the user terminal 20-1 in the lock control device 10-1 and the server 30-1. Thus, it is possible to prevent information having high confidentiality from being leaked to the outside even when the process request is not made to the lock control device 10-1.

{1-4-3. Effect 3}

The lock control device 10-1 verifies the validity of the public key of the user terminal 20-1*b* by verifying the signature information of the user terminal 20-1*a* serving as the owner terminal which is included in the eKey received from the user terminal 20-1*b* using the public key of the owner terminal. Thus, the lock control device 10-1 can check whether the user terminal 20-1*b* of the authentication target is the user terminal 20-1 having the valid eKey.

<1-5. Modifications>

{1-5-1. Modification 1}

The first embodiment is not limited to the above description. The above description has been made in connection with the example in which the user terminal 20-1 reads the information stored in the two-dimensional code printed on the owner registration card such as the common key of the lock control device 10-1, and performs the owner registration in the lock control device 10-1 and the server 30-1.

Meanwhile, a case in which an application for reading the two-dimensional code is not installed in the user terminal 20-1 or a case in which the user does not know how to read the two-dimensional code, for example, because the user is an elderly person or the like is assumed.

As will be described later, according to Modification 1, even when the two-dimensional code printed on the owner registration card is not read by the user terminal 20-1, the user terminal 20-1 may perform the owner registration in the lock control device 10-1 and the server 30-1.

(1-5-1-1. Configuration)

FIG. 26 is an explanatory diagram illustrating an example (an owner registration card 50*b*) of an owner registration card according to Modification 1. As illustrated in FIG. 26, a code value 502 of a common key of the lock control device 10-1 stored in a two-dimensional code 500 is printed directly on the owner registration card 50*b* together with the two-dimensional code 500. The common key of the lock control device 10-1 is stored in the two-dimensional code 500 of the owner registration card 50*b*, and a public key and a secret key of the lock control device 10-1 may not be stored.

For example, in an initial state such as at the time of product shipping, the common key, the public key, and the secret key of the lock control device 10-1 are stored in the lock control device 10-1 according to Modification 1. FIG. 27 is an explanatory diagram illustrating a storage example (a lock key file 126*b*) of initial state information in the lock key file 126 according to Modification 1. As illustrated in FIG. 27, in the initial state, the lock secret key and the lock public key (in addition to a lock ID and the lock common key) are also stored in the lock key file 126*b*, compared to the lock key file 126*a* illustrated in FIG. 3.

The remaining configuration of Modification 1 is similar to that described above.

(1-5-1-2. Operation)

Next, an operation according to Modification 1 will be described. An operation (S10) of the "owner registration process A" according to Modification 1 will be described below with reference to FIG. 28. This operation is an alternative operation to the operation illustrated in FIG. 17. Here, an operation example when the user of the user terminal 20-1*a* manually inputs a code value of the common key of the lock control device 10-1 printed on the owner registration card to the user terminal 20-1*a* will be described. The other types of operations are similar to those described above, and thus a description thereof will be omitted.

As illustrated in FIG. 28, first, for example, the user of the user terminal 20-1*a* manually inputs the code value of the common key of the lock control device 10-1 printed on the owner registration card delivered in the state in which it is packaged together with the lock control device 10-1 to the operation display unit 222 (S1601).

Then, the transmission control unit 212 causes the communication unit 220 to transmit an owner registration request including (the code value of) the common key of the lock control device 10-1 input in S1601, a terminal ID of the user terminal 20-1*a*, and the public key of the user terminal 20-1*a* to the lock control device 10-1, for example, based on the operation of the user on the operation display unit 222 (S1603).

Operations of S1605 to S1611 illustrated in FIG. 28 are the same as operations of S1007 to S1013 illustrated in FIG. 17. An operation of S1613 illustrated in FIG. 28 is the same as the operation of S1017 illustrated in FIG. 17.

After S1613, the transmission control unit 114 of the lock control device 10-1 causes the communication unit 120 to transmit the public key and the secret key of the lock control device 10-1 stored in the lock key file 126 to the user terminal 20-1*a* (S1615). As a result, the user terminal 20-1*a* may acquire the public key and the secret key of the lock control device 10-1. Then, for example, the user terminal 20-1*a* may register the owner terminal in the server 30-1 according to the flow of the same is operations as the operations illustrated in FIG. 18.

An operation of S1617 illustrated in FIG. 28 is the same as the operation of S1019 illustrated in FIG. 17.

(1-5-1-3. Effects)

As described above with reference to FIGS. 26 to 28, according to Modification 1, since the user manually input the common key of the lock control device 10-1 printed on the owner registration card to the user terminal 20-1, the user terminal 20-1 can perform the owner registration in the lock control device 10-1 and the server 30-1 even without reading the two-dimensional code printed on the owner registration card.

Further, since only the user terminal 20-1 to which the code value of the common key of the lock control device 10-1 has been input can acquire the public key and the secret key of the lock control device 10-1 from the lock control device 10-1, it is possible to prevent the user who does not know the code value of the common key of the lock control device 10-1 from illegally performing the owner registration.

Generally, the common key of the lock control device 10-1 is about 128 to 256 bits, and thus the user can manually input the common key of the lock control device 10-1 without difficulty.

{1-5-2. Modification 2}

Modification 1 has been described above. Next, Modification 2 will be described. The first embodiment has been described in connection with the example in which, when the user terminal 20-1*b* other than the owner terminal requests the user terminal 20-1*a* serving as the owner terminal to issue the eKey, the eKey is issued to the user terminal 20-1*b* as illustrated in FIG. 20, but the present disclosure is not limited to this example.

As will be described later, according to Modification 2, the user terminal 20-1*a* serving as the owner terminal may voluntarily designate another user terminal 20-1*b* and issue an eKey to the designated user terminal 20-1*b*.

(1-5-2-1. Operation)

FIG. 29 is a sequence diagram illustrating a part of the operation (S13) of the "eKey issuance process B" according to Modification 2. This operation is an alternative operation to the operation illustrated in FIG. 20. The other types of operations are similar to those described above, and thus a description thereof will be omitted.

Operations of S1701 to S1705 illustrated in FIG. 29 are the same as the operations of S1301 to S1305 illustrated in FIG. 20.

After S1705, the user of the user terminal 20-1*a* designates the user terminal 20-1*b* of the eKey issuance target on the operation display unit 222. Then, the key information issuing unit 206 of the user terminal 20-1*a* set the terminal ID of the designated user terminal 20-1*b* as the terminal ID of the user terminal 20-1 of the eKey issuance target (S1707).

An operation of S1709 illustrated in FIG. 29 is the same as the operation of S1319 illustrated in FIG. 20. Further, operations subsequent to S1709 are the same as the operations illustrated in FIGS. 21 and 22.

According to Modification 2, there is an advantage in that the processes of S1307 to S1317 illustrated in FIG. 20 may be omitted.

<1-6. Application Example>

In the above, the first embodiment has been described. Next, the application example of the first embodiment will be described with reference to FIGS. 30 to 32.

{1-6-1. Background}

First, the background that led to the creation of the present application example will be described. In the first embodiment, the user terminal 20-1 that issues the eKey corresponding to the individual lock control device 10-1 is the user terminal 20-1*a* registered as the owner terminal. Thus, for example, when an owner user 2*a* serving as the user of the owner terminal has to issue the eKey to a plurality of guest users 2*b* (the users other than the owner user 2*a*), it takes time to issue the eKey to all the guest users 2*b*. Further, since it is necessary for the owner user 2*a* to perform an approval work for approving an eKey issuance request made from an individual guest user 2*b*, a work load of the owner user 2*a* is large.

As will be described later, according to the present application example, the owner terminal may give a right of issuing a sub eKey similar to the eKey to another user terminal 20-1*b*. The sub eKey is an example of sub key information in the present disclosure.

{1-6-2. System Configuration}

FIG. 30 is an explanatory diagram illustrating a configuration of an information processing system according to the present application example. As illustrated in FIG. 30, the information processing system according to the present application example further includes a user terminal 20-1*c*, compared to FIG. 1.

The remaining components are the same as those described above.

{1-6-3. Configuration}

(1-6-3-1. Lock Control Device 10-1)

In the above, the configuration of the information processing system according to the present application example has been described. Next, the configuration according to the present application example will be described in detail. The configuration of the lock control device 10-1 by the present application example is substantially same as the configuration illustrated in FIG. 2. In the following, only components having the function different from the above description will be described.

Key Information Verifying Unit 104

The key information verifying unit 104 according to the present application example determines the validity of the eKey or the sub eKey received from the user terminal 20-1. A specific determination method is substantially the same as that described above.

eKey

Here, an exemplary configuration (right setting information 4008-2) of the right setting information included in the eKey according to the present application example will be described with reference to FIG. 31. As illustrated in FIG. 31, the presence or absence (ON/OFF) of the right of the user terminal 20-1 related to an issuance of the sub eKey is further stored in the right setting information 4008-2, compared to the right setting information 4008-1 illustrated in FIG. 6.

Determination Unit 108

When the sub eKey is received from the user terminal 20-1, the determination unit 108 according to the present application example determines whether the process request received from the user terminal 20-1 is permitted based on the result of verifying the received sub eKey through the key information verifying unit 104 and the right setting information of the user terminal 20-1 included in the sub eKey. A specific determination method is substantially the same as that described above.

(1-6-3-2. User Terminal 20-1)

The user terminal 20-1 has substantially the same configuration as the configuration illustrated in FIG. 7. The following description will proceed focusing on components having different functions from those described above.

Key Information Issuing Unit 206

The key information issuing unit 206 according to the present application example may issue a sub eKey in association with another user terminal 20-1*c* when the eKey is issued to the user terminal 20-1, and the issuance right of the sub eKey is registered in the eKey. For example, the key information issuing unit 206 issues the sub eKey so that a type of information included in the sub eKey is identical to that of the eKey. Further, the key information issuing unit 206 issues the sub eKey so that the right set for the user terminal 20-1*c* of the sub eKey issuance target is equal to or lower than the right set to the eKey issued to the user terminal 20-1.

(1-6-3-3. Server 30-1)

The server 30-1 according to the present application example has substantially the same configuration and function as described above.

{1-6-4. Operation}

The configuration according to the present application example has been described above. Next, an operation according to the present application example will be described with reference to FIG. 32. Here, an operation example will be described in connection with a situation in which the user terminal 20-1*b* other than the owner terminal issues the sub eKey to another user terminal 20-1*c*. The other types of operations described in Section 1-3 are similarly applied to the present application example, and thus a description thereof will be omitted.

As illustrated in FIG. 32, first, for example, when the user inputs a sub eKey issuance request to the operation display unit 222, the key information issuing unit 206 of the user terminal 20-1*b* checks whether the issued eKey is stored in the storage unit 226 (S1801). When the eKey is not stored in the storage unit 226 (No in S1801), the present operation ends.

On the other hand, when the eKey is stored in the storage unit 226 (Yes in S1801), the key information issuing unit 206 checks the right setting information included in the stored eKey, and checks whether the issuance right of the sub eKey is set for the user terminal 20-1*b* (S1803). When the issuance right of the sub eKey is not set for the user terminal 20-1*b* (No in S1803), the present operation ends.

On the other hand, when the issuance right of the sub eKey is set for the user terminal 20-1*b* (Yes in S1803), the key information issuing unit 206 generates a sub eKey URL generation request associated with the lock control device 10-1. At this time, information of the right set for the user terminal 20-1*c* with respect to an expiration date of the sub eKey (issued in association with the sub eKey URL) and the functions of the lock control device 10-1 are designated by the user of the user terminal 20-1*b*, and then the key information issuing unit 206 generates the sub eKey URL generation request including the designated information.

Then, the communication unit 220 transmits the generated sub eKey URL generation request to the server 30-1 according to the control of the transmission control unit 212 (S1805).

Operations subsequent to S1805 illustrated in FIG. 32 differs from the operations subsequent to S1303 in the "eKey issuance process B" illustrated in FIGS. 20 to 22 in the eKey, the sub eKey, and the terminal ID of the user terminal 20-1, but the remaining content and a processing order are the same. Thus a description thereof will be omitted here.

{1-6-5. Effects}

(1-6-5-1. Effect 1)

As described above, according to the present application example, the owner terminal can give the issuance right of the sub eKey to the user terminal 20-1*b* by setting the issuance right of the sub eKey in the right setting information included in the eKey to the user terminal 20-1*b* and issuing the eKey to the user terminal 20-1*b*. Then, the user terminal 20-1*b* that has issued the eKey can basically issue the sub eKey to another user terminal 20-1*c* without getting an approval from the owner terminal.

For example, the owner user can ask the user (hereinafter, also referred to as a "quasi-owner user") of the user terminal 20-1*b* to issue the sub eKey to the guest user 2*c*, and thus the work load of the owner user is reduced.

For example, an owner (owner user) of an apartment can ask a real estate management company to issue the sub eKey to residents of respective units of the apartment, contractors, brokers, or the like (guest users) by issuing the eKey to the user terminal 20-1 of the real estate management company. Thus, the work load of the owner of the apartment is remarkably reduced.

(1-6-5-2. Effect 2)

It is also possible to check that the right is not illegally added by checking both the right setting permitted to the eKey and the right setting permitted to the sub eKey and verifying that the right setting permitted to the sub eKey does not exceed the right setting permitted to the eKey.

2. Second Embodiment

<2-1. Background>

The first embodiment has been described above. Next, a second embodiment will be described.

First, the background that led to the creation of the second embodiment will be described. Basically, when the eKey is issued, the user terminal 20-1 according to the first embodiment may freely use the eKey within the effective period set for the eKey.

Incidentally, the user of the owner terminal is also assumed to desire to invalidate the eKey issued to another user terminal 20-1 before the expiration date passes, for example, the user of the owner terminal is assumed to desire to compulsorily invalidate the eKey before the expiration date passes because the user broke up with his or her significant other.

As will be described later, according to the second embodiment, the owner terminal may invalidate an issued eKey before the expiration date passes by notifying a server 30-2 of an eKey ID of the eKey that is desired to be invalidated.

<2-2. System Configuration>

A system configuration according to the second embodiment is the same as that of the first embodiment illustrated in FIG. 1 or FIG. 30.

<2-3. Configuration>

Then, a configuration according to the second embodiment will be described in detail. In the following, a description of portions overlapping the first embodiment will be omitted.

{2-3-1. Server 30-2}

FIG. 33 is a functional block diagram illustrating a configuration of the server 30-2 according to the second embodiment. As illustrated in FIG. 33, the server 30-2 differs from the server 30-1 illustrated in FIG. 10 in that a control unit 300-2 is provided instead of the control unit 300-1.

(2-3-1-1. Control Unit 300-2)

The control unit 300-2 further includes an eKey invalidation list registering unit 314, compared to the control unit 300-1.

(2-3-1-2. eKey Invalidation List Registering Unit 314)

When an eKey invalidation request including an eKey ID of an invalidation target is received from the user terminal 20-1, the eKey invalidation list registering unit 314 adds the eKey ID included in the received invalidation request to an eKey invalidation list DB 326, which will be described later.

eKey Invalidation List DB 326

The eKey invalidation list DB 326 is a database in which an eKey ID of an eKey registered as a compulsory invalidation target is stored. For example, an invalidation request date and time and the eKey ID of the invalidation target are stored in the eKey invalidation list DB 326 in association with each other. The eKey invalidation list DB 326 is stored in, for example, the database 32.

{2-3-2. Lock Control Device 10-1 and User Terminal 20-1}

The lock control device 10-1, and the user terminal 20-1 according to the second embodiment have substantially the same configurations as those of the first embodiment.

<2-4 Operation>

The configuration according to the second embodiment has been described above. Then, an operation according to the second embodiment will be described in "2-4-1. Operation at Time of eKey Invalidation Request" through "2-4-2. Operation at Time of Process Request to Lock Control Device 10-1." The other types of operations described in the first embodiment are similarly applied to the second embodiment.

{2-4-1. Operation at Time of eKey Invalidation Request}

First, an operation at the time of the eKey invalidation request according to the second embodiment will be described with reference to FIG. 34. Here, an operation example will be described in connection with a situation in which the user terminal 20-1 serving as the owner terminal asks the server 30-2 to compulsorily invalidate a specific eKey among issued eKeys.

As illustrated in FIG. 34, first, for example, when the user inputs an eKey invalidation request to the operation display unit 222, the control unit 200-1 of the user terminal 20-1 checks whether the issued eKey is stored in the storage unit 226 (S2001). When the eKey is not stored in the storage unit 226 (No in S2001), the present operation ends.

On the other hand, when the eKey is stored in the storage unit 226 (Yes in S2001), the control unit 200-1 cheeks whether an eKey invalidation list addition right is set for the user terminal 20-1 by checking the right setting lamination included in the stored eKey (S2003). When the eKey invalidation list addition right is not set for the user terminal 20-1 (No in S2003), the present operation ends.

On the other hand, when the eKey invalidation list addition right is set for the user terminal 20-1 (Yes in S2003), the user of the user terminal 20-1 designates the eKey ID of the eKey of the invalidation target in the operation display unit 222 (S2005).

Thereafter, the control unit 200-1 generates an eKey invalidation request including the eKey ID designated in S2005. Then, the communication unit 220 transmits the generated eKey invalidation request to the server 30-2 according to the control of the transmission control unit 212 (S2007).

Thereafter, the eKey invalidation list registering unit 314 of the server 30-2 causes the communication unit 320 to transmit an eKey invalidation registration request to the database 32 based on the eKey invalidation request received in S2007 (S2009).

Thereafter, the database 32 adds the eKey ID included in the invalidation registration request received in S2009 to the eKey invalidation list DB 326 (S2011).

{2-4-2. Operation at Time of Process Request to Lock Control Device 10-1}

Next, an operation (S14) of the "lock process request" (illustrated in FIG. 23) according to the second embodiment will be described. The operation of the "lock process request" according to the second embodiment is similar to that of the first embodiment except for an operation of S1405 illustrated in FIG. 23, and a description thereof will be omitted.

In S1405 according to the second embodiment, the database 32 first searches whether the eKey ID included in the confirmation request received in S1403 is registered in the eKey invalidation list DB 326. Then, when the search is hit, a confirmation result indicating that the eKey is invalidated (that is, that the eKey is not valid) is transmitted to the server 30-2.

On the other hand, when the search is not hit, similarly to the first embodiment, the database 32 extracts the information relevant to the effectiveness of the eKey corresponding to the eKey ID, and transmits the extracted information to the server 30-2.

<2-5. Effects>

As described above with reference to FIGS. 33 and 34, the server 30-2 according to the second embodiment adds the eKey ID included in the eKey invalidation request received from the user terminal 20-1 serving as the owner terminal to the eKey invalidation list DB 326. Then, when an inquiry about effectiveness of the eKey stored in the user terminal 20-1*b* is received from the user terminal 20-1*b*, for example, at the time of the process request to the lock control device 10-1 by the user terminal 20-1*b* other than the owner terminal, the server 30-2 first checks whether the eKey ID included in the received inquiry is registered in the eKey invalidation list DB 326. Then, when the eKey ID included in the received inquiry is registered in the eKey invalidation list DB 326, the server 30-2 gives a notification indicating that the eKey is invalidated to the user terminal 20-1*b*.

Thus, the owner terminal can compulsorily invalidate a specific eKey among the issued eKeys before the expiration date passes.

3. Third Embodiment

The second embodiment has been described above. As described above, in the second embodiment, the owner terminal notifies the server 30-2 of the eKey ID of the eKey of the invalidation target, and invalidates the issued eKey before the expiration date passes.

Next, a third embodiment will be described. As will be described later, according to the third embodiment, the owner terminal may invalidate the issued eKey before the expiration date passes by registering the terminal ID of the user terminal 20-1 to which the eKey desired to be invalidate was issued in a lock control device 10-3.

<3-1. System Configuration>

A system configuration according to the third embodiment is similar to that of the first embodiment illustrated in FIG. 1 or FIG. 30.

<3-2. Configuration>

{3-2-1. Lock Control Device 10-3}

Next, the configuration according to the third embodiment will be described in detail. FIG. 35 is a functional block diagram illustrating the configuration of the lock control device 10-3 according to the third embodiment. Note that, in the following, the description will be omitted with respect to the content overlapping the first embodiment.

(3-2-1-1. Determination Unit 108)

The determination unit 108 according to the third embodiment does not permit the process request received from the user terminal 20-1 when the terminal ID included in the eKey received from the user terminal 20-1 is registered in a blacklist DB 132, which will be described later.

The determination unit 108 according to the third embodiment permits the received process request (that is, an addition request or a deletion request of a terminal ID to or from the blacklist DB 132) when the process request received from the user terminal 20-1 is the addition request or the deletion request of the terminal ID to or from the blacklist DB 132, and the presence of the right of the user terminal 201 with respect to the received process request is stored in the right setting information of the eKey.

Blacklist DB 132

The blacklist DB 132 is a database that stores the terminal ID of the user terminal 20-1 in which all the process requests to the lock control device 10-3 are denied. For example, in the blacklist DB 132, an addition date and time and a target terminal ID are stored in association with each other. The blacklist DB 132 is an example of an access prohibition terminal list in the present disclosure.

eKey

Here, an exemplary configuration (right setting information 4008-3) of the right setting information included in the eKey according to the third embodiment will be described with reference to FIG. 36. As illustrated in FIG. 36, the right setting information 4008-3 further stores the presence or absence (ON/OFF) of the right of the user terminal 20-1 related to viewing, changing, and deleting of registered content of the blacklist DB 132, compared to the right setting information 4008-2 illustrated in FIG. 31.

(3-2-1-2. Process Executing Unit 110)

The process executing unit 110 according to the third embodiment adds or deletes the terminal ID received from the user terminal 20-1 to or from the blacklist DB 132 when the process request received from the user terminal 20-1 is the addition request or the deletion request of the terminal ID to or from the blacklist DB 132, and the process request is determined to be permitted by the determination unit 108.

(3-2-1-3. Storage Unit 124)

The storage unit 124 according to the third embodiment further stores the blacklist DB 132.

Note that other components included in the lock control device 10-3 are substantially the same as the first embodiment. Also, the configurations of the user terminal 20-1 and the server 30-1 are substantially the same as the first embodiment.

<3-3. Operation>

The configuration according to the third embodiment has been described above. Then, an operation according to the third embodiment will be described. An operation (S1411) of the "process request determination process" according to the third embodiment will be described below with reference to FIGS. 37 and 38. This operation is an alternative operation to the operations illustrated in FIGS. 24 and 25. An operation example will be described below in connection with a situation in which the user terminal 20-1 requests the lock control device 10-3 to add a terminal ID to the blacklist DB 132.

The other types of operations are similar to those of the first embodiment, and thus a description thereof will be omitted.

{3-3-1. Process Request Determination Process}

Operations of S3001 to S3007 illustrated in FIG. 37 are the same as the operations of S1501 to S1507 illustrated in FIG. 24.

After S3007 the determination unit 108 of the lock control device 10-3 checks whether the terminal ID included in the eKey received in S3007 is registered in the blacklist DB 132 (S3009). When the terminal ID is registered in the blacklist DB 132 (Yes in S3009), the lock control device 10-3 performs an operation of S3033, which will be described later.

On the other hand, when the terminal ID is not registered in the blacklist DB 132 (No in S3009), the lock control device 10-3 performs the same operations as the operations of S1509 to S1513 illustrated in FIG. 24 (S3011 to S3015).

Here, operations subsequent to S3015 will be described with reference to FIG. 38. As illustrated in FIG. 38, when the current time is determined to be within the effective period included in the received eKey in S3015 (Yes in S3015), the determination unit 108 checks whether an addition right of adding a terminal ID to the blacklist DB 132 is set for the user terminal 20-1 by checking the right setting information included in the eKey received in S3007 (S3021). When the addition right to the blacklist DB 132 is not set for the user terminal 20-1 (No in S3021), the lock control device 10-3 performs an operation of S3033, which will be described later.

On the other hand, when the addition right to the blacklist DB 132 is set for the user terminal 20-1 (Yes in S3021), the lock control device 10-3 performs the same operations as the operations of S1523 to S1531 illustrated in FIG. 25 (S3023 to S3031).

When the response data received in S3027 is determined not to be valid in S3031 (No in S3031), the determination unit 108 does not permit the process request received in S3007, that is, the addition request of the terminal ID to the blacklist DB 132 (S3033). Then, the lock control device 10-3 performs an operation of S3037, which will be described later.

On the other hand, when the received response data is determined to be valid (Yes in S3031), the determination unit 108 permits the process request received in S3007. Then, the process executing unit 110 adds the terminal ID included in the process request received in S3007 to the blacklist DB 132 (S3035).

An operation of S3037 illustrated in FIG. 38 is the same as the operation of S1537 illustrated in FIG. 25.

<3-4. Effects>

{3-4-1. Effect 1}

As described above with reference to FIGS. 35 and 38, the lock control device 10-3 according to the third embodiment does not permit the process request received from the user terminal 20-1 when the terminal ID included in the eKey received from the user terminal 20-1 is registered in the blacklist DB 132.

Thus, by registering the terminal ID of the user terminal 20-1 to which the eKey desired to be invalidated was issued in the blacklist DB 132, the owner terminal can compulsorily invalidate the eKey of the user terminal 20-1 of the terminal ID before the expiration date passes.

{3-4-2. Effect 2}

In the second embodiment, even when the eKey ID is registered in the eKey invalidation list DB 326, for example, if communication between the user terminal 20-1 that stores the eKey corresponding to the eKey ID and the server 30-2 is disconnected according to the radio wave state or the like, it is difficult for the server 30-2 to stop use of the eKey by the user terminal 20-1. In other words, the user terminal 20-1 for which the eKey invalidation registration is performed may temporarily cause the lock control device 10-1 to execute various kinds of processes such as the unlocking process.

On the other hand, in the third embodiment, the lock control device 10-3 stores the blacklist DB 132. Thus, it is not possible for the user terminal 20-1 of the terminal ID registered in the blacklist DB 132 to execute a process on the lock control device 10-3 without depending on a communication state. In other words, according to the third embodiment, it is possible to reliably invalidate the eKey.

4. Fourth Embodiment

<4-1. Background>

In the above, the third embodiment has been described. Next, the fourth embodiment will be described. First, the background that has lead up to creating the fourth embodiment will be described.

Generally, for the user having an unlocking right, it is desirable to unlock a door with a small load. For example, a method of automatically unlocking the door when the user terminal approaches the door is considered. However, in this method, even when the user is in the house, the door is likely to be unlocked. As a result, a malicious person may intrude into the house.

As will be described later, according to the fourth embodiment, it is possible to prevent the door from being automatically unlocked without intention of the user. Further, a user terminal 20-4 according to the fourth embodiment may suppress power consumption of the user terminal 20-4 by limiting a measurement range of position information causing the door to be automatically unlocked.

<4-2. System Configuration>

The system configuration according to the fourth embodiment is same as the first embodiment illustrated in FIG. 1 or FIG. 30.

<4-3. Configuration>

Next, a configuration according to the fourth embodiment will be described in detail. In the following, a description of content overlapping the first embodiment will be omitted.

{4-3-1. User Terminal 20-4}

FIG. 39 is a functional block diagram illustrating a configuration of the user terminal 20-4 according to the fourth embodiment. As illustrated in FIG. 39, the user terminal 20-4 does not include an imaging unit 224 and further includes a radio wave strength measuring unit 228 and a position information measuring unit 230, compared to the user terminal 20-1 illustrated in FIG. 7. The user terminal 20-4 includes a control unit 200-4 instead of the control unit 200-1.

(4-3-1-1. Control Unit 200-4)

The control unit 200-4 further includes a distance calculating unit 214, an outing flag changing unit 216, and a measurement control unit 218, compared to the control unit 200-1 according to the first embodiment. The control unit 200-4 does not include the two-dimensional code reading unit 202.

(4-3-1-2. Distance Calculating Unit 214)

The distance calculating unit 214 calculates a distance between lock position information stored in the storage unit 226 and position information measured by the position information measuring unit 230, which will be described later. Here, the lock position information is position information measured by the position information measuring unit 230, for example, when the user terminal 20-4 is positioned, for example, within a BLE zone of the lock control device 10-1, and the user inputs an initial setting on an initial setting screen displayed on the operation display unit 222.

For example, when a value of an outing flag stored in the storage unit 226 is set to OFF, and the position information measured by the position information measuring unit 230 is outside the BLE zone of the lock control device 10-1 (and, for example, outside a Wi-Fi zone when a Wi-Fi router is installed in a facility having a door in which the lock control device 10-1 is installed), the distance calculating unit 214 calculates a distance between the stored lock position information and the position information measured by the position information measuring unit 230. Here, the outing flag is a flag identifying whether the user carrying the user terminal 20-4 is currently out of home. For example, when a value of the outing flag is set to ON, it indicates that the user is out of home, and when the value of the outing flag is set to OFF, it indicates that the user is not out of home. "OFF" is an example of a first value in the present disclosure, and ON is an example of a second example in the present disclosure. The present disclosure is not limited to this example, and the first value and the second value may be different arbitrary numbers or characters, for example, the first value may be "0," and the second value may be "1." The value of the outing flag may be changed by the outing flag changing unit 216, which will be described later. As will be described later in detail, the outing flag may also be used for controlling the measurement by the position information measuring unit 230.

(4-3-1-3. Outing Flag Changing Unit 216)

The outing flag changing unit 216 changes the value of the outing flag based on the position information measured by the position information measuring unit 230. The outing flag changing unit 216 also changes the value of the outing flag based on a change in a radio wave strength measured by the radio wave strength measuring unit 228 and the value of the outing flag stored in the storage unit 226.

For example, when the value of the outing flag stored in the storage unit 226 is set to ON, and a measurement value of a first radio wave strength measured by the radio wave strength measuring unit 228 is changed from a value equal to or smaller than a first threshold value to a value larger than the first threshold value, the outing flag changing unit 216 switches the value of the outing flag from ON to OFF. Here, the first radio wave strength is, for example, the radio wave strength of the BLE received from the lock control device 10-1.

Further, when the value of the outing flag stored in the storage unit 226 is set to OFF, and the measurement value of the first radio wave strength measured by the radio wave strength measuring unit 228 is equal to or smaller than the first threshold value, and a measurement value of a second radio wave strength measured by the radio wave strength measuring unit 228 is equal to or smaller than a second threshold value, the outing flag changing unit 216 switches the value of the outing flag from OFF to ON based on the distance calculated by the distance calculating unit 214. For example, when the value of the outing flag is set to OFF, and the distance calculated by the distance calculating unit 214 is larger than a predetermined distance, the outing flag changing unit 216 switches the value of the outing flag from OFF to ON. The second radio wave strength is a radio wave strength received from a Wi-Fi router installed in a corresponding facility, for example. The second threshold value and the first threshold value may be different values or may be the same value.

Change Example 1 of Outing Flag

Here, the above function will be described in detail with reference to FIG. 40. First, process content when the user carrying the user terminal 20-4 is moving from a spot illustrated in FIG. 40 to a house 4, such as when the user carrying the user terminal 20-4 returns to the house 4, will be described. In this case, the value of the outing flag is set to ON (since the user is out of home). As illustrated in FIG. 40, at a spot A, the measurement value of the radio wave strength of the BLE received from the lock control device 10-1 is changed from a value equal to or smaller than the first threshold value to a value larger than the first threshold value. Thus, the outing flag changing unit 216 (of the user terminal 20-4) switches the value of the outing flag from ON to OFF when the user terminal 20-4 arrives at the spot A. As will be described later in detail, at this time, the user terminal 20-4 transmits the unlocking request to the lock control device 10-1, and thus the door is automatically unlocked.

Change Example 2 of Outing Flag

Further, process content when the user carrying the user terminal 20-4 is moving from the house 4 toward a spot E, for example, when the user carrying the user terminal 20-4 goes out, will be described. As described above, when the user is at the house 4, the value of the outing flag is set to OFF.

When the user passes through the spot A, the measurement value of the radio wave strength of the BLE received from the lock control device 10-1 is changed from a value larger than the first threshold value to a value equal to or smaller than the first threshold value. Thus, when the user terminal 20-4 is farther from the house 4 than the spot A, first, the distance calculating unit 214 calculates a distance between the lock position information stored in the storage unit 226 and the position information measured by the position information measuring unit 230. Here, the lock position information is assumed to be position information of substantially the same position as the position of the lock control device 10-1 illustrated in FIG. 40.

Then, the outing flag changing unit 216 compares the distance calculated by the distance calculating unit 214 with a predetermined distance ("a" illustrated in FIG. 40), and when the calculated distance is larger than "a," the outing flag changing unit 216 switches the value of the outing flag from OFF to ON. In the illustrated in FIG. 40, when the user terminal 20-4 is farther from the house 4 than a spot B, the distance calculated by the distance calculating unit 214 is larger than "a." Thus, when the user terminal 20-4 is farther from the house 4 than the spot B, the outing flag changing unit 216 switches the value of the outing flag from OFF to ON.

(4-3-1-4. Measurement Control Unit 218)

The measurement control unit 218 controls the measurement by the position information measuring unit 230 based on the value of the outing flag stored in the storage unit 226 and the measurement value of the radio wave strength measured by the radio wave strength measuring unit 228. For example, when the outing flag changing unit 216 changes the value of the outing flag from OFF to ON, the measurement control unit 218 causes the position information measuring unit 230 to stop the measurement of the position information. Further, when the value of the outing flag is set to OFF, the measurement value of the first radio wave strength measured by the radio wave strength measuring unit 228 is equal to or smaller than the first threshold value, and the measurement value of the second radio wave strength is equal to or smaller than the second threshold value, the measurement control unit 218 causes the position information measuring unit 230 to resume the measurement of the position information. According to this control example, since the position information measuring unit 230 does not measure the position information in only certain cases, it is possible to suppress power consumption of the user terminal 20-4.

Here, the above function will be described in detail with reference to FIG. 41. FIG. 41 is a diagram corresponding to the example illustrated in FIG. 40, and is an explanatory diagram illustrating a range in which the measurement control unit 218 causes the position information measuring unit 230 to measure the position information. Further, when the user terminal 20-4 is positioned within a range 80 indicated by a circle in FIG. 41, the measurement value of the radio wave strength of the BLE received from the lock control device 10-1 by the user terminal 20-4 is assumed to be larger than the first threshold value. Further, the measurement value of the radio wave strength received from a Wi-Fi router 34 installed in the house 4 by the user terminal 20-4 within a range 82 illustrated in FIG. 41 is assumed to be larger than the second threshold value. A range 84 indicated by a circle in FIG. 41 is assumed to be a range within a predetermined distance "a") from the lock position information stored in the storage unit 226.

In the example illustrated in FIG. 41, when the user terminal 20-4 is positioned within a measurement region 86 indicated by an alternating long and short dashed line, the measurement control unit 218 causes the position information measuring unit 230 to measure the position information, for example, at predetermined time intervals.

(4-3-1-5. Transmission Control Unit 212)

The transmission control unit 212 according to the fourth embodiment controls transmission of the unlocking request to the lock control device 10-1 based on the value of the outing flag stored in the storage unit 226 and the value of the radio wave strength measured by the radio wave strength measuring unit 228. For example, when the value of the outing flag is set to ON, and the measurement value of the first radio wave strength measured by the radio wave strength measuring unit 228 is changed from a value equal to or smaller than the first threshold value to a value larger than the first threshold value, the transmission control unit 212 causes the communication unit 220 to transmit the unlocking request to the lock control device 10-1.

(4-3-1-6. Storage Unit 226)

The storage unit 226 according to the fourth embodiment further stores the outing flag.

(4-3-1-7. Radio Wave Strength Measuring Unit 228)

The radio wave strength measuring unit 228 measures, for example, the radio wave strength of the BLE received from the lock control device 10-1. Further, when the router is installed in the facility, the radio wave strength measuring unit 228 may measure the radio wave strength of Wi-F received from the router.

(4-3-1-8. Position Information Measuring Unit 230)

The position information measuring unit 230 measures current position information of the user terminal 20-4. Here, the position information is, for example, information including longitude and latitude.

For example, the position information measuring unit 230 receives positioning signals from positioning satellites such as a global positioning system (GPS), and measures the current position information. The position information measuring unit 230 may receive positioning signals from one type of satellite or receive positioning signals from a plurality of types of satellite signals, and measure the position information based on a combination of the received signals.

{4-3-2. Lock Control Device 10-1 and Server 30-1}

The lock control device 10-1 and the server 30-1 have substantially the same configuration as in the first embodiment.

<4-4. Operation>

The configuration of the fourth embodiment has been described above. Next, an operation according to the fourth embodiment will be described in "4-4-1. Operation at Time of Initial Setting" through "4-4-2. Operation at Time of Automatic Unlocking Use." The other types of operations are the same as in the first embodiment (illustrated in FIGS. 12 to 29), and thus a description thereof will be omitted.

{4-4-1. Operation at Time of initial Setting}

FIG. 42 is a flowchart illustrating an "operation at the time of initial setting" according to the fourth embodiment. Here, the description will proceed with an operation of the user of the user terminal 20-4 registering the lock position information near the lock control device 10-1. In the following, the radio wave strength measuring unit 228 of the user terminal 20-4 is assumed to measure the radio wave strength of the BLE received from the lock control device 10-1, for example, at predetermined time intervals.

As illustrated in FIG. 42, first, for example, when the user inputs an initial setting to the operation display unit 222, the control unit 2004 determines whether the radio wave strength of the BLE measured immediately before by the radio wave strength measuring unit 228 is larger than the first threshold value (S4001). When the measured radio wave strength of the BLE is equal to or smaller than the first threshold value (No in S4001), the control unit 200-4 causes the operation display unit 222 to display a message such as "please move close to a door and setup." Then, the "operation at the time of initial setting" ends.

On the other hand, when the measured radio wave strength of the BLE is larger than the first threshold value (Yes in S4000, the control unit 200-4 displays a setup screen on the operation display unit 222 (S4003).

Then, when the Wi-Fi router is installed in the house having the door in which the lock control device 10-1 is installed (Yes in S4005), the user inputs a MAC address of the Wi-Fi router in the setup screen displayed in S4003 (S4007).

When no Wi-Fi router is installed in the house (No in S4005) or after S4007, the measurement control unit 218 causes the position information measuring unit 230 to measure the current position information (S4009).

Thereafter, the control unit 200-4 stores the position information measured in S4009 in the storage unit 226 as the lock position information (S4011).

Thereafter, the outing flag changing unit 216 may set the value of the outing flag to ON and also store the outing flag in the storage unit 226. Further, the user may input a usage start of an "automatic unlocking mode" in the setup screen.

{4-4-2. Operation at Time of Automatic Unlocking Use}

Next, an "operation at the time of automatic unlocking use" according to the fourth embodiment will be described in detail with reference to FIGS. 43 and 44. This operation is an operation example after the lock position information is registered, and the usage start of the "automatic unlocking mode" is set in the setup screen. In the following, the radio wave strength measuring unit 228 of the user terminal 20-4 is assumed to measure the radio wave strength of the BLE received from the lock control device 10-1, for example, at predetermined intervals.

As illustrated in FIG. 43, first, the outing flag changing unit 216 of the user terminal 20-4 determines whether the value of the outing flag stored in the storage unit 226 is set to ON (S4101). When the value of the outing flag is set to OFF (No in S4101), the user terminal 20-4 performs an operation of S4111, which will be described later.

On the other hand, when the value of the outing flag is set to ON (Yes in S4101), the control unit 200-4 determines whether the radio wave strength of the BLE measured immediately before by the radio wave strength measuring unit 228 is larger than the first threshold value (S4103). When the measured radio wave strength of the BLE is equal to or smaller than the first threshold value (No in S4103), the user terminal 20-4 stands by, for example, for a predetermined period of time, and performs the operation of S4103 again.

On the other hand, when the measured radio wave strength of the BLE is larger than the first threshold value (Yes in S4103), the communication unit 220 transmits the unlocking request to the lock control device 10-1 according to the control of the transmission control unit 212 (S4105). Then, the outing flag changing unit 216 changes the value of the outing flag from ON to OFF, and then stores the value of the outing flag in the storage unit 226 again (S4107). Accordingly, the user terminal 20-4 may identify that the user is not currently out of home.

Here, operations subsequent to S4107 will be described with reference to FIG. 44. As illustrated in FIG. 44, first, the control unit 200-4 determines whether the radio wave strength of the BLE measured immediately before by the radio wave strength measuring unit 228 is larger than the first threshold value (S4111). When the measured radio wave strength of the BLE is larger than the first threshold value (Yes in S4111), the user terminal 20-4 performs an operation of S4121, which will be described later.

On the other hand, when the measured radio wave strength of the BLE is equal to or smaller than the first threshold value (No in S4111), the control unit 200-4 determines whether the radio wave strength that was received from the Wi-Fi router installed in the facility and measured immediately before by the radio wave strength measuring unit 228 is larger than the second threshold value (S4113). When the measured radio wave strength of Wi-Fi is larger than the second threshold value (Yes in S4113), the user terminal 20-4 performs an operation of S4121, which will be described later.

On the other hand, when the measured radio wave strength of Wi-Fi is equal to or smaller than the second threshold value (No in S4113), the measurement control unit 218 causes the position information measuring unit 230 to start to measure the position information (S4115). Thus, the position information measuring unit 230 measures the current position information, for example, at predetermined intervals.

Then, the distance calculating unit 214 calculates a distance between the position information measured immediately before by the position information measuring unit 230 and the lock position information stored in the storage unit 226 (S4117).

Then, the outing flag changing unit 216 determines whether the distance calculated in S4117 is larger than a predetermined distance (S4119). When the calculated distance is equal to or smaller than the predetermined distance (No in S4119), the user terminal 20-4 stands by for a predetermined period of time (S4121). Then, the user terminal 20-4 performs the operation of S4111 again.

On the other hand, when the calculated distance is larger than the predetermined distance (Yes in S4119), the outing flag changing unit 216 changes the value of the outing flag from OFF to ON, and stores the value of the outing flag in the storage unit 226 again (S4123). Accordingly, the user terminal 20-4 may identify that the user is currently out of home.

Thereafter, the user terminal 20-4 performs the operation of S4103 again.

<4-5. Effects>

{4-5-1. Effect 1}

As described above, for example, with reference to FIGS. 39 to 44, the user terminal 20-4 according to the fourth embodiment transmits the unlocking request to the lock control device 10-1 when the stored value of the outing flag is set to ON, and the measurement value of the measured first radio wave strength is changed from a value equal to or smaller than the first threshold value to a value larger than the first threshold value. For example, when the user carrying the user terminal 20-4 returns to his or her house from a place where be or she has gone, the user terminal 20-4 transmits the unlocking request to the lock control device 10-1. Thus, it is possible to prevent the door from being automatically unlocked unintentionally.

Further, when the door is automatically unlocked, the user terminal 20-4 changes the value of the outing flag from ON to OFF, and maintains the value of the outing flag to be OFF as long as the user terminal 20-4 is positioned within a predetermined distance from the lock position. Thus, it is possible to prevent the door from being automatically unlocked regardless of whether or not the user terminal 20-4 is positioned in the house.

{4-5-2. Effect 2}

The user terminal 20-4 can determine whether or not the user of the user terminal 20-4 is out of home based on the result of measuring the radio wave strength received from the lock control device 10-1 (and the Wi-Fi router) and the result of measuring the position information with a high degree of accuracy and can record the determination result as the value of the outing flag.

{4-5-3. Effect 3}

According to the fourth embodiment, in order to perform the automatic unlocking, the lock control device 10-1 does not have to include a sensor for detecting the approach of the user terminal 20-4.

{4-5-4. Effect 4}

In the fourth embodiment, it is also possible to use an automatic locking system that transmit an explicit locking instruction or unlocking instruction to the lock control device 10-1 using an application installed in the user terminal 20-4 or that is mounted in the lock control device 10-1 together with the automatic unlocking process. As a result, it is possible to increase convenience of the user and implement door unlocking and locking.

{4-5-5. Effect 5}

The user terminal 20-4 controls whether the position information is measured based on the stored value of the outing flag and the measurement value of the radio wave strength received from the lock control device 10-1 or the Wi-Fi router. For example, when the value of the outing flag is set to OFF, the measurement value of the radio wave strength of the BLE is equal to or smaller than a threshold value, and the measurement value of the radio wave strength of the Wi-Fi is equal to or smaller than a threshold value, the user terminal 20-4 measures the position information, for example, at predetermined intervals, and in the other cases, the user terminal 20-4 does not measure the position information.

Thus, since the user terminal 20-4 does not measure the position information only in a certain cases, it is possible to suppress power consumption of the user terminal 20-4. For example, when the value of the outing flag is set to ON (that is, when the user is out of home) or when the Wi-Fi router is installed in the house of the user, and the user is in his or her house, it is unnecessary to measure the position information. Further, even when the Wi-Fi router is not installed in the house of the user, if the user terminal 20-4 is positioned within the BLE zone of the lock control device 10-1, it is unnecessary to measure the position information. In this case, the user terminal 20-4 does not measure the position information and thus it is possible to suppress power consumption.

<<5. Modifications>>

Embodiments of the present disclosure have been described above with reference to the accompanying drawings, whilst the present disclosure is not limited to the above examples, of course. A person skilled in the art may find various alterations and modifications within the scope of the appended claims, and it should be understood that they will naturally come under the technical scope of the present disclosure.

In above each embodiment, an example in which the lock control device 10-1 or the lock control device 10-3 are installed in a door at an entrance or in a room of a house has been described mainly, but embodiments are not limited to such examples. The lock control device 10-1 or the lock control device 10-3 can be installed in various types of doors, such as a door of a locker installed in an airport, a station, or the like, and a door of a car, for example. Also, it may be applied to a locking mechanism of a bicycle or the like.

Also, the steps in the operation of above each embodiment are needless to be executed in the described order. For example, the steps may be executed in the order changed as appropriate. Also, the steps may be executed in parallel or individually in part, instead of being executed in temporal sequence.

Also, according to above each embodiment, a computer program for causing a processor such as a CPU and hardware such as a RAM to exercise a function equivalent to each configuration of the above lock control device 10-1 or the lock control device 10-3 may be provided. Also, a recording medium storing the computer program is provided.

Additionally, the present technology may also be configured as below.

(1)

A lock control device attachable to a locking mechanism, the lock control device including circuitry configured to receive key information and a process request from a first communication device, the key information including authorization information of the first communication device related to a plurality of types of functions of the lock control device, and determine whether the process request is permitted based on the key information, wherein the key information further includes identification information of the first communication device.

(2)

The lock control device according to (1), wherein the authorization information includes information indicating a right that is set with respect to unlocking or locking of the locking mechanism, and the process request includes an unlocking request or a locking request of the locking mechanism.

(3)

The lock control device according to (1) or (2), wherein the authorization information further includes information indicating a right that is set with respect to viewing of an operation log stored in the lock control device, and the process request further includes a viewing request of the operation log.

(4)

The lock control device according to any of (1) to (3), wherein the authorization information further includes information indicating a right that is set with respect to changing of time information stored in the lock control device or changing of setting information of a plurality of devices included in the lock control device, and the process request further includes a change request of the time information or a change request of the setting information of one or more of devices among the plurality of devices.

(5)

The lock control device according to any of (1) to (4), further including a non-transitory computer-readable medium configured to store an access prohibition device list storing identification information of at least one communication device having no access rights to the lock control device, wherein the circuitry determines that the process request is not permitted when the identification information of the first communication device is stored in the access prohibition device list.

(6)

The lock control device according to any of (1) to (5), wherein the authorization information further includes information indicating a right that is set with respect to addition or deletion of identification information of another communication device to or from the access prohibition device list, and the process request further includes an addition request or a deletion request of the identification information of another communication device to or from the access prohibition device list.

(7)

The lock control device according to any of (1) to (6), wherein the key information further includes a first public key associated with the first communication device.

(8)

The lock control device according to any of (1) to (7), wherein the circuitry is further configured to receive a first common key and a second public key associated with a second communication device from the second communication device, wherein the lock control device further includes a non-transitory computer-readable medium configured to store a second common key associated with the lock control device, and wherein the circuitry is further configured to register the second communication device as an owner device of the lock control device and to initiate storage of the second public key into the computer-readable medium when a comparison result indicates that the first common key is identical to the second common key.

(9)

The lock control device according to any of (1) to (8), wherein the key information is issued in association with the first communication device by the second communication device registered as the owner device of the lock control device.

(10)

The lock control device according to any of (1) to (9), wherein the key information further includes signature information for the first public key by the second communication device.

(11)

The lock control device according to any of (1) to (10), wherein the circuitry is further configured to verify a validity of the first public key based on the signature information for the first public key, and determine that the process request is permitted when the first public key is verified to be valid.

(12)

The lock control device according to any of (1) to (11), wherein the circuitry is further configured to receive, from the first communication device, first information generated based on a first secret key corresponding to the first public key, verify the first information based on the first public key, and determine that the process request is permitted when the first information is verified to be valid.

(13)

The lock control device according to any of (1) to (12), wherein the circuitry is further configured to receive sub key information and a second process request to the lock control device from a third communication device, the sub key information including authorization information of a right of the third communication device related to the plurality of types of functions of the lock control device, and determine whether the second process request is permitted based on the sub key information, wherein the sub key information is issued in association with the third communication device by the first communication device, and wherein the right that is set to the third communication device with respect to the plurality of types of functions is equal to or lower than the right set to the first communication device.

(14)

An information processing method implemented via at least one processor, the method including:

receiving, by a lock control device and from a first communication device, key information and a process request, the key information including authorization information of the first communication device related to a plurality of types of functions of the lock control device; and determining whether the process request is permitted based on the key information, wherein the key information further includes identification information of the first communication device.

(15)

A non-transitory: computer-readable medium having embodied thereon a program, which when executed by a processor of a computer causes the computer to execute a method, the method including:

receiving, by a lock control device and from a first communication device, key information and a process request, the key information including authorization information of the first communication device related to a plurality of types of functions of the lock control device; and determining whether the process request is permitted based on the key information, wherein the key information further includes identification information of the first communication device.

(16)

A communication device, including:

circuitry configured to obtain signal strength information associated with a first signal received from a lock control device; and initiate transmission of an unlocking request to the lock control device based on the signal strength information associated with the first signal.

(17)

The communication device according to (16), further including:

a non-transitory computer-readable medium configured to store a parameter, wherein the circuitry is further configured to obtain position information of the communication device, and control a changing of a value of the parameter based on the obtained position information.

(18)

The communication device according to (16) or (17), wherein the transmission of the unlocking request to the lock control device is initiated based on a measured signal strength of the first signal and the value of the parameter.

(19)

The communication device according to any of (16) to (18), wherein the circuitry is further configured to control the obtaining of the position information so as to stop the obtaining when the value of the parameter is changed from a first value to a second value.

(20)

The communication device according to any of (16) to (19), wherein when the unlocking request is transmitted to the lock control device, the circuitry is further configured to change the value of the parameter from the second value to the first value, and when the value of the parameter is the first value, the measured signal strength of the first signal is equal to or smaller than a first threshold value, and a measured signal strength of a second signal received by the communication terminal is equal to or smaller than a second threshold value, the circuitry is configured to resume the obtaining of the position information.

(21)

A lock control device, including;

a communication unit configured to receive key information and a process request to the lock control device from a first communication terminal, the key information including setting information of a right of the first communication terminal related to a plurality of types of functions of the lock control device and a first public key associated with the first communication terminal; and a determination unit configured to determine whether the process request is permitted based on the key information.

(22)

The lock control device according to (21), further including:

a locking unit, wherein the setting information includes information indicating a right that is set with respect to unlocking or locking of the locking unit, and the process request includes an unlocking request or a locking request of the locking unit.

(23)

The lock control device according to (22), wherein the setting information further includes information indicating a right that is set with respect to viewing of an operation log stored in the lock control device, and the process request further includes a viewing request of the operation log.

(24)

The lock control device according to (22) or (23), wherein the setting information further includes information indicating a right that is set with respect to changing of time information stored in the lock control device or changing of setting information of a plurality of devices included in the lock control device, and the process request farther includes a change request of the time information or a change request of the setting information of one or more of devices among the plurality of devices.

(25)

The lock control device according to any one of (22) to (24), further including:

a storage unit configured to store an access prohibition terminal list storing identification information of a communication terminal having no access rights to the lock control device, wherein the key information further includes identification information of the first communication terminal, and the determination unit determines that the process request is not permitted when the identification information of the first communication terminal is stored in the access prohibition terminal list.

(26)

The lock control device according to (25), wherein the setting information further includes information indicating a right that is set with respect to addition or deletion of identification information of another communication terminal to or from the access prohibition terminal list, and the process request further includes an addition request or a deletion request of identification information of another communication terminal to or from the access prohibition terminal list.

(27)

The lock control device according to any one of (22) to (26), wherein the communication unit further receives a first common key and a second public key associated with a second communication terminal from the second communication terminal, and the lock control device further includes:

a storage unit configured to store a second common key associated with the lock control device; and an owner terminal registering unit configured to register the second communication terminal as an owner terminal of the lock control device and store the second public key in the storage unit when a comparison result indicates that the first common key is identical to the second common key.

(28)

The lock control device according to (27), wherein the key information is information that is issued in association with the first communication terminal by the second communication terminal registered as the owner terminal of the lock control device.

(29)

The lock control device according to (28), wherein the key information further includes signature information for the first public key by the second communication terminal.

(30)

The lock control device according to (29), further including:

a key verifying unit configured to verify a validity of the first public key based on the signature information for the first public key, wherein the determination unit further determines that the process request is permitted when the key verifying unit verifies the first public key to be valid.

(31)

The lock control device according to (30), wherein the communication unit further receives first information generated based on a first secret key corresponding to the first public key from the first communication terminal, the lock control device further includes:

a verification processing unit configured to verify the first information based on the first public key, and the determination unit further determines that the process request is permitted when the verification processing unit verifies the first information to be valid.

(32)

The lock control device according to any one of (22) to (31), wherein the communication unit further receives sub key information and a second process request to the lock control device from a third communication terminal, the sub key information including setting information of a right of the third communication terminal related to the plurality of types of functions of the lock control device and a third public key associated with the third communication terminal, the determination unit further determines whether the second process request is permitted based on the sub key information, the sub key information is information that is issued in association with the third communication terminal by the first communication terminal, and the right that is set to the third communication terminal with respect to the plurality of types of functions is equal to or lower than the right set to the first communication terminal.

(33)

An information processing method, including:

receiving key information and a process request to a lock control device from a first communication terminal, the key information including setting information of a right of the first communication terminal related to a plurality of types of functions of the lock control device and a first public key associated with the first communication terminal; and determining whether the process request is permitted based on the key information.

(34)

A program for causing a computer to function as:

a communication unit configured to receive key information and a process request to the lock control device from a first communication terminal, the key information including setting information of a right of the first communication terminal related to a plurality of types of functions of the lock control device and a first public key associated with the first communication terminal; and a determination unit configured to determine whether the process request is permitted based on the key information.

(35)

A communication terminal, including:

a radio wave strength measuring unit configured to measure a first radio wave strength received from a lock control device; and a transmission control unit configured to control transmission of an unlocking request to the lock control device based on a value of the first radio wave strength measured by the radio wave strength measuring unit.

(36)

The communication terminal according to (35), further including:

a storage unit configured to store an outing flag;

a position information measuring unit configured to measure position information of the communication terminal; and an outing flag changing unit configured to change a value of the outing flag based on the position information measured by the position information measuring unit.

(37)

The communication terminal according to (36), wherein the transmission control unit controls transmission of the unlocking request to the lock control device based on a measurement value of the first radio wave strength and the value of the outing flag.

(38)

The communication terminal according to (37), further including:

a measurement control unit configured to cause the position information measuring unit to stop measuring of the position information when the value of the outing flag is changed from a first value to a second value.

(39)

The communication terminal according to (38), wherein, when the unlocking request is transmitted to the lock control device, the outing flag changing unit changes the value of the outing flag from the second value to the first value, and when the value of the outing flag is the first value, the measurement value of the first radio wave strength measured by the radio wave strength measuring unit is equal to or smaller than a first threshold value, and a measurement value of the second radio wave strength is equal to or smaller than a second threshold value, the measurement control unit causes the position information measuring unit to resume the measuring of the position information.

REFERENCE SIGNS LIST

10-1, 10-3 lock control device
20-1, 20-4 user terminal
22 communication network
30-1, 30-2 server
32 database
34 Wi-Fi router
100-1, 100-3, 200-1, 200-4, 300-1, 300-2 control unit
102, 302 information registering unit
104 key information verifying unit
106, 310 authentication information verifying unit
108 determination unit
110 process executing unit
112, 308 challenge generating unit
114, 212, 306 transmission control unit
120, 220, 320 communication unit
122 locking unit
124, 226, 322 storage unit
126 lock key file
128 owner information file
130 operation log DB
132 blacklist DB
202 two-dimensional code reading unit
204 digital signature unit
206 key information issuing unit
208 authentication processing unit
210 operation recognizing unit
214 distance calculating unit
216 outing flag changing unit
218 measurement control unit
222 operation display unit
224 imaging unit
228 radio wave strength measuring unit
230 position information measuring unit
304 key information issuance requesting unit
312 authenticating unit
314 invalidation list registering it
324 owner information DB
326 invalidation list DB

The invention claimed is:

1. A communication device, comprising:

circuitry configured to obtain signal strength information associated with a first signal received from a lock control device, and initiate transmission of an unlocking request to the lock control device based on the signal strength information associated with the first signal; and a non-transitory computer-readable medium configured to store a parameter, wherein the circuitry is further configured to obtain position information of the communication device, and control a changing of a value of the parameter based on the obtained position information, and wherein the transmission of the unlocking request to the lock control device is initiated based on a measured signal strength of the first signal and the value of the parameter, and wherein the signal strength information of the first signal and the value of the parameter are obtained independently of each other.

2. The communication device according to claim 1, wherein the circuitry is further configured to control the obtaining of the position information so as to stop the obtaining when the value of the parameter is changed from a first value to a second value.

3. The communication device according to claim 2, wherein when the unlocking request is transmitted to the lock control device, the circuitry is further configured to change the value of the parameter from the second value to the first value, and when the value of the parameter is the first value, the measured signal strength of the first signal is equal to or smaller than a first threshold value, and a measured signal strength of a second signal received by the communication device is equal to or smaller than a second threshold value, the circuitry is further configured to resume the obtaining of the position information.

4. The communication device according to claim 2, wherein the lock control device is installed in a door, and the parameter identifies whether the communication device is located at an inside of the door or an outside of the door.

5. The communication device according to claim 4, wherein the first value indicates that the communication device is located at the inside of the door and the second value indicates that the communication device is located at the outside of the door.

6. The communication device according to claim 2, wherein the circuitry is further configured to control the obtaining of the position information so as to resume the obtaining of the position information when the value of the parameter is the first value.

7. The communication device according to claim 2, wherein, when the value of the parameter is the first value, the measured signal strength of the first signal is equal to or smaller than a first threshold value, and a measured signal strength of a second signal received by the communication device is equal to or smaller than a second threshold value, the circuitry is further configured to resume the obtaining of the position information.

8. An information processing method implemented via at least one processor, the method comprising:

obtaining signal strength information associated with a first signal received from a lock control device;

transmitting an unlocking request to the lock control device based on the signal strength information associated with the first signal;

obtaining position information of a communication device; and changing, based on the obtained position information, a value of a parameter stored in a non-transitory computer-readable medium, wherein the transmission of the unlocking request to the lock control device is initiated based on a measured signal strength of the first signal and the value of the parameter, and wherein the signal strength information of the first signal and the value of the parameter are obtained independently of each other.

9. A non-transitory computer-readable medium having embodied thereon a program, which when executed by a processor of a computer causes the computer to execute a method, the method comprising:

obtaining signal strength information associated with a first signal received from a lock control device;

transmitting an unlocking request to the lock control device based on the signal strength information associated with the first signal;

obtaining position information of a communication device; and changing, based on the obtained position information, a value of a parameter stored in a non-transitory computer-readable medium, wherein the transmission of the unlocking request to the lock control device is initiated based on a measured signal strength of the first signal and the value of the parameter, and wherein the signal strength information of the first signal and the value of the parameter are obtained independently of each other.

* * * * *